US010718170B2

(12) United States Patent
Recker et al.

(10) Patent No.: US 10,718,170 B2
(45) Date of Patent: Jul. 21, 2020

(54) VISE ARRANGEMENT FOR AN UNDERGROUND DRILLING MACHINE

(71) Applicant: Vermeer Manufacturing Company, Pella, IA (US)

(72) Inventors: Clint Recker, Pella, IA (US); Tanner Vos, Harvey, IA (US)

(73) Assignee: Vermeer Manufacturing Company, Pella, IA (US)

( * ) Notice: Subject to any disclaimer, the term of this patent is extended or adjusted under 35 U.S.C. 154(b) by 27 days.

(21) Appl. No.: 16/028,625

(22) Filed: Jul. 6, 2018

(65) Prior Publication Data

US 2019/0010770 A1 Jan. 10, 2019

Related U.S. Application Data

(60) Provisional application No. 62/530,757, filed on Jul. 10, 2017.

(51) Int. Cl.

| | |
|---|---|
| ***E21B 19/14*** | (2006.01) |
| ***E21B 19/08*** | (2006.01) |
| ***E21B 7/04*** | (2006.01) |
| ***E21B 19/16*** | (2006.01) |

(52) U.S. Cl.

CPC ..... *E21B 19/14* (2013.01); *E21B 19/08* (2013.01)

(58) Field of Classification Search

CPC . E21B 7/04; E21B 19/16; E21B 19/08; E21B 19/147; E21B 7/043; E21B 19/163; E21B 19/164

See application file for complete search history.

(56) References Cited

U.S. PATENT DOCUMENTS

| | | | |
|---|---|---|---|
| 5,050,283 | A | 9/1991 | Piipponen et al. |
| 5,556,263 | A | 9/1996 | Jacobsen et al. |
| 5,607,280 | A | 3/1997 | Razendaal |
| 5,740,703 | A | 4/1998 | Perry |
| 6,179,065 | B1 | 1/2001 | Payne et al. |
| 6,332,502 | B1 | 12/2001 | Mills et al. |
| 6,543,551 | B1 | 4/2003 | Sparks et al. |
| 6,550,547 | B1 | 4/2003 | Payne et al. |
| 6,880,430 | B2 | 4/2005 | Carlson |
| 7,284,624 | B2 | 10/2007 | Tjader |

(Continued)

FOREIGN PATENT DOCUMENTS

| | | | |
|---|---|---|---|
| CN | 1414208 | A | 4/2003 |
| CN | 103069096 | A | 4/2013 |

(Continued)

OTHER PUBLICATIONS

U.S. Appl. No. 15/967,975, filed May 1, 2018 and entitled "Dual Rod Directional Drilling Machine" (109 pgs).

(Continued)

*Primary Examiner* — D. Andrews
*Assistant Examiner* — Manuel C Portocarrero
(74) *Attorney, Agent, or Firm* — Michael Best and Friedrich LLP

(57) ABSTRACT

The present disclosure relates to a vise arrangement for a directional drilling machine. The vise arrangement can include a translatable and pivotal vise. The vise arrangement can also include up-hole and down-hole rod guides/supports. The vise arrangement can further include a lubrication dispenser.

16 Claims, 43 Drawing Sheets

(56) References Cited

U.S. PATENT DOCUMENTS

| | | | | |
|---|---|---|---|---|
| 7,665,514 | B2 | 2/2010 | Patterson | |
| 9,127,518 | B1 | 9/2015 | Sewell | |
| 9,598,905 | B2 | 3/2017 | Van Zee et al. | |
| 10,167,688 | B2 | 1/2019 | Jelgert et al. | |
| 2002/0157870 | A1 | 10/2002 | Bischel et al. | |
| 2004/0226412 | A1 | 11/2004 | Carlson | |
| 2009/0095526 | A1 | 4/2009 | Lane et al. | |
| 2011/0147011 | A1* | 6/2011 | Thibodeaux, Jr. ..... | E21B 19/10 166/382 |
| 2013/0068490 | A1 | 3/2013 | Van Zee et al. | |
| 2016/0305200 | A1* | 10/2016 | Gordey ..... | E21B 19/02 |

FOREIGN PATENT DOCUMENTS

| | | | |
|---|---|---|---|
| WO | 2009031166 | A1 | 3/2009 |
| WO | 2011146490 | A1 | 11/2011 |
| WO | 2017020008 | A1 | 2/2017 |

OTHER PUBLICATIONS

European Search Report for European Application No. 18182392, dated Nov. 7, 2018.

* cited by examiner

VISE ARRANGEMENT FOR AN UNDERGROUND DRILLING MACHINE

CROSS REFERENCE TO RELATED APPLICATION

This application claims the benefit of U.S. Provisional Patent Application Ser. No. 62/530,757, filed Jul. 10, 2017, which application is hereby incorporated by reference in its entirety.

TECHNICAL FIELD

The present disclosure relates generally to underground drilling machines. More particularly, the present disclosure relates to systems for making and breaking threaded joints between drill rods of the drilling machine.

BACKGROUND

Utility lines for water, electricity, gas, telephone, cable television, fiber optics, and the like are often run underground for reasons of safety and aesthetics. Sometimes, the underground utilities are buried in a trench that is then backfilled. However, trenching can be time consuming and can cause substantial damage to existing structures or roadways. As an alternative, underground drilling processes and systems have been developed for installing utilities underground. A common underground drilling process involves initially drilling a pilot bore from a launch point to a termination point. Once the pilot bore has been drilled, the pilot bore can be enlarged using a back reaming process. During back reaming, a product (e.g., a pipe) can be pulled behind the back reamer into the back reamed hole. For some drilling techniques, the launch point and the termination point can be below-ground (e.g., in pits). Other drilling techniques can have the launch and termination points at ground level. For this type of drilling process, the drilled bore often defines a curved path which angles into the ground from the launch point and gradually curves upwardly to reach the termination point. Known techniques can be used for steering the drilling machine during drilling so that the drilled bore follows a desired path. Relatively long bores can be drilled by coupling a relatively large number of drill rods together to form a drill string.

One type of directional drilling machine includes an elongate track (e.g., a rack) that can be aligned at an inclined orientation relative to the ground. A rotational driver (e.g., a gear box) is mounted on the track (e.g., by a carriage) so as to be movable along a drive axis that extends parallel to the length of the track. In certain examples, a rack and pinion drive is used to propel the rotational driver along the track. The rotational driver can include a drive member that is rotated by the rotational driver about the drive axis. The drive member is adapted for connection to a drill rod (e.g., a drill pipe). The drill rod can have a threaded end including either female or male threads.

To drill a bore using a directional drilling machine of the type described above, the track is oriented at an inclined angle relative to the ground, and the rotational driver is moved to an upper end of the track. Next, a drill rod is unloaded from a drill rod storage structure (e.g., a magazine) of the directional drilling machine and an upper end of the drill rod is coupled to the drive member of the rotational driver typically by a threaded connection. After the upper end of the drill rod has been coupled to the rotational driver, the lower end of the drill rod is coupled to a drill head if the drill rod is the first drill rod to be introduced into the ground, or to the upper-most drill rod of an existing drill string if the drill string has already been started. Thereafter, the rotational driver is driven in a downward direction along the inclined track while the drive member is concurrently rotated about the drive axis. As the rotational driver is driven down the track, the rotational driver transfers axial thrust and torque to the drill string. The axial thrust and torque is transferred through the drill string to the drill head thereby causing a cutting element (e.g., a bit) of the drill head to rotationally bore through the ground. The length of the bore is progressively increased as drill rods are progressively added to the drill string. The drill rods are most commonly secured together by threaded connections at joints between the drill rods.

After a bore has been drilled, it is necessary to pull back the drill string to remove the drill string from the bore. During the pull-back process, drill rods of the drill string are individually withdrawn from the ground, uncoupled from the drill string, and returned to the drill rod storage structure. Often, back reaming is done as part of the pull-back process. To uncouple a withdrawn drill rod from the remainder of the drill string, the threaded coupling between the withdrawn drill rod and the subsequent drill rod of the drill string is required to be broken before the withdrawn drill rod can be returned to the rod storage structure. Due to the torque loads associated with drilling and back reaming, threaded couplings between drill rods of a drill string can become quite tight and difficult to break.

Drilling machines have incorporated components and features for increasing efficiency relating to drill rod handling and relating to breaking and making joints. For example, linear and/or pivotal rod handling devices can be provided on drilling machines for moving drill rods between a rod storage structure and a drive axis of a rotational driver. Example rod handling devices are disclosed by U.S. Pat. Nos. 5,556,253; 5,607,280; 6,332,502; and 6,543,551. Also, one or more vises can be provided on the drilling machine for facilitating making and breaking threaded joint connections. Example vise arrangements for use with drilling machines are disclosed by U.S. Pat. No. 9,598,905; U.S. Patent Application Publication No. US 2009/0095526; and PCT Publication No. WO 2017/020008. Further, systems for applying a lubricant such as grease to the threaded joints of drill rods have been developed to facilitate breaking joints after drilling. U.S. Pat. No. 6,550,547 discloses a system on a drilling machine for applying grease to the threaded ends of drill rods.

Directional drilling machines can use different styles of drilling rods. One style of drilling rod includes a single pipe. In use, the single pipes are strung together and used to rotate a drilling bit at the downward end of the drill string. The drilling bit can include a steering face that is manipulated to steer the drill string. Another style of drill rod includes an inner pipe positioned within an outer pipe. This type of system is disclosed by U.S. Pat. No. 9,598,905, which is hereby incorporated by reference in its entirety. When dual-pipe style drilling rods are strung together, the resultant drill string includes inner and outer drill string sections that can be rotated independently, commonly, the inner drill string section can be used to rotate a drill bit while the outer drill string section can be used to control the position or orientation of a steering feature of the drill string.

Regardless of the type of drill rod used, efficiency is an important aspect of the operation of any drilling machine. In this regard, the ability to efficiently make and break joints between drill rods is an important efficiency consideration. Wear reduction is another important consideration in the design of drilling machines.

SUMMARY

The operational designs of rod handling systems and vise systems greatly influence the efficiency at which a drilling machine can be operated. Rod handling systems that linearly move rods in one motion between a rod storage location and a drive axis of a rotational driver can be operated in an extremely efficient manner. Also, vise systems having open-top vises can be very efficiently operated because the drilling machine operator is provided with a more open view of the rod joint location when making or breaking a joint. The ability to combine a linear rod handling system with an open-top vise system can be problematic because open-top vises inherently are closed at their sides thereby preventing rods from being laterally loaded into the vise system. Certain aspects of the present disclosure relate to open-top vise systems that are compatible with and can be efficiently operated in combination with linear rod handling devices. In certain examples, the open-top vise system can be used to prevent rotation of a drill rod as a threaded joint is made or broken between the drill rod and a rotational driver of the drilling machine thereby eliminating the need to incorporate a rod gripping/clamping device such as a vise into the rod handling device for performing this function.

Wear and durability can also greatly influence the efficiency at which a drilling machine can be operated. Wear and lack of durability can result in broken or worn parts that are required to be repaired. The need for repair results in expense related to the cost of the repair itself and related to machine down times. With regard to vise systems, poor alignment between drill rods and the vises can result in wear of the vises and the drill rods. Specifically, if a rod is not centered relative to the vise prior to clamping, a tapered shape of the vise will typically actively force centering of the rod during the clamping process, which causes the rod to slide across the tapered surface of the vise from the off-center position to a centered position. This sliding action under clamping pressure can result in wear of the vise and/or drill rods over time. Certain aspects of the present disclosure relate to vise systems having a self-centering feature for centering drill rods within vises of a vise system. In certain examples, the self-centering feature does not include any moving parts and is relatively simple and robust in design. In certain examples, the self-centering feature includes rod supports or rod guides between which the vises of the vise system are positioned. In certain examples, the rod supports or guides include rings. In certain examples, the self-centering feature is compatible with drill rods having ends with enlarged outer diameters and intermediate sections with reduced outer diameters.

One aspect of the present disclosure relates to a drilling machine having a vise arrangement for making and breaking joints between drill rods that has features to enhance the ability of an operator to visually monitor the position of a joint within the vise arrangement. In certain examples, the vise arrangement can include open-top vises for enhancing the ability of the operator to visually monitor the joint location of a joint between two drill rods desired to be clamped/gripped by the vises. In certain examples, the vise arrangement is compatible with a linear rod handling device that moves drill rods linearly along a drill rod transfer path between a rod storage structure and a drive axis of the drilling machine. In certain examples, the vise arrangement includes at least one vise that can be translated along the drive axis between first and second axial positions. In certain examples, in the first axial position, the translatable vise is offset from the drill rod transfer path and, in the second position, the translatable vise is intersected by the rod transfer path. In one example, in the second axial position, the translatable vise axially overlaps with a rod loading/unloading region of the drill rod storage structure. The rod loading/unloading region of the drill rod storage structure can be the opening or gap beneath the rod storage structure through which rods are moved to unload rods from the rod storage structure and to load rods into the rod storage structure. In certain examples, the translatable vise can be used to clamp onto a drill rod when in the second axial position to allow a rotational driver (e.g., a gear box) of the drilling machine to make or un-make a threaded joint with the drill rod. In certain examples, a gripper-less (e.g., vise-less) rod handling device can be used to move rods between the rod storage structure and the drive axis. In certain examples, the rod handling device may include a drill rod receiving location and drill rods may be magnetically secured at the drill rod receiving location. In certain examples, the rod handling device may not be required to include any robust clamping devices such as one or more vises since the translatable vise of the vise arrangement can be used to prevent rotation of the drill rods as the drill rods are coupled to and decoupled from the rotational driver. In certain examples, the rod handling device can include one or more linear shuttles. In certain examples, the linear shuttles can include arms that linearly slide between extended and retracted positions. In certain examples, the shuttles are configured to align drill rods with a drive axis of the rotational driver when extended, and to position drill rods beneath the drill rod storage structure when retracted. In certain examples, the linear shuttles can include blocking surfaces that block an open bottom side of the rod storage structure. In certain examples, the ability to translate at least one of the vises of the vise arrangement allows the translatable vise to be moved between a first position where the translatable vise does not obstruct a rod from being moved by the rod handling device from the rod storage structure to the drive axis and a second position where the translatable vise does obstruct a rod from being linearly moved by the rod handling device from the rod storage structure to the drive axis. In certain examples, the translatable vise is not configured to be able to laterally receive a drill rod linearly from the rod handling device.

Another aspect of the present disclosure relates to a vise arrangement for making and breaking drill rod joints that includes a rod guide/support arrangement for reducing wear of the vises and/or the drill rods. In certain examples, the guide/support arrangement can include a down-hole guide/support positioned below the vise arrangement and an up-hole guide/support positioned above the vise arrangement. In certain examples, the guides/supports can include guide/support rings having tapered lead-in surfaces. In certain examples, the guide/support rings can be centered on clamping axes of the vises. In certain examples, clamping axes of the vises can be coaxially aligned with a drive axis of a drilling machine. In certain examples, the vise arrangement can be used with drill rods having enlarged end portions having enlarged diameters. In certain examples, the enlarged ends of two drill rods meeting at a joint can define a length, and the guides/supports can be axially spaced apart by a distance less than or equal to the length. In this way, it is ensured that the enlarged end portions are within the guides/supports when the joint is aligned between the vises.

In certain examples, the guides/supports can be configured to automatically center the drill rods with respect to the clamping axes of the vises of the vise arrangement. In certain examples, the guides/supports do not have any movable parts and provide for passive centering of the drill rods with respect to the vises prior to clamping. In certain examples, the guides/supports can be configured to self-center rods within the vise arrangement.

Another aspect of the present disclosure relates to a drilling machine having a lubrication system for applying a lubricant such as grease to the threaded joints of a drill string. In certain examples, the drilling machine can include a rotational driver having a rod coupler that is adapted to be rotationally driven about a drive axis. The rod coupler is adapted to be coupled by a threaded connection to the up-hole-most drill rod of a drill string. In certain examples, a rod coupler can include a female connection interface including internal threads. In certain examples, the drilling machine can include a lubricant dispenser for dispensing lubricant into the female interface and onto the internal threads. By applying lubricant to the female interface, such lubricant is transferred to the threads of the drill rods when the drill rods are coupled to the rod coupler of the rotational driver. In certain examples, the lubricant dispenser can be positioned and/or oriented to facilitate dispensing lubricant into the female coupling interface of the rod coupler. In certain examples, the dispenser can have a dispensing axis oriented at an oblique angle relative to a drive axis about which the rotational coupler is translated and rotated. In certain examples, the dispenser can be carried with a translatable vise that can be translated along the drive axis.

Another aspect of the present disclosure relates to an underground drilling machine including a rotational driver having a rotationally driven rod coupler adapted for connection to an end of a drill rod. The rod coupler is rotatable about a drive axis. The rotational driver is mounted to move back and forth along the drive axis. The underground drilling machine also includes a rod storage structure positioned alongside the drive axis and a rod handling device for conveying drill rods back and forth between the drive axis and the rod storage structure along a rod transfer path. The underground drilling machine further includes first and second rod vises positioned along the drive axis. In some examples, the first rod vise has an open top. The second rod vise is positioned between the first rod vise and the rotational driver. The second rod vise is movable along the drive axis relative to the first rod vise between a first axial position and a second axial position. The second rod vise is offset from the rod transfer path when in the first axial position such that the second rod vise does not prevent a drill rod from being moved between the drill rod storage structure and the drive axis by the rod handling device. The second rod vise is intersected by the rod transfer path when in the second axial position and thereby is positioned so as to obstruct movement of a drill rod between the drill rod storage structure and the drive axis by the rod handling device. The second rod vise is pivotally movable about the drive axis between a first pivotable position and a second pivotable position. In some examples, the open side of the second rod vise faces upwardly when the second rod vise is in the first pivotable position.

Another aspect of the present disclosure relates to an underground drilling machine including a rotational driver having a rotationally driven rod coupler adapted for connection to an end of a drill rod. The rod coupler is rotatable about a drive axis. The rotational driver is mounted to move back and forth along the drive axis. The rod coupler includes a female connection interface including internal threads. The underground drilling machine also includes a drill rod storage structure positioned alongside the drive axis and a rod handling device for conveying drill rods back and forth between the drive axis and the drill rod storage structure. The underground drilling machine further includes at least one rod vise positioned along the drive axis, and a joint lubricant dispenser positioned for dispensing joint lubricant into the female connection interface. The lubricant dispenser is movable along the drive axis.

Still another aspect of the present disclosure relates to an underground drilling machine including a rotational driver having a rotationally driven rod coupler adapted for connection to an end of a drill rod. The rod coupler is rotatable about a drive axis and is mounted to move back and forth along the drive axis. The underground drilling machine also includes a drill rod storage structure positioned alongside the drive axis and rod handling device for conveying drill rods back and forth between the drive axis and drill rod storage structure. The underground drilling machine further includes first and second rod vises positioned along the drive axis. The second rod vise is positioned between the first rod vise and the rotational driver. The second rod vise is pivotally movable about the drive axis between a first pivotal position and second pivotal position. The underground drilling machine further includes a first rod guide/support corresponding to the first vise and a second rod guide/support corresponding to the second vise. The rod guides/supports can be configured for self-centering drill rods within the rod vises.

A variety of advantages of the disclosure will be set forth in part in the description that follows, and in part will be apparent from the description, or may be learned by practicing the various aspects of the present disclosure. It is to be understood that both the foregoing general description and the following detailed description are exemplary and explanatory only and are not restrictive of the broad inventive concepts upon which the examples are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
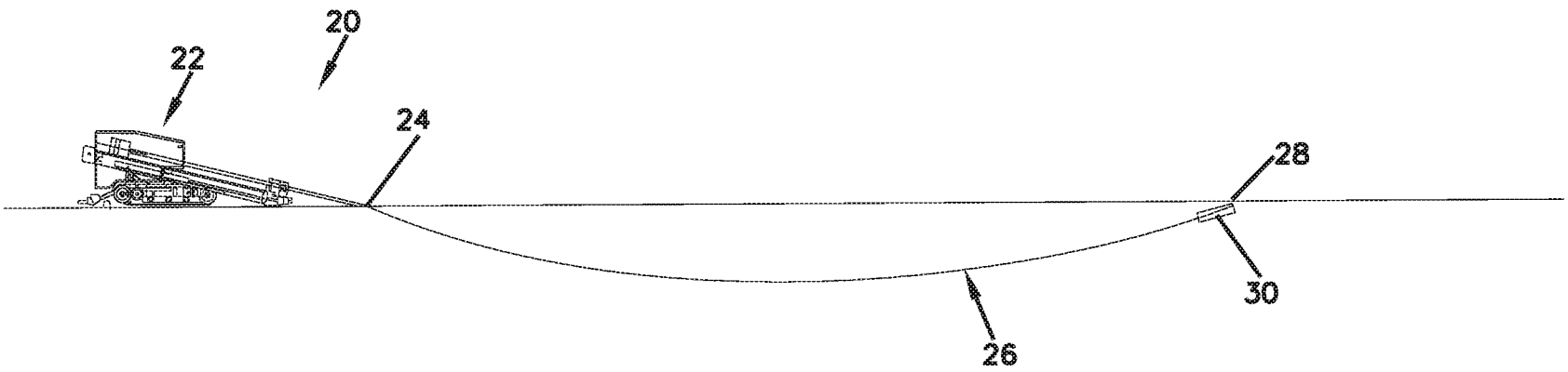
FIG. 1 is a schematic view of a drilling system in accordance with the principles of the present disclosure, including a horizontal directional drilling machine.

FIG. 1 shows an example drilling system 20 in accordance with the principles of the present disclosure. The drilling system 20 includes a drilling machine 22 positioned at a launch point 24. The drilling machine 22 has drilled out a drill string 26 along a bore path that extends from the launch point 24 to a termination point 28. It will be appreciated that horizontal directional drilling techniques can be used to steer the drill string 26 during the drilling process such that the drill string 26 generally follows the desired bore path. As shown at FIG. 1, the depicted bore path initially extends at a downward trajectory as the bore path extends from the launch point 24 and gradually transitions along a curved path from the downward trajectory to an upward trajectory. In this way, the bore path extends generally horizontally beneath the ground and is able to pass beneath above-ground obstructions. It will be appreciated that the end of the drill string 26 can include a drill head 30 that may include a transmitter (e.g., a sonde) for use in locating the drill string 26 from the surface of the ground, and also preferably includes a cutting devise (e.g., a bit) adapted for drilling the bore when the drill string 26 is rotated by the drilling machine 22. This type of directional drilling, where the bore path is primarily horizontal, is often referred to as horizontal directional drilling (HDD).

Figure 2:
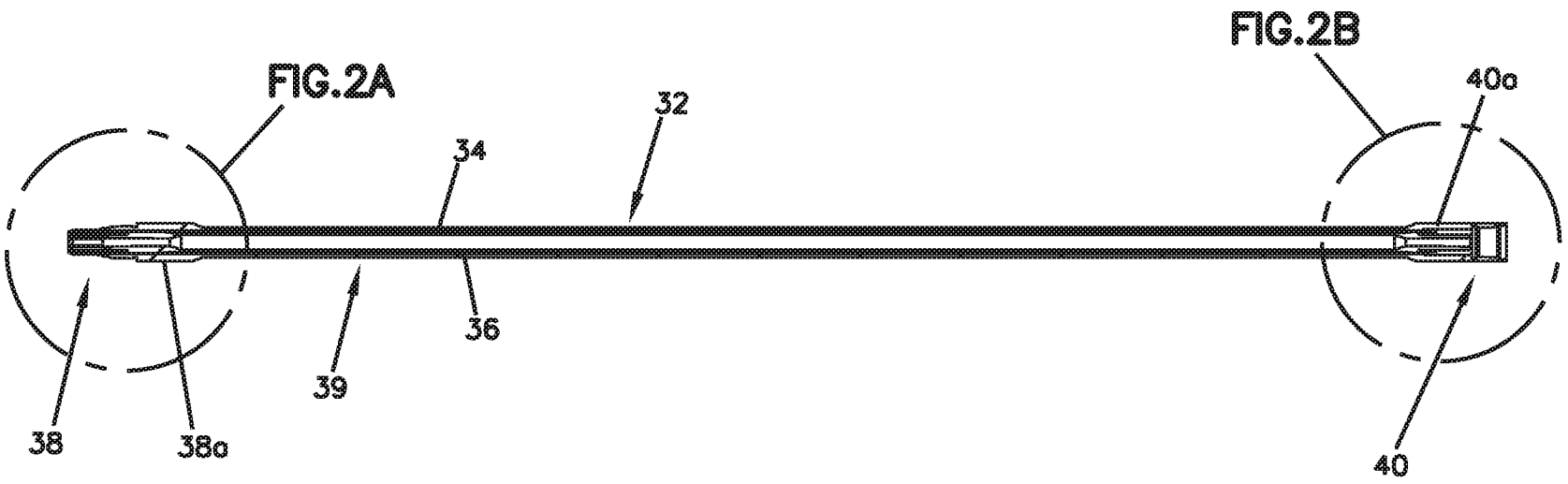
FIG. 2 is a longitudinal cross-sectional view of an example drill rod.
Figure 2A:
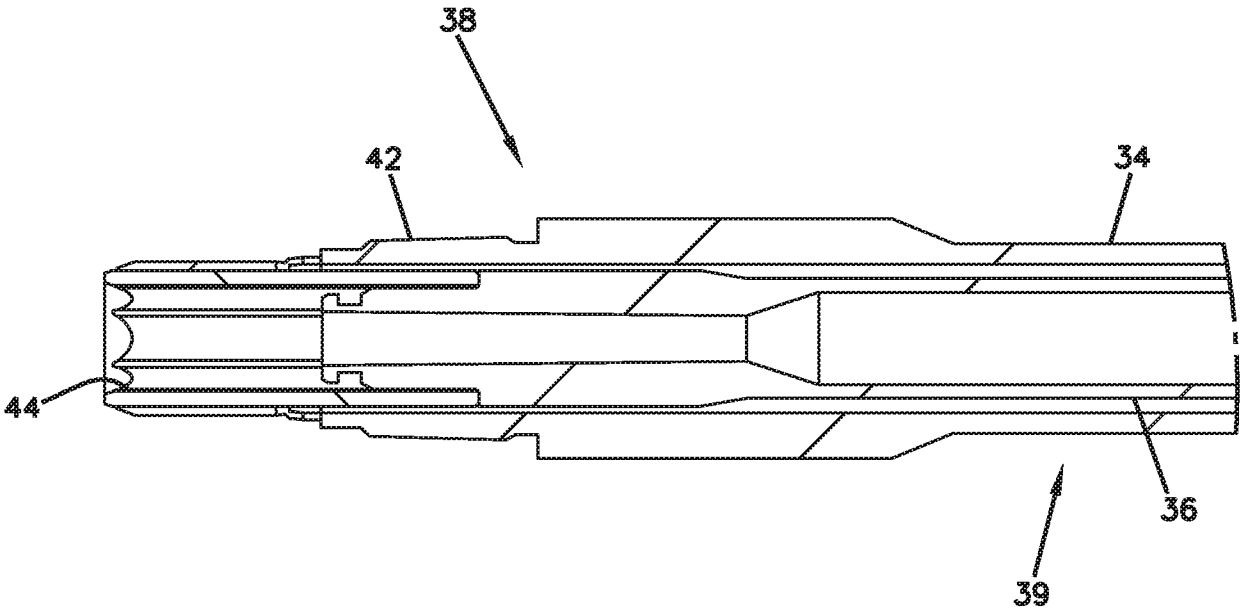
FIG. 2A is an enlarged view of one end of the drill rod of FIG. 2.
Figure 2B:
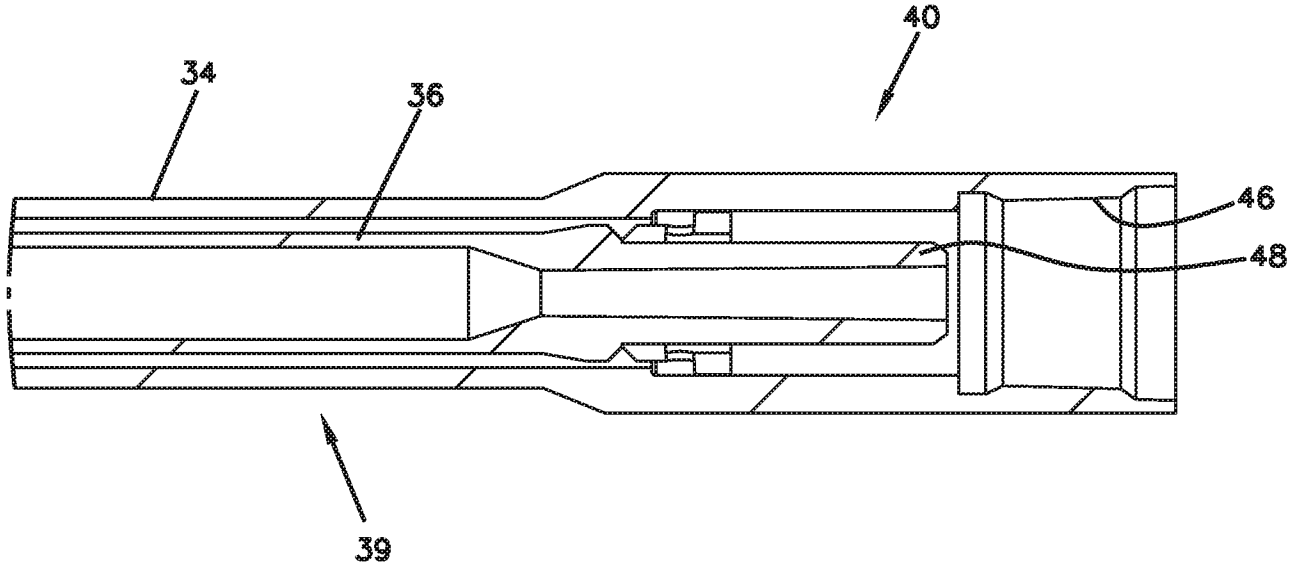
FIG. 2B is an enlarged view of the other end of the drill rod of FIG. 2.

It will be appreciated that the drill string 26 is formed by a plurality of drill rods that are strung together in an end-to-end configuration. It will be appreciated that the drill rods can each have a single-pipe configuration or a multi-pipe configuration (e.g., a dual-pipe arrangement). FIG. 2 shows an example drill rod 32 having a dual-pipe configuration. The drill rod 32 includes an outer pipe 34 and an inner pipe 36. The outer and inner pipes 34, 36 are able to rotate independently with respect to one another. The drill rod 32 includes a first end 38 positioned opposite from a second end 40. At the first end 38, the outer pipe 34 includes a threaded male connection interface 42 having exterior threads and the inner pipe 36 includes a non-threaded female connection interface 44. The first end 38 of the drill rod 32 can be referred to as the pin end of the drill rod 32. The non-threaded female connection interface 44 can include a socket having an internal transverse cross-sectional shape that is preferably not circular. In certain examples, the internal transverse cross-sectional shape is hexagonal, square, splined or other shapes known to be capable of transferring torque. At the second end 40 of the drill rod 32, the outer pipe 34 includes a threaded female connection interface 46 having internal threads and the inner pipe 36 includes a non-threaded male connection interface 48. The second end 40 of the drill rod 32 can be referred to as the box end of the drill rod 32. In certain examples, the non-threaded male connection interface 48 can include a driver such as a square driver, a hex driver, a splined driver, or other shaped drivers suitable for transferring torque when mated with a female connection interface having a complementary shape. FIG. 2A is an enlarged view of the first end 38 of the drill rod 32, and FIG. 2B is an enlarged view of the second end 40 of the drill rod 32.

Figure 3:
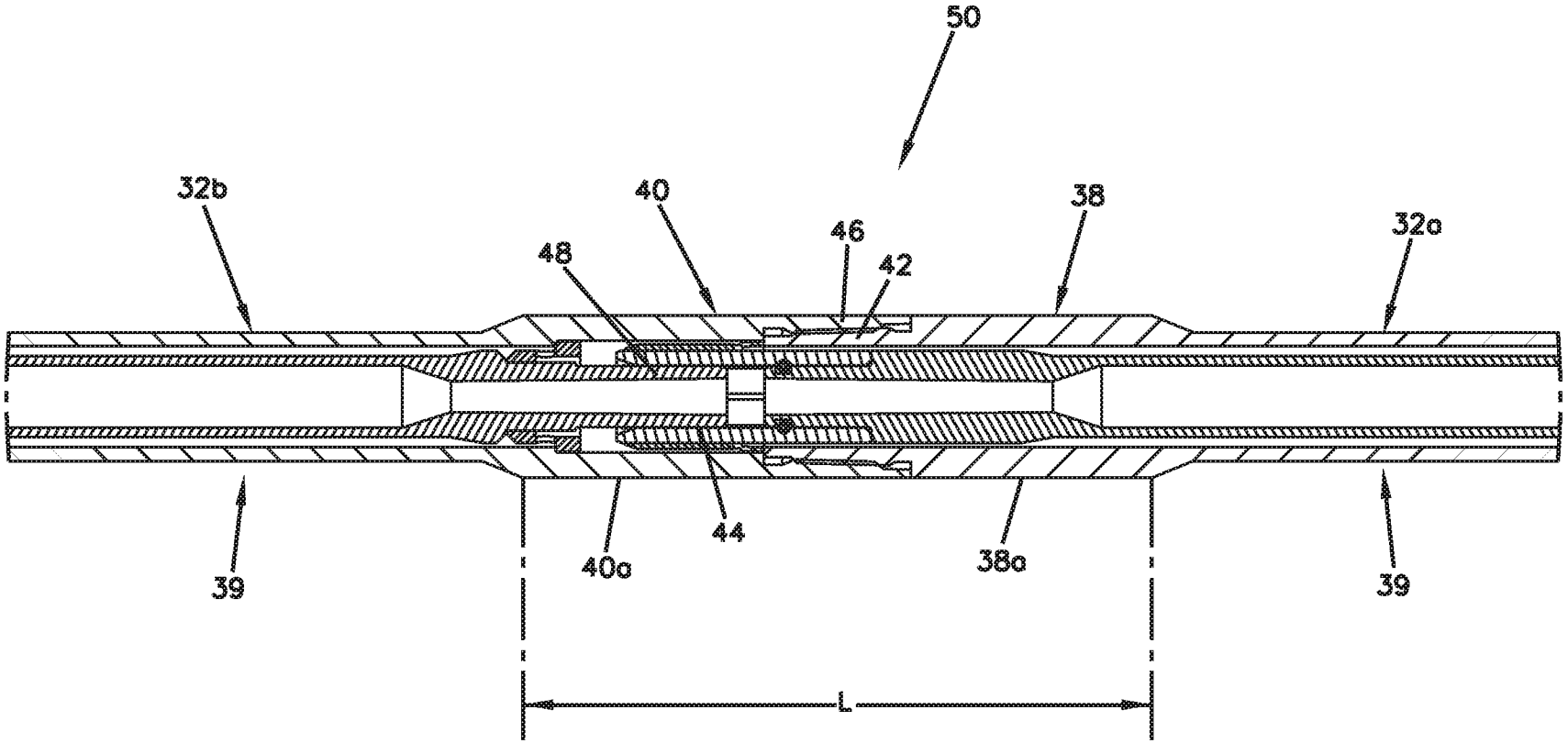
FIG. 3 is an enlarged view of a joint between two drill rods.

FIG. 3 is an enlarged view of a coupling joint 50 formed when two drill rods 32*a*, 32*b* are coupled together end-to-end. As shown at FIG. 3, the first end 38 of one of the drill rods 32*a* is shown mated with the second end 40 of the other drill rod 32*b* such that the drill rods 32*a*, 32*b* are coupled together end-to-end. In this mated configuration, the threaded male connection interface 42 of the drill rod 32*a* has been threaded into the threaded female connection interface 46 of the drill rod 32*b*. Also, the non-threaded female connection interface 44 of the drill rod 32*a* has received the non-threaded male connection interface 48 of the drill rod 32*b*. It will be appreciated that as the threaded connection interfaces 42, 46 are threaded together, the non-threaded connection interfaces 44, 48 concurrently fit together in a slip-fit manner.

Referring again to FIG. 2, the drill rod 32 includes enlarged end portions 38*a*, 40*a*, adjacent the first and second ends 38, 40. The enlarged end portions 38*a*, 40*a* have enlarged outer diameters at the box and pin ends of the rod as compared to an intermediate portion 39 of the drill rod 32 which has a reduced outer diameter. It will be appreciated that the enlarged end portions 38*a*, 40*a* can be manufactured using an upset forging process and can be referred to as "upsets." When two drill rods 32*a*, 32*b* are coupled together as shown at FIG. 3, the coupled together enlarged end portions 38*a*, 40*a* cooperate to define an enlarged diameter section length L which corresponds to the length of enlarged diameter section formed by the combined axial lengths of the enlarged end portions 38*a*, 40*a* which have been coupled together.

The enlarged end portions 38*a*, 40*a* have individual axial lengths that each extend from a shoulder to the corresponding terminal end of the outer pipe 34. The shoulders are steps in the outer surface of the outer pipe 34 where the enlarged end portions 38*a*, 40*a* transition from the enlarged outer diameters corresponding to the enlarged end portions 38*a*, 40*a* to the reduced outer diameter corresponding to the intermediate portion 39. The enlarged end portion 40*a* has an axial length that is longer than the enlarged end portion 38*a*. The joint 50, as shown at FIG. 3, is formed when two enlarged end portions 38*a*, 40*a* are threaded together. As so formed, a seam is located between the coupled enlarged end portions 38*a*, 40*a* and represents the exterior dividing line between the coupled enlarged end portions 38*a*, 40*a*. When a joint is made, the length of the enlarged end portion 38*a* extends from its corresponding shoulder to the seam and the length of the enlarged end portion 40*a* extends from the seam to its corresponding shoulder. Since the enlarged end portion 40*a* has a longer axial length than the enlarged end portion 38*a*, the enlarged end portion 40*a* makes up a larger percentage of the enlarged diameter section length L than the enlarged end portion 38*a*. Thus, the joint is asymmetrical about the seam with the enlarged end portion 40*a* section of the joint 50 being longer than the enlarged end portion 38*a* section of the joint 50. It will be appreciated that the enlarged diameter section represents a heavier, more robust and stiffer portion of the drill string as compared to the intermediate portions. In certain examples, shortening the enlarged diameter section length by making the enlarged end portion 38*a* shorter than the enlarged end portion 40*a* may positively affect the flexibility of the drill string. However, in other examples, the joint could be symmetrical and various aspects of the present disclosure are not limited to drill rods having enlarged end portions having different axial lengths.

While drill rods having a dual-pipe configuration have been shown for example purposes, it will appreciated that the various aspects of the present disclosure are also applicable for use with drill rods having single pipe configurations, or other drill rods.

Figure 4:
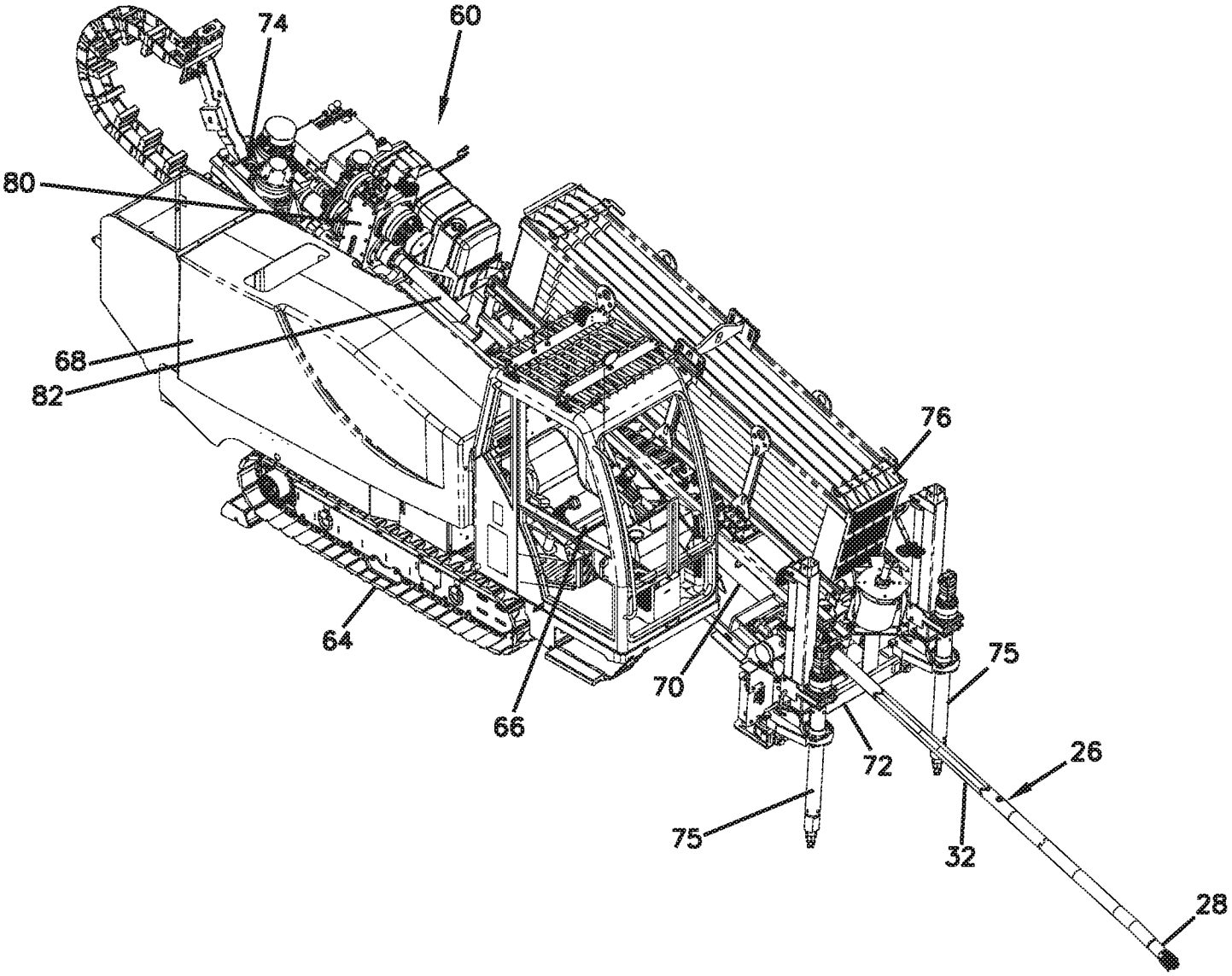
FIG. 4 is a perspective view of an example drilling machine in accordance with the principles of the present disclosure.
Figure 5:
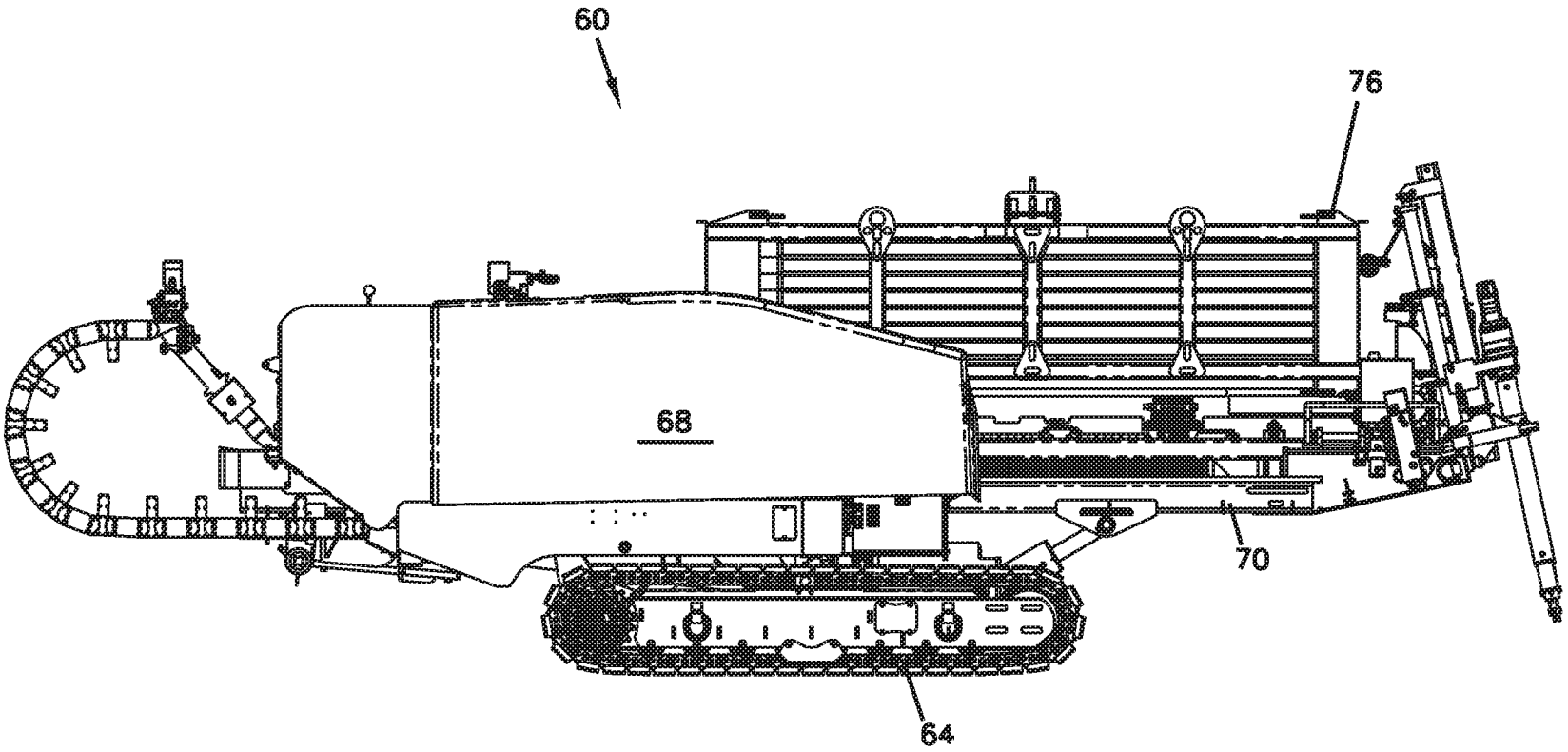
FIG. 5 is a side view of the drilling machine of FIG. 4.

FIG. 4 shows an example drilling machine 60 in accordance with the principles of the present disclosure. The drilling machine 60 can include a chassis supported on a propulsion structure 64. As depicted, the propulsion structure 64 is shown as including continuous metal tracks, but other propulsion structures such as wheels or continuous rubber tracks could also be used. An operator station 66 is shown supported on the chassis. The operator station 66 can optionally include an enclosed cabin. A shroud or a body 68 is also supported on the chassis. In certain examples, the shroud 68 can enclose a prime mover such as a diesel engine, a spark ignition engine, a fuel cell, or the like for providing power for the drilling machine 60 for propulsion and for drilling operations. The body 68 can also house hydraulic pumps, a transmission, electric generators, or other means for transferring energy from the prime mover to different driven components of the drilling machine. The drilling machine 60 further includes a drilling frame 70 that is pivotally connected to the chassis. During transport, the drilling frame 70 can be generally horizontally arranged. During drilling operations, the drilling frame 70 can be pivoted relative to the chassis of the drilling machine 60 to an inclined or angled configuration. When in the angled configuration, a base end 72 of the drilling frame 70 is supported on the ground and an upper end 74 of the drilling frame 70 is positioned above the ground. The base end 72 can include anchors 75 such as augers for securely anchoring the base end 72 of the drilling frame 70 to the ground during drilling operations.

The drilling machine 60 also includes a drill rod storage structure 76 that mounts on the drilling frame 70. In a preferred example, the drill rod storage structure 76 is a magazine that is removable from the drilling frame 70, although non-removable storage structures could also be used. In certain examples, the drill rod storage structure 76 can include a plurality of vertical columns 77, each for holding a separate vertical column of drilling rods. In certain examples, the drill rod storage structure 76 can have an open bottom that allows rods to be loaded into and dispensed from the rod storage structure through the bottom of the rod storage structure 76. It will be appreciated that rod storage structures can commonly be referred to as rod boxes, rod racks, rod magazines or like terms. Example rod storage structures are disclosed by U.S. Pat. Nos. 6,332,502; 5,556,263; 5,607,280 and 6,543,551, which are hereby incorporated by reference in their entireties. In other example, drill rod storage structures in accordance with the principles of the present disclosure may have columns in orientations other than vertical, or may not have columns at all, and may or may not have open bottoms.

Figure 18:
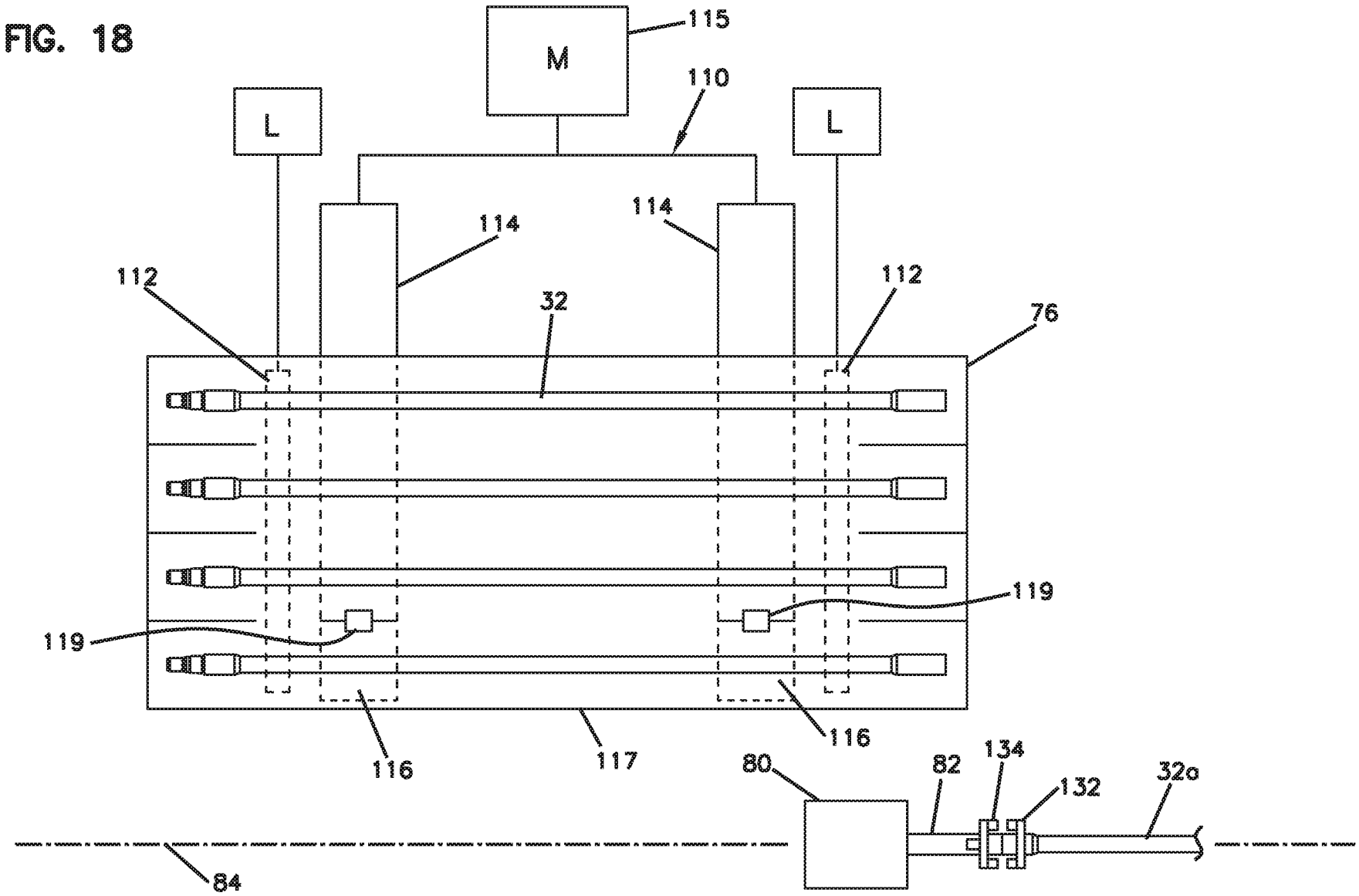
FIGS. 18-25 are schematic views of the drilling machine of FIG. 4 depicting a sequence for adding drill rods to a drill string as the drill string is extended during drilling operations.
Figure 19:
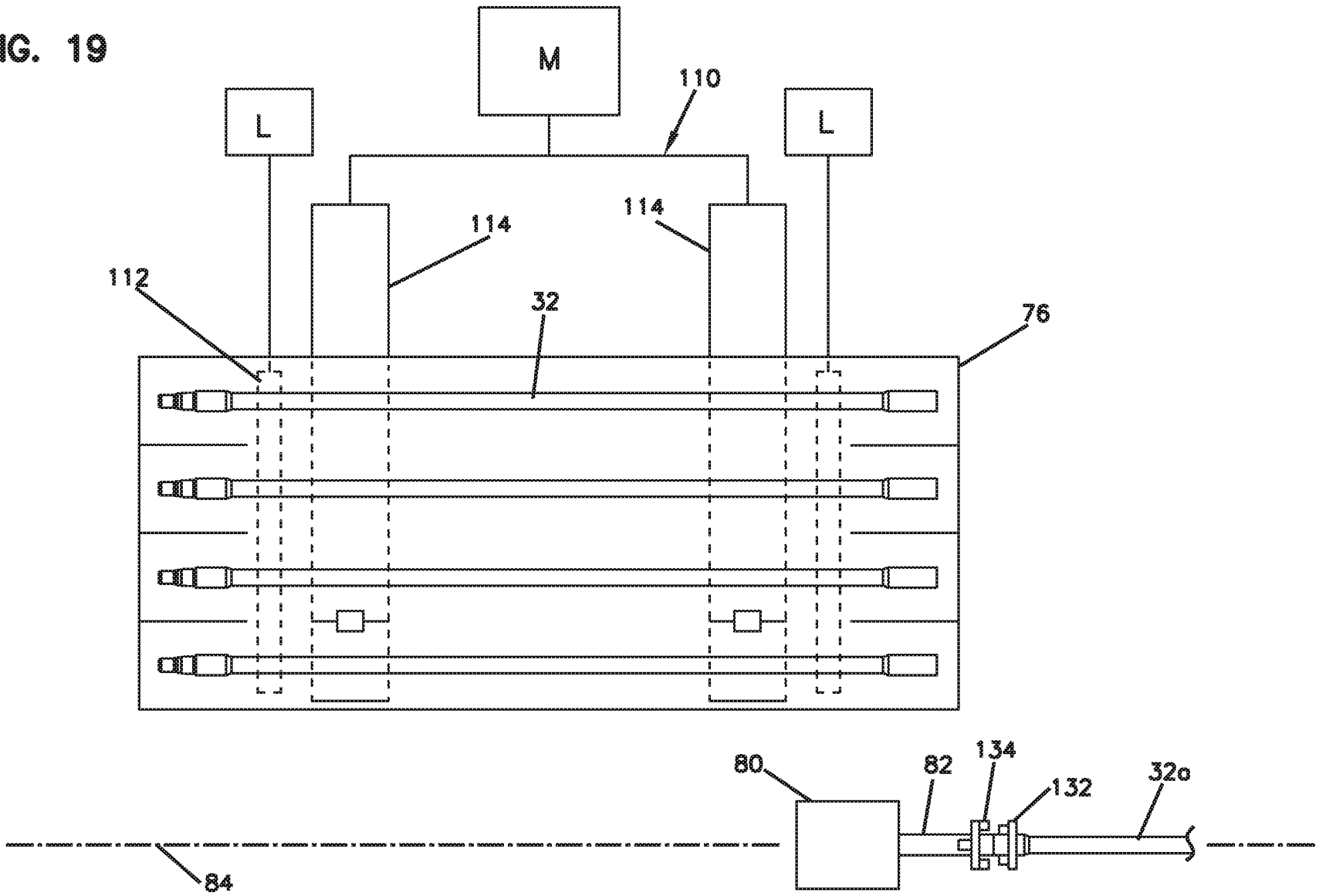
Figure 20:
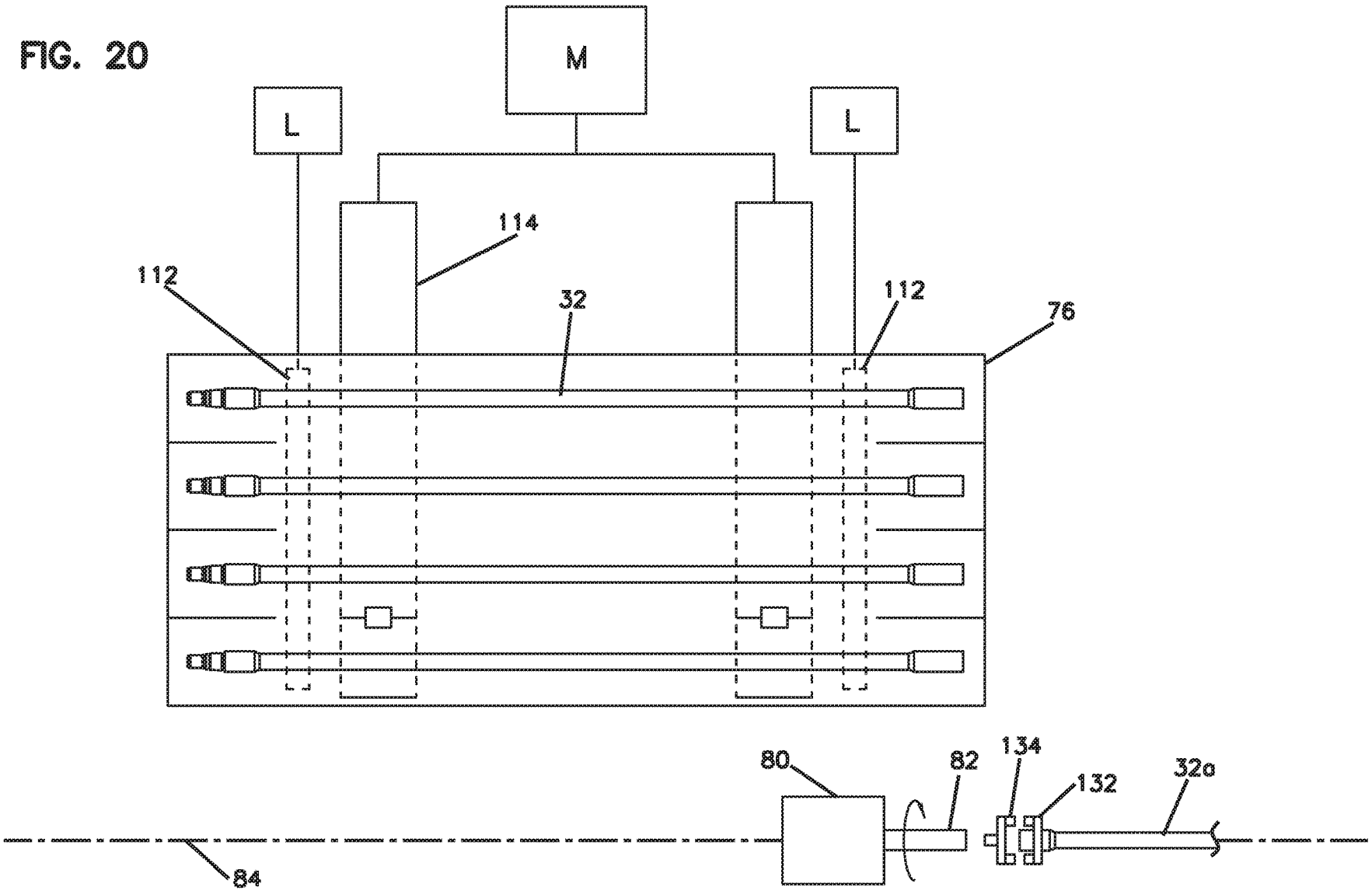

Referring to FIGS. 4-7, the drilling machine 60 also includes a rotational driver 80 including a rotationally driven rod coupler 82 adapted for connection to an end of a drill rod 32. The rod coupler 82 can be referred to as a stem, a chuck, a sub, a spindle, or like terms. The rod coupler 82 can also include add-on pieces such as a sub-saver. It will be appreciated that the rotational driver 80 can include a drive mechanism for rotating the rod coupler 82 about a drive axis 84 (see FIGS. 6 and 18). The drive mechanism can include one or more motors such as one or more hydraulic motors, pneumatic motors, or electric motors. Torque can be transferred from the drive motors to the rod coupler 82 by mechanical means for transferring torque such as sprockets, chains, gears, screw drives, or other means.

Figure 17:
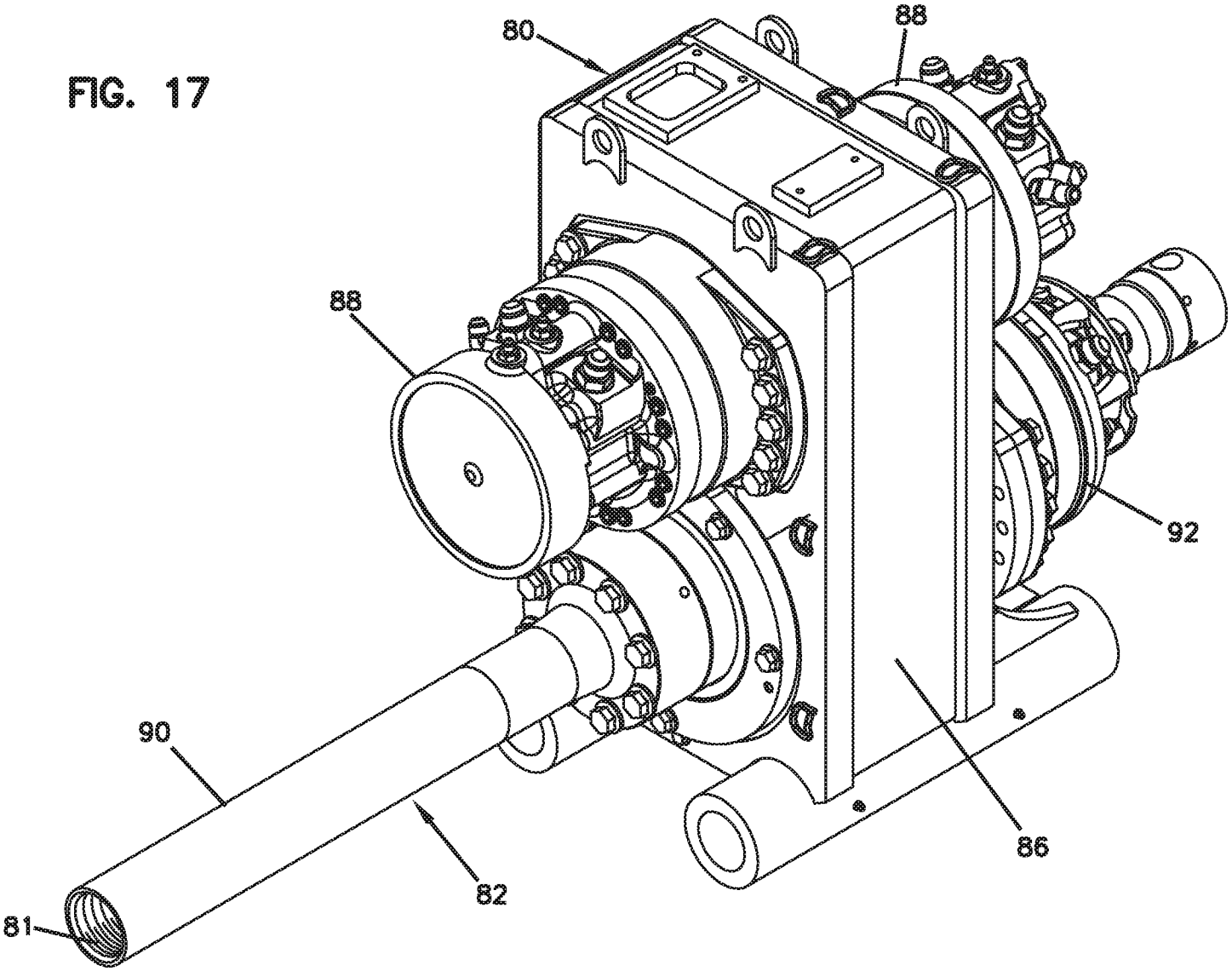
FIG. 17 is a perspective view of an example rotational driver that can be incorporated as part of the drilling machine of FIG. 4.

As depicted at FIG. 17, the rotational driver 80 includes a gearbox 86 adapted for applying torque to drive rotation of a drill string having dual pipes. The gearbox 86 includes motors 88 for driving an outer rotation drive 90 for rotating the outer pipes 34 of a dual pipe drill string, and a motor 92 for driving an inner rotational drive (not shown) adapted for rotating the inner pipes 36 of the dual-pipe drill string. It will be appreciated that the motors 88 can be coupled to the outer rotational drive 90 directly or by a suitable gear arrangement. The motor 92 can coupled to the inner rotational drive either directly or by a suitable gear arrangement. Further details about the gearbox can be found at U.S. patent application Ser. No. 15/967,975 filed May 1, 2018, which is hereby incorporated by reference in its entirety. Another type of gearbox for use with dual-pipe drill rods disclosed at U.S. Pat. No. 9,598,905 that is hereby incorporated by reference. It will be appreciated that rotational drivers for use with single-pipe drill rods may include only one drive motor that may be directly coupled to a rod coupler of the rotational driver or may be coupled to the rotational coupler by intermediate mechanical means for transferring torque.

In the depicted example, the outer rotational drive 90 of the rotational driver 80 is provided with a female connection interface having internal threads 81. The female connection interface provided by the outer rotational drive 90 is adapted to couple with the threaded male connection interface 42 of the drill rods 32. The inner rotational drive of the rotational driver 80 has a non-threaded male connection interface adapted to mate with the non-threaded female connection interface 44 of the drill rods 32. In other examples, the outer rotational drive could have a male interface and the inner rotational drive could have a female interface.

Figure 6A:
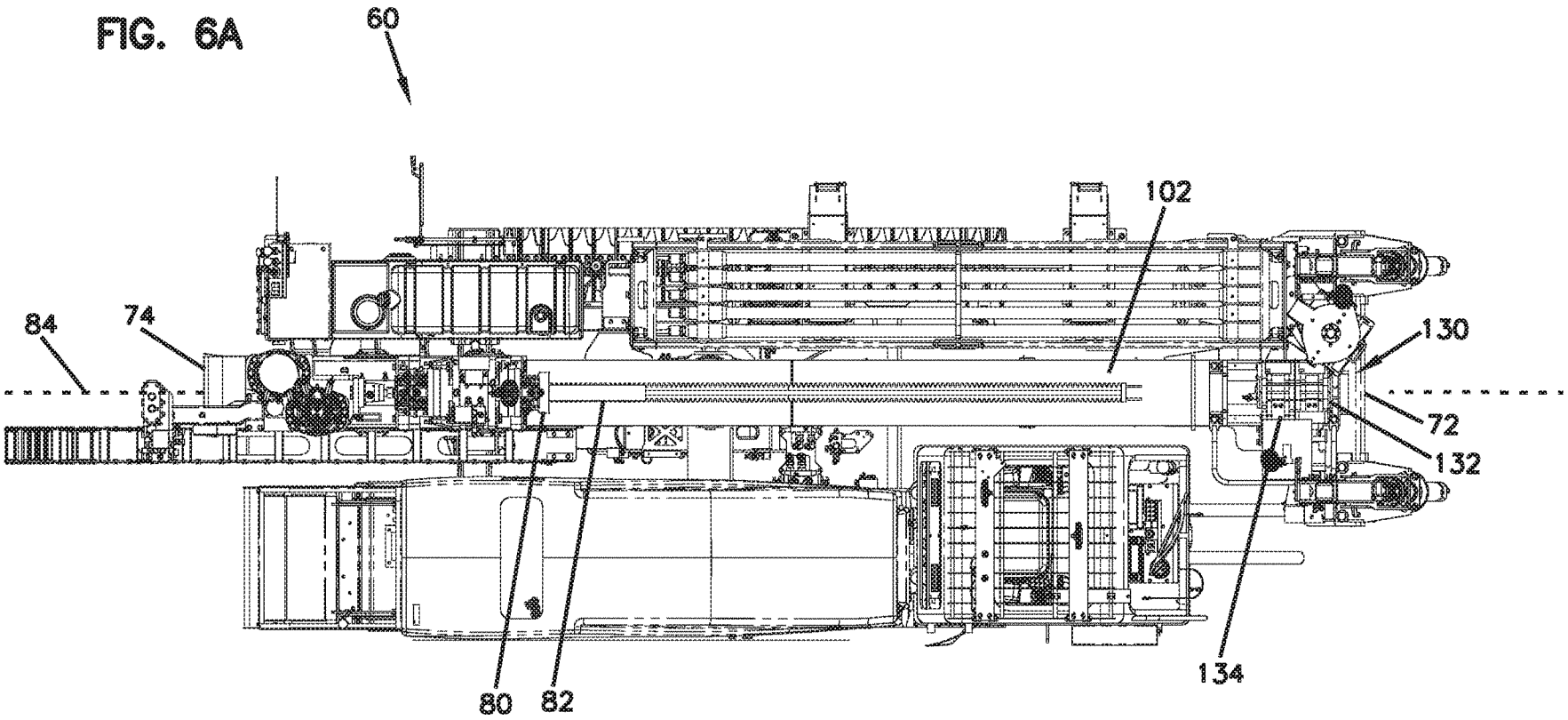
FIG. 6A is a top view of the drilling machine of FIG. 4 with a translatable vise of the drilling machine shown in a first axial position in which the translatable vise does not interfere with the linear movement of drill rods between a rod storage structure of the drilling machine and a drive axis of the drilling machine.
Figure 6B:
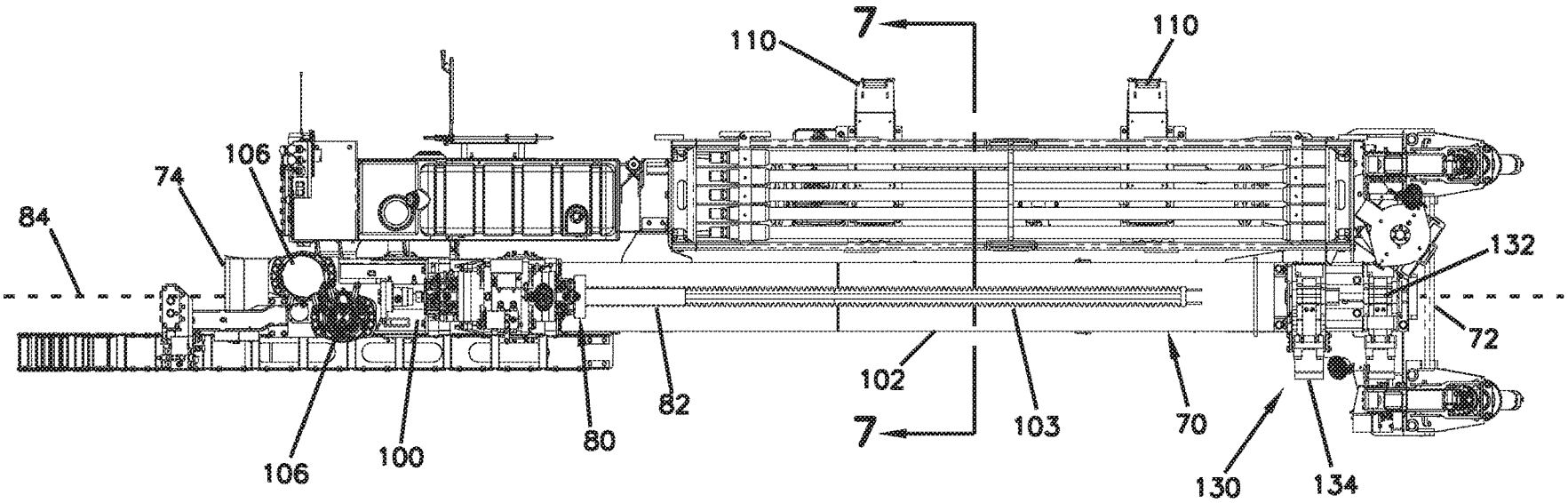
FIG. 6B is a top view of the drilling machine of FIG. 4 with a translatable vise of the drilling machine shown in a second axial position in which the translatable vise obstructs the linear movement of drill rods between a rod storage structure of the drilling machine and a drive axis of the drilling machine.
Figure 6C:
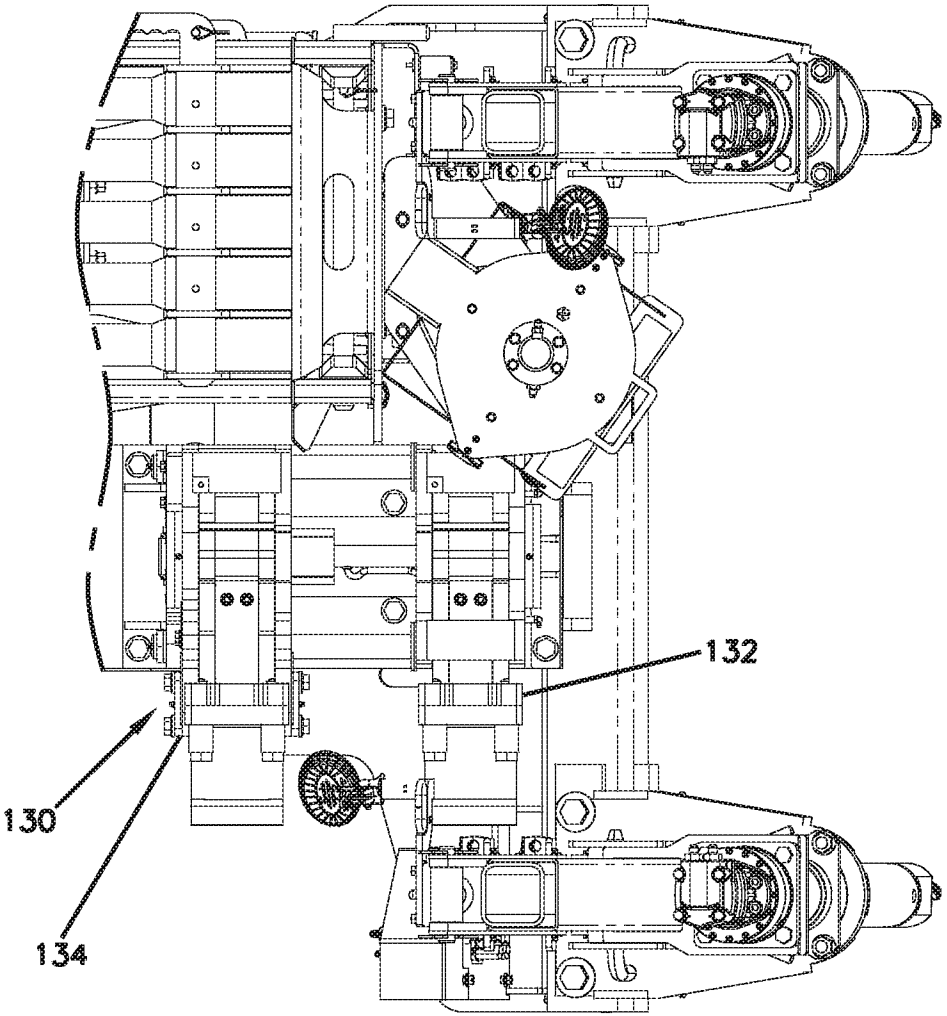
FIG. 6C is an enlarged view of a portion of FIG. 6B showing the translatable vise in the second axial position.

Referring to FIG. 6B, the rotational driver 80 mounts on a carriage 100 that rides along an elongate track 102 extending between the base end 72 and the upper end 74 of the drilling frame 70. The track mounted configuration of the carriage 100 is configured to allow the rotational driver 80 to be moved or reciprocated back and forth along the length of the drilling frame 70 as drilling rods are drilled into the ground or pulled back from the ground. The track can include one or more guide structures such as a rail, a rack, a rod, a linear motion bearing, or like structures for guiding linear movement of the carriage 100. It will be appreciated that the rotational driver 80 moves along the drive axis 84 as the carriage 100 moves along the track 102. Preferably, the rotational driver 80 moves linearly along the drive axis 84. In certain examples, a translational driver is provided for moving the carriage 100 and the rotational driver 80 mounted thereon back and forth along the length of the track 102. The translational driver provides drilling thrust for driving drill strings into the ground, and also provides pull-back force for removing drill strings from the ground. By way of example, the translational driver can include actuators or actuating systems that may include hydraulic or pneumatic cylinders; hydraulic or pneumatic motors; rotating gears; electrical motors; linear gears such as racks, belts, chains, sprockets, sheaves, and screw drives; or the like. In certain examples, the carriage 100 is driven by a rack and pinion system including any elongated rack 103 that extends along the length of the track 102 and pinion gears that engage opposite sides of the rack 103. The pinion gears can be driven by motors 106 (e.g., hydraulic motors, electric motors, pneumatic motors, or other motors) mounted on the carriage 100.

Figure 7A:
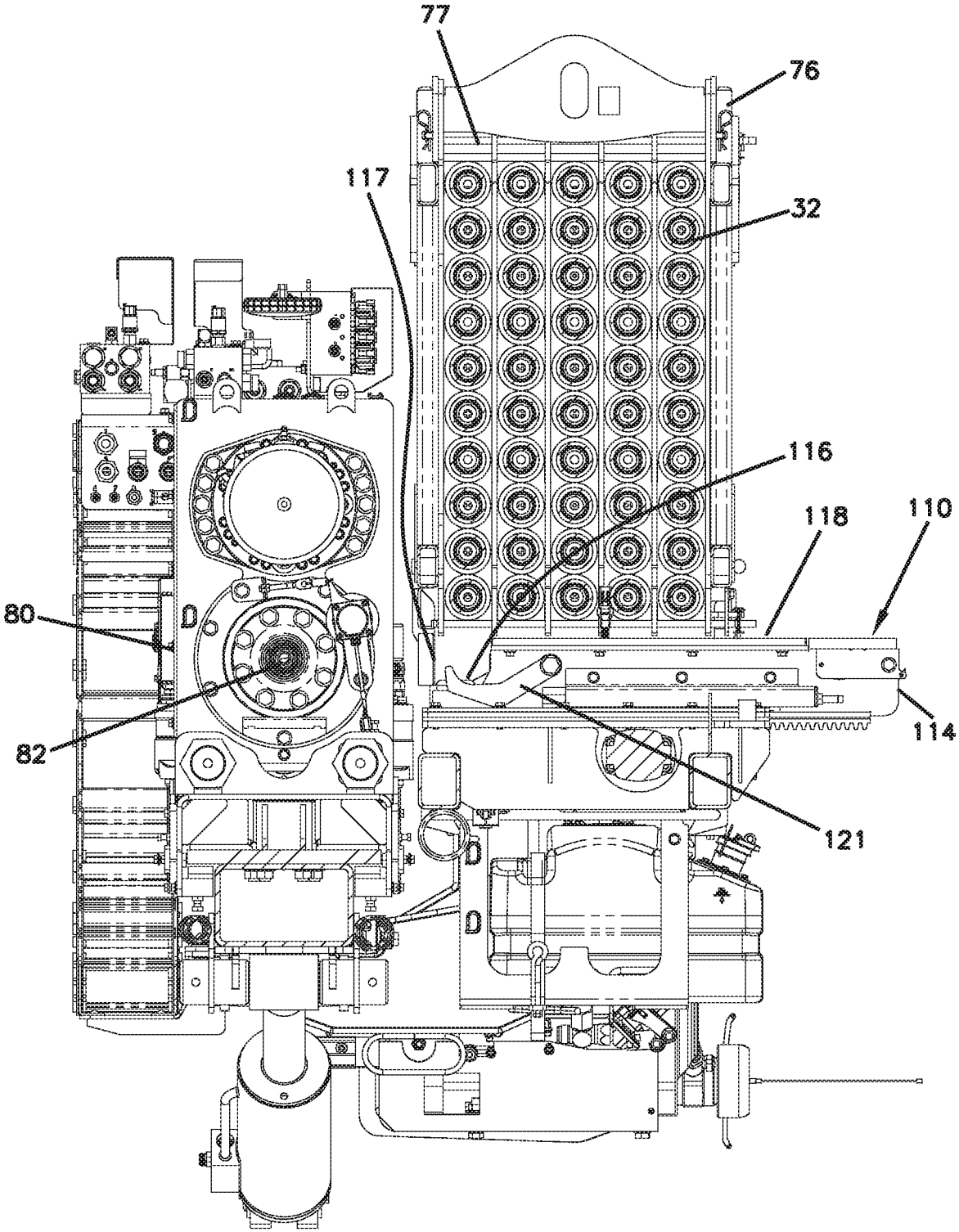
FIG. 7A is a cross-sectional view taken along section line 7-7 of FIG. 6 showing a rod handling shuttle in a retracted position with a rod receiving location of the shuttle positioned beneath a rod storage structure of the drilling machine.
Figure 7B:
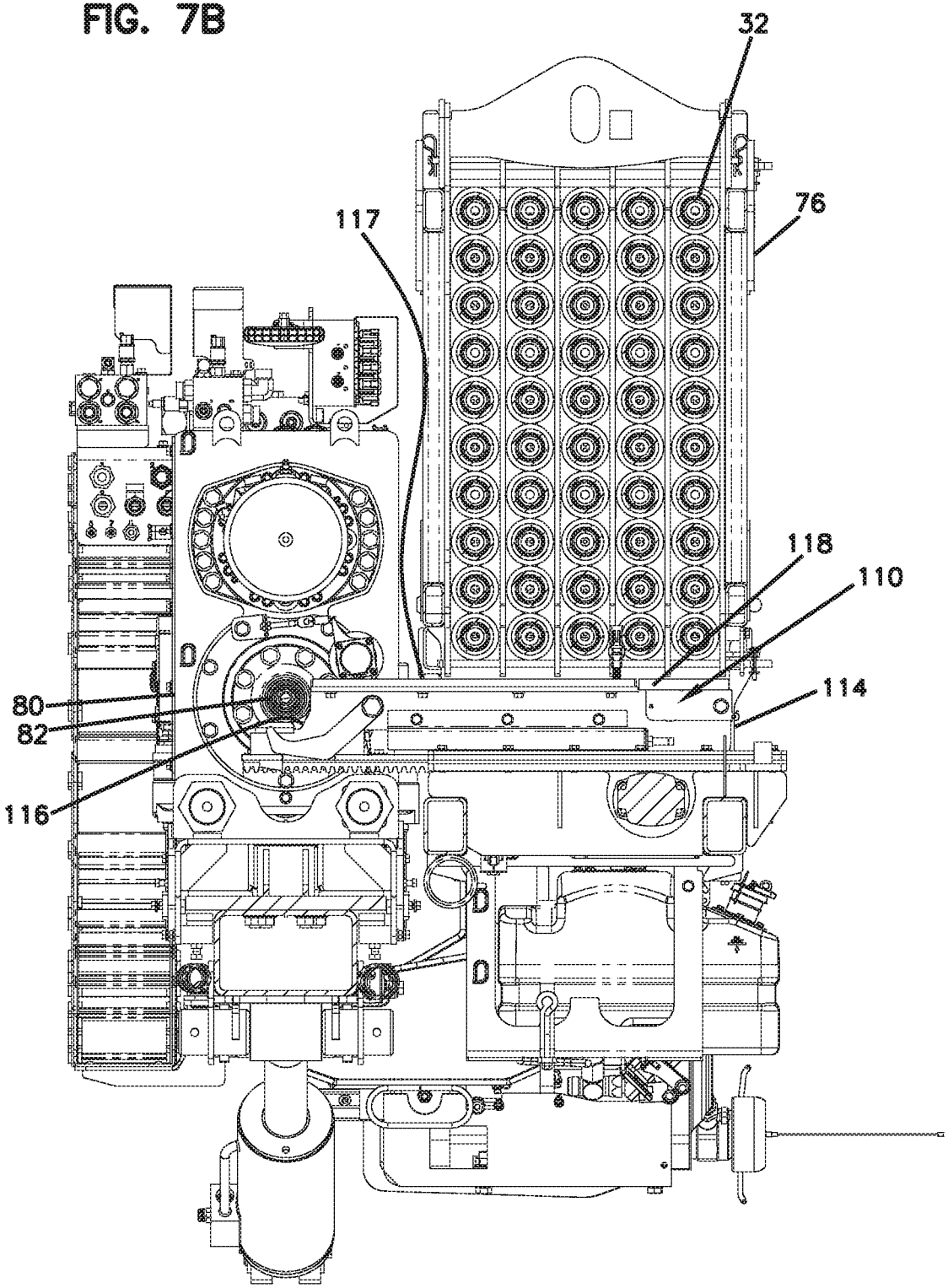
FIG. 7B is a cross-sectional view taken along section line 7-7 of FIG. 6 showing a rod handling shuttle in an extended position with a rod receiving location of the shuttle positioned to align a drill rod received therein with a drive axis of the drilling machine.

The drilling machine 60 further includes a rod handling device 110 (see FIGS. 6B, 7A, and 7B) for conveying drill rods back and forth between the drive axis 84 and the rod storage structure 76. In the depicted example of FIGS. 7A and 7B, the rod handling device 110 is mounted below the rod storage structure 76, and rods are loaded into the rod storage structure 76 through the bottom of the rod storage structure 76 and are also unloaded from the rod storage structure 76 through the bottom of the rod storage structure 76. A lift device 112 (shown schematically at FIG. 18) can be provided for raising and lowering the drill rods within the rod storage structure 76. The rod handling device 110 can include one or more carrier arms for carrying drill rods along a rod transfer path between the drive axis 84 and the rod storage structure 76. In one example, the carrier arms can include shuttle arms 114 for linearly moving drill rods along a linear rod transfer path between the drive axis 84 and the rod storage structure 76. The one or more shuttle arms can include two parallel shuttle arms 114 that are spaced-apart along the drive axis 84 and are linearly movable between a retracted orientation (see FIG. 7A) and an extended orientation (see FIG. 7B). The shuttle arms 114 can be linearly moved by drive mechanisms 115 (see schematic depiction at FIG. 18) such as a rack and pinion drive, a linear actuator such as a hydraulic and pneumatic cylinder, a belt drive, a chain drive, a screw drive, or like means, and can be supported for linear movement by linear motion bearings. The shuttle arms 114 can include rod receivers 116 defined by the shuttle arms 114 at locations of the shuttle arms closest to the drive axis 84. When the shuttle arms 114 are fully extended, as shown at FIG. 7B, a drill rod supported at the rod receivers 116 is placed into coaxial alignment with the drive axis 84. When the shuttle arms 114 are retracted, the rod receivers 116 are positioned directly beneath a column of the rod storage device from which a drill rod is to be received during drilling operations or into which a drill rod is to be loaded during pull-back operations. A rod loading/unloading region 117 of the drill rod storage structure can be the opening or gap beneath the rod storage structure 76 through which drill rods are moved to unload rods from the rod storage structure and to load rods into the rod storage structure.

As depicted, one or more magnets 119 (see FIG. 18) associated with each of the shuttle arms 114 can be used to retain the drill rods within rod receivers 116 as the drill rods are carried by the shuttle arms. As depicted, the rod receivers 116 are depicted as shelfs and the receivers 116 have open sides that face toward the drive axis. In a preferred example, the rod handling device 110 does not include any clamps such as vises or other means for mechanically clamping rods within the rod receivers 116 when the shuttle arms 114 are extended. Assists 121 are provided for retaining a rod at the receivers 116 when the receivers 116 are beneath a column of the rod storage structure 76. The weight of a column of pipes may be sufficient to overcome the magnetic force holding a rod in the receivers 116. The assists 121 lift into place when the receivers are beneath the rod storage structure to prevent a column of pipes from being unintentionally discharged. The assists 121 provide no rod retention function when the shuttle arms 114 are extended.

In certain examples, the shuttle arms 114 include blocking surfaces 118 that block the underside of the rod storage structure 76 to prevent the rods from falling out when rods are being loaded into or unloaded from the rod storage structure 76. The blocking surfaces 118 work in combination with the lift device 112. It will be appreciated that rods are unloaded from the rod storage structure 76 starting with the column closest to the drive axis 84 and working on a column-by-column basis progressively away from the drive axis. In contrast, when rods are loaded back into the rod storage structure 76, the columns are loaded in an opposite direction starting with the column farthest from the drive axis that is not fully loaded and working on a column-by-column basis back toward the drive axis. The column from which rods are being unloaded or into which rods are being loaded can be referred to as the selected column. To unload a drill rod from the rod storage structure, shuttles are retracted to a position where the receivers 116 are positioned directly beneath the selected column of the rod storage structure. At this point the drill rods are being held in an elevated position by the lift device 112. The lift device 112 is then lowered to a lowered position causing the bottom-most rod of the column of pipes in the selected column to be received at the receivers 116 and causing the other columns of rods to be supported on the blocking surfaces 118. The shuttle arms 114 are then extended and the blocking surfaces 118 move beneath the selected column to prevent the remaining rods in the selected column from falling out. Once the rod in the receivers 116 has cleared the rod storage structure, the lift can be raised to lift the remaining rods in the rod storage structure to reduce friction on the shuttle arms. The process is repeated to remove more rods from the rod storage device. To load a rod into the rod storage structure, the lift device 112 is lowered and the shuttle arms 114 are retracted to place the receivers 116 holding a rod desired to be loaded into the rod storage structure directly beneath the selected column. The lift device 112 is then raised to lift the rod into the selected column. The process is repeated to load more rods into the rod storage structure. Further details about example rod handling devices are disclosed by U.S. Pat. Nos. 6,332,502; 5,556,253; 6,543,551; and 5,607,280, which are hereby incorporated by reference in their entireties. While linear motion rod handling devices are certainly preferred, other types of rod handling devices (e.g., pivotal motion, arcuate motion, combinations of different motions, etc.) can also be used.

Referring to FIGS. 6A, 6B, 6C and FIGS. 8-16, the drilling machine 60 further includes a vise arrangement 130 for use in assisting making and/or breaking joints between drill rods 32. The vise arrangement 130 is mounted to the drilling frame 70 adjacent to the base end 72 of the drilling frames 70. The vise arrangement 130 is depicted including a first rod vise 132 and a second rod vise 134. In one example, the first rod vise 132 is a non-translatable and a non-pivotal vise, while the second rod vise 134 is both translatable and pivotal. The first rod vise 132 is positioned closer to the base end 72 of the frame 70 than the second rod vise 134. Thus, the first rod vise 132 can be referred to as a lower or down-hole vise and the second rod voice 134 can be referred to as an upper or up-hole vise since during typical use of the drilling machine with the frame inclined, the first rod vise 132 is positioned lower and closer to the launch point than the second rod vise 134. The vise arrangement 130 also includes first and second rod guides/supports 160, 162 that respectively correspond to the first and second rod vises 132, 134. The rod guides/supports 160, 162 function to self-center drill rods within the vises 132, 134 such that center axes of the drill rods align with central clamping axes of the vises 132, 134. The vises 132, 134 are positioned between the rod guide/supports 160, 162. The first rod guide/support 160 can be referred to as a lower or down-hole guide/support and the second rod guide/support 162 can be referred to as an upper or up-hole guide/support since during typical use of the drilling machine with the frame inclined, the first guide/support 160 is positioned lower and closer to the launch point than the second guide/support 162. The first guide/support 160 is positioned between the first vise 132 and the base end 72 of the frame and/or the launch point of the bore. The second guide/support 162 is positioned between the second vise 134 and the rotational driver 80 and is carried with the second vise 134 as the second vise 134 is translated along the drive axis 84. The second guide/support 162 does not pivot with the second vise 134. The vise arrangement 130 further includes a joint thread lubricant dispenser 166 that is carried with the second rod vise 134 as the second rod vise 134 is translated along the drive axis 84. In one example, the lubricant dispenser 166 is mounted at an up-hole side of the second guide/support 162 by a bracket 168. The lubricant dispenser 166 is configured to dispense lubricant into the rod coupler 82 of the rotational drive 80. Preferably, lubricant is dispensed by the dispenser 166 to the rod coupler 82 each time before the rod coupler 82 is threaded with the next drill rod.

Referring to FIGS. 6A and 6B, the first and second vises 132, 134 are positioned along the drive axis 84. The second rod vise 134 is positioned between the first rod vise 132 and the rotational driver 80. The second rod vise is movable (e.g., translatable) along the drive axis 84 relative to the first rod vise 132 between a first axial position (see FIG. 6A) and second axial position (see FIG. 6B). When the second rod vise 134 is in the first axial position, the second rod vise 134 is in close proximity to the first rod vise 132 and is offset from the rod storage structure 76 and the rod transfer path such that the second rod vise 134 is not intersected by the rod transfer path and does not form an obstruction that prevents a drill rod from being moved between the drill rod storage structure 76 and the drive axis 84 by the rod handling device 110. Thus, with the second rod vise 134 in the first axial position, the second rod vise 134 does not block or interfere with the ability to move rods linearly from the drive axis 84 to the rod storage structure 76 or from the rod storage location 76 to the drive axis 84. When the second rod vise 134 is in the second axial position, the second rod vise 134 is intersected by the rod transfer path and coincides with or axially overlaps with the rod loading/unloading region of the rod storage structure. Thus, when the second rod vise 134 is in the second axial position, the second rod vise obstructs the ability to move rods linearly between the bottom of the rod storage structure 76 and the drive axis 84. In other words, with the second rod vise 134 in the second axial position, the second rod vise 134 blocks or interferes with the ability to move rods linearly from the drive axis 84 to the rod storage structure 76 and from the rod storage location 76 to the drive axis 84.

In one example, the first rod vise 132 is not mounted to pivot about the drive axis 84 relative to the frame 70 and is not configured to slide or translate along the drive axis 84 relative to the frame 70. Thus, the first rod vise 132 can be referred to as a fixed vise. In contrast, the second rod vise is configured to pivot about the drive axis 84 relative to the frame 70 and the first rod vise 132, and is also configured to slide along the drive axis 84 relative to the frame and the first rod vise 132.

Figure 8:
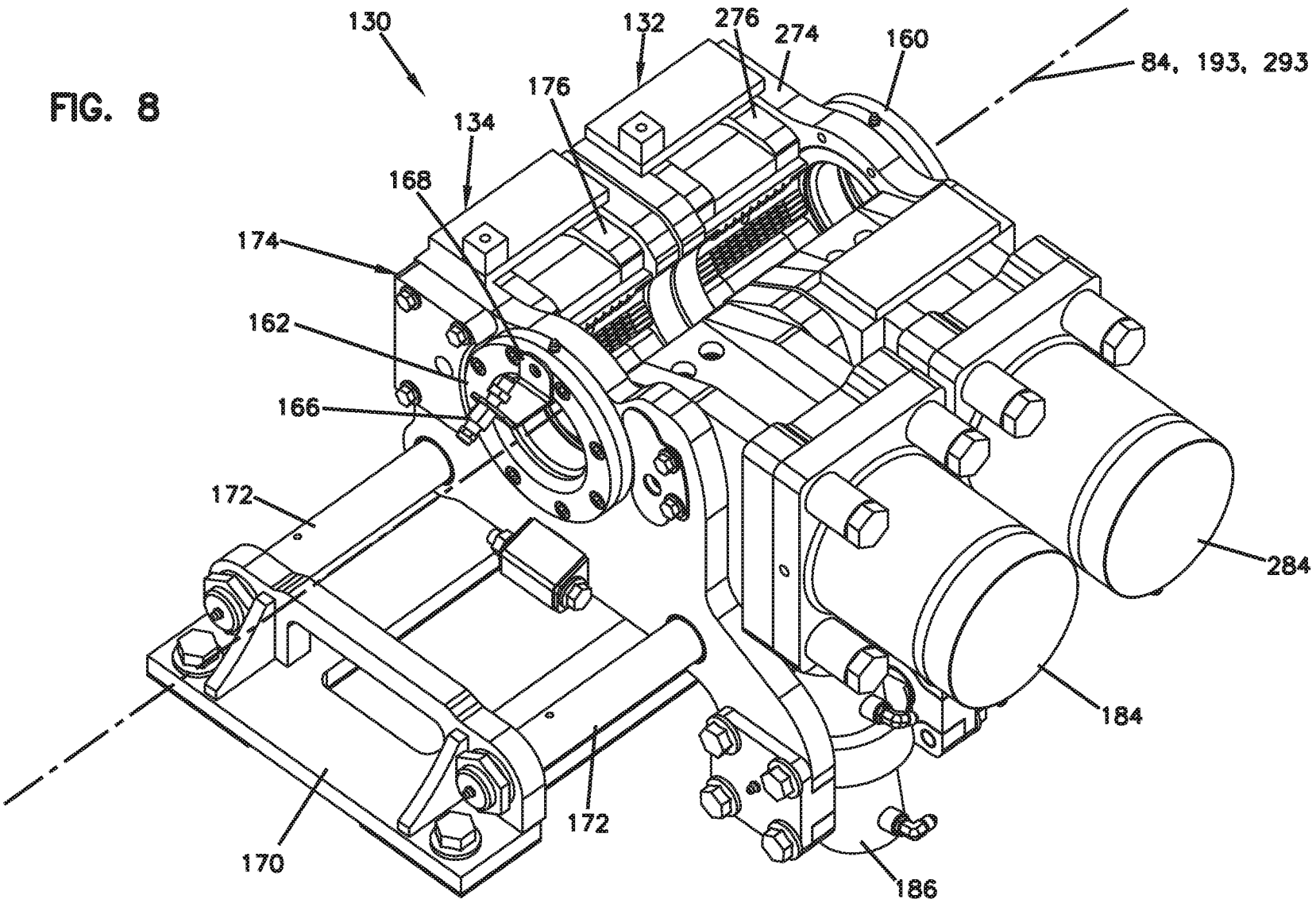
FIG. 8 is a perspective view of a vise arrangement in accordance with the principles of the present disclosure that can be incorporated as part of the drilling machine of FIG. 4, the vise arrangement including a translatable and pivotal vise shown in a first axial position and a first pivotal position.
Figure 9A:
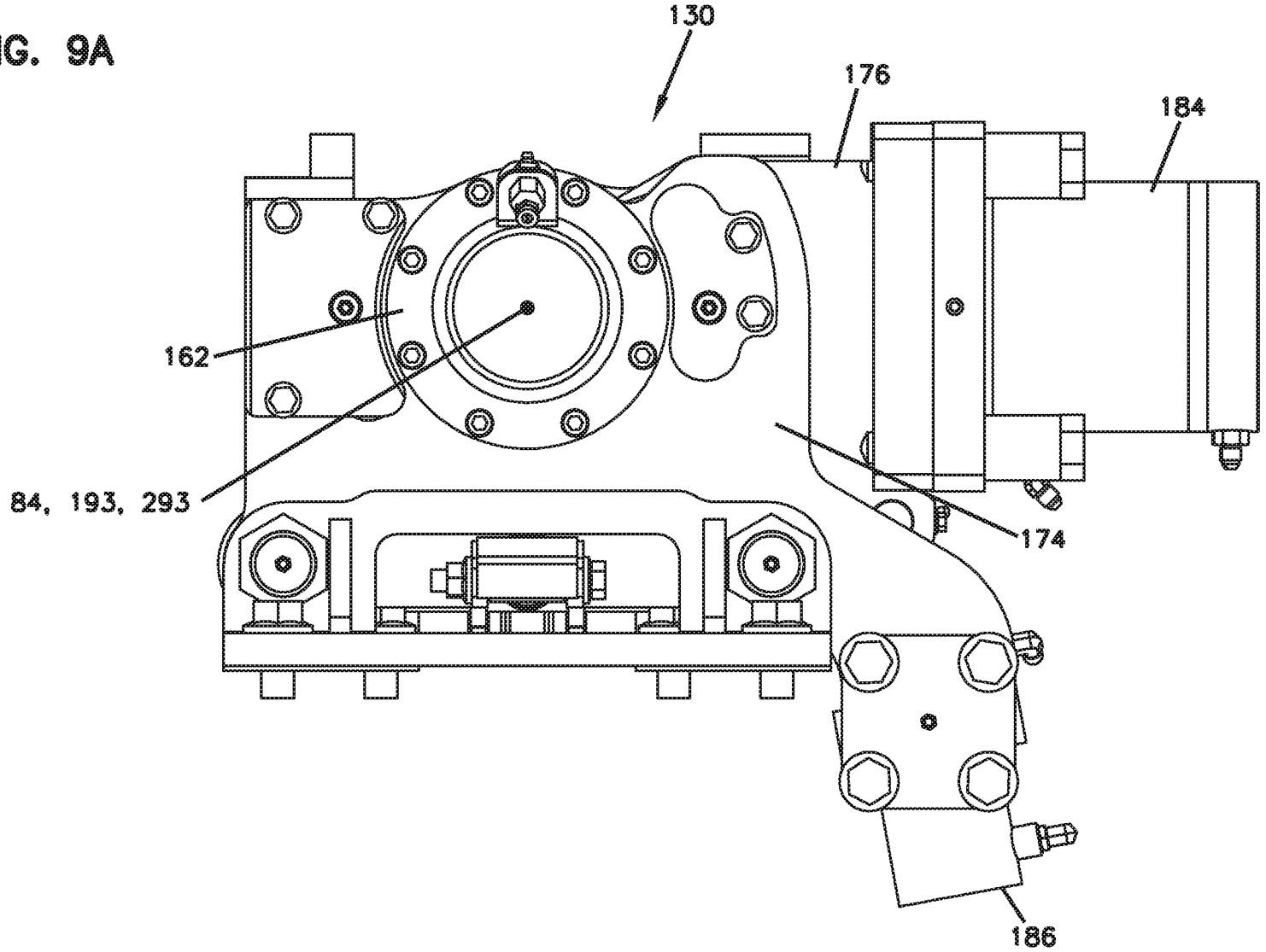
FIG. 9A shows an up-hole side of the vise arrangement of FIG. 8.
Figure 9B:
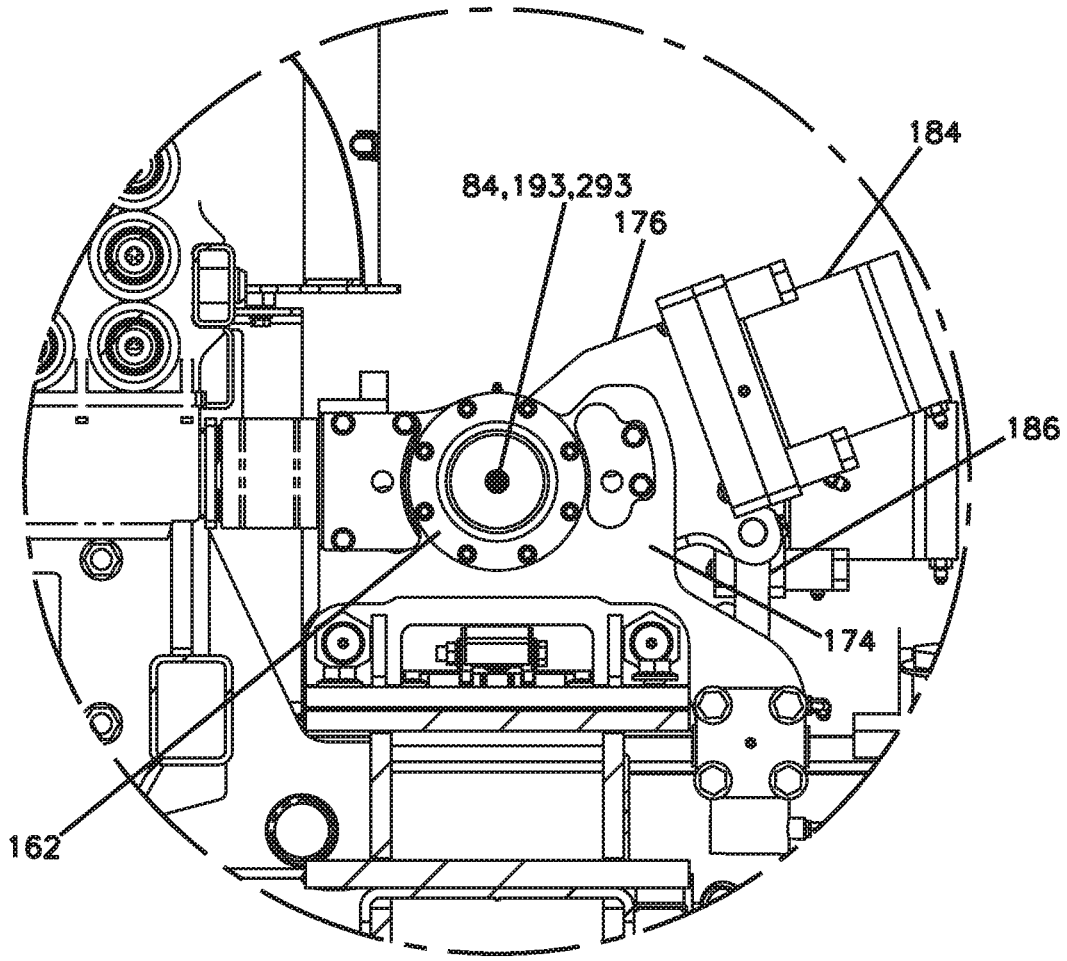
FIG. 9B shows an up-hole side of the vise arrangement of FIG. 8 with the translatable and pivotal vise pivoted to a second pivotal position.
Figure 10:
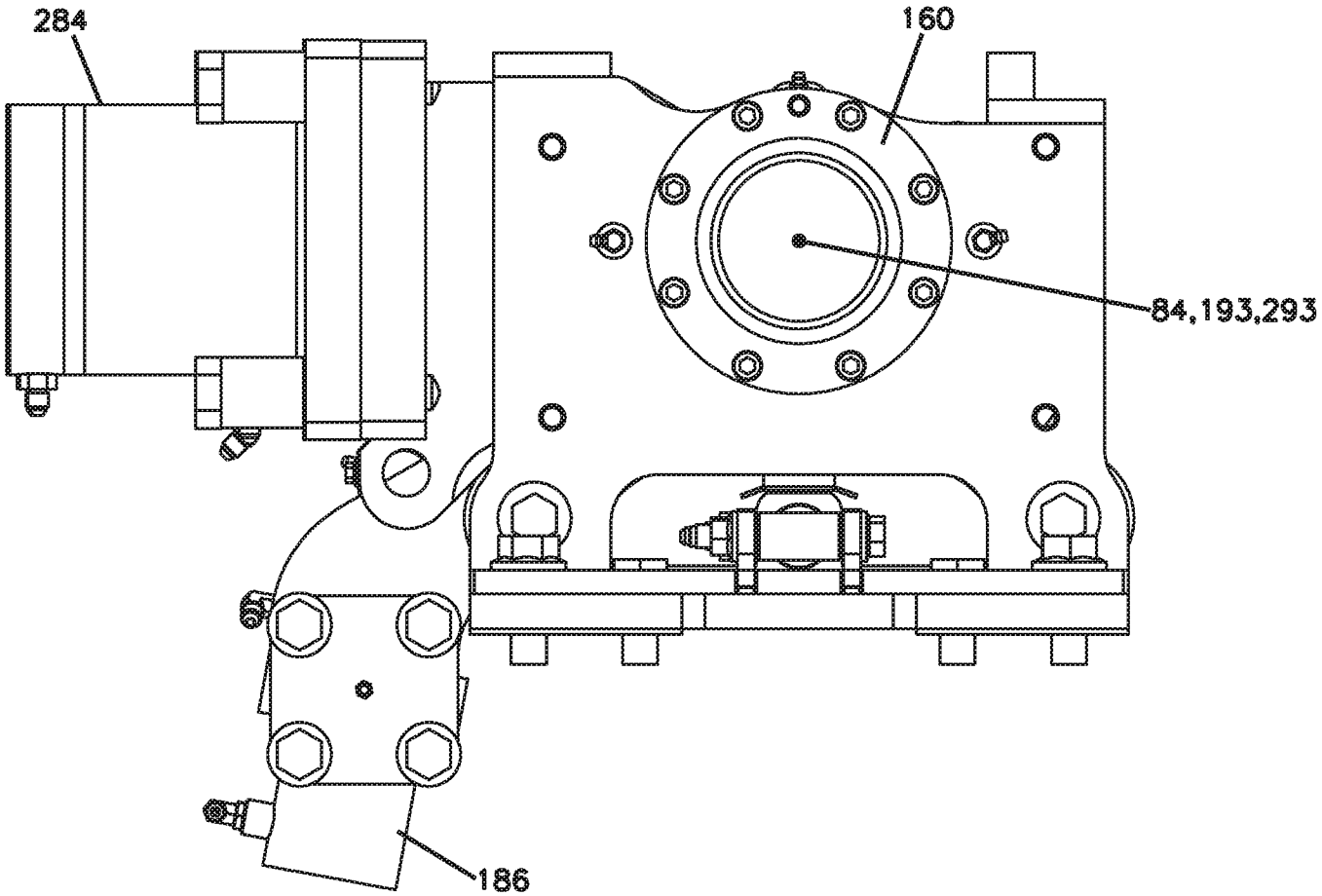
FIG. 10 shows a down-hole side of the vise arrangement of FIG. 8.
Figure 11:
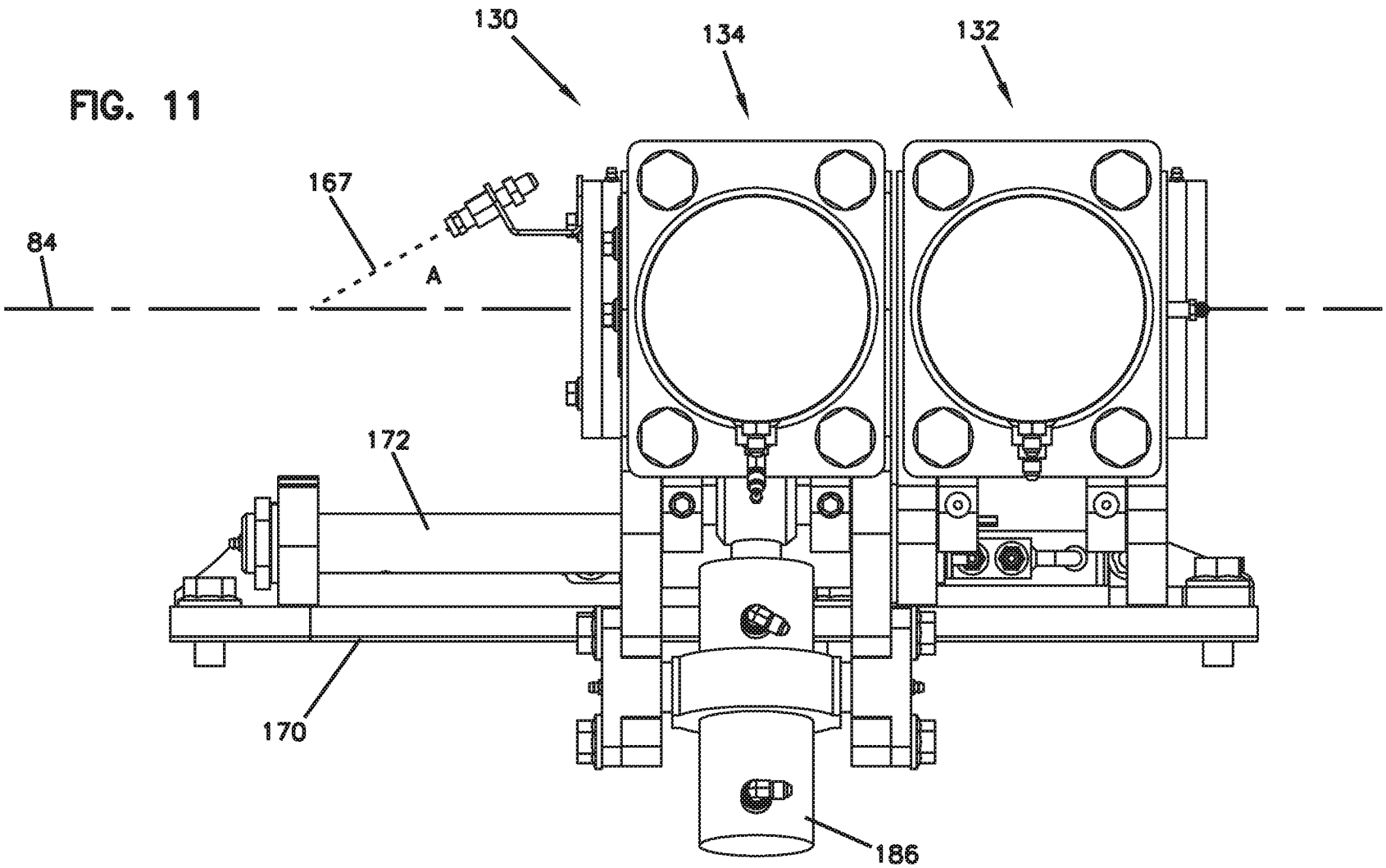
FIG. 11 is a first side view of the vise arrangement of FIG. 8.
Figure 12:
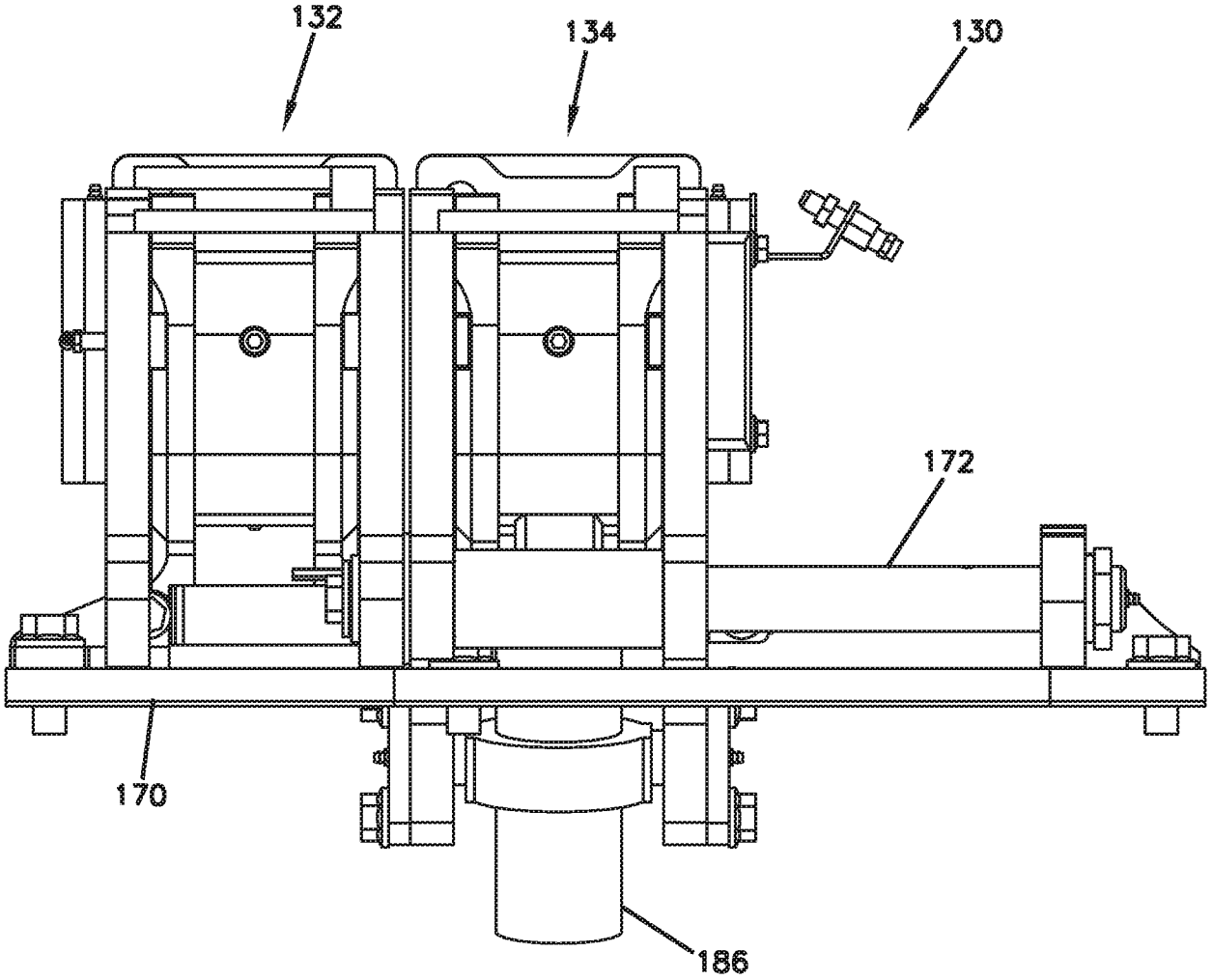
FIG. 12 is a second side view of the vise arrangement of FIG. 8.
Figure 13:
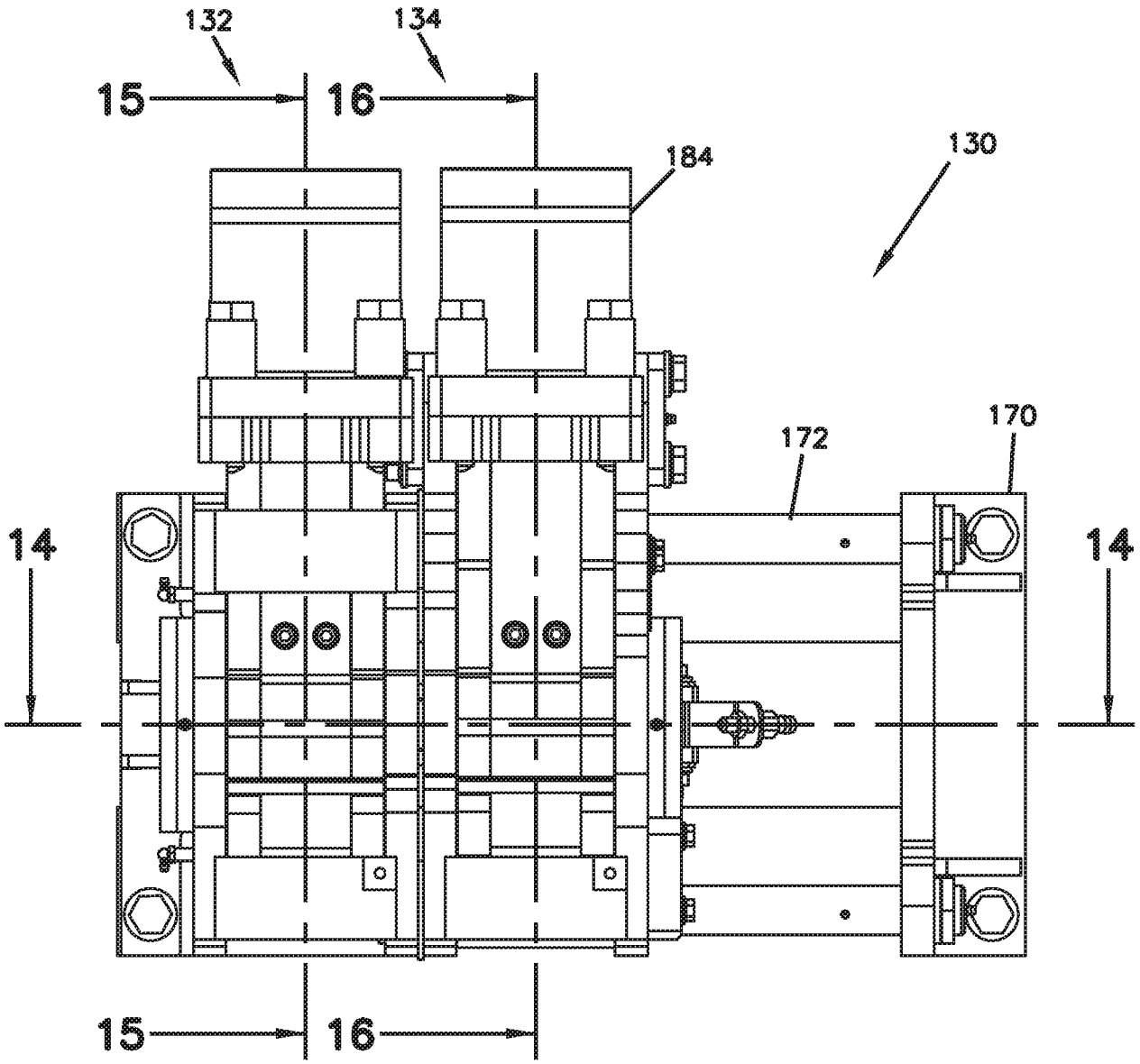
FIG. 13 is a top view of the vise arrangement of FIG. 8.
Figure 14:
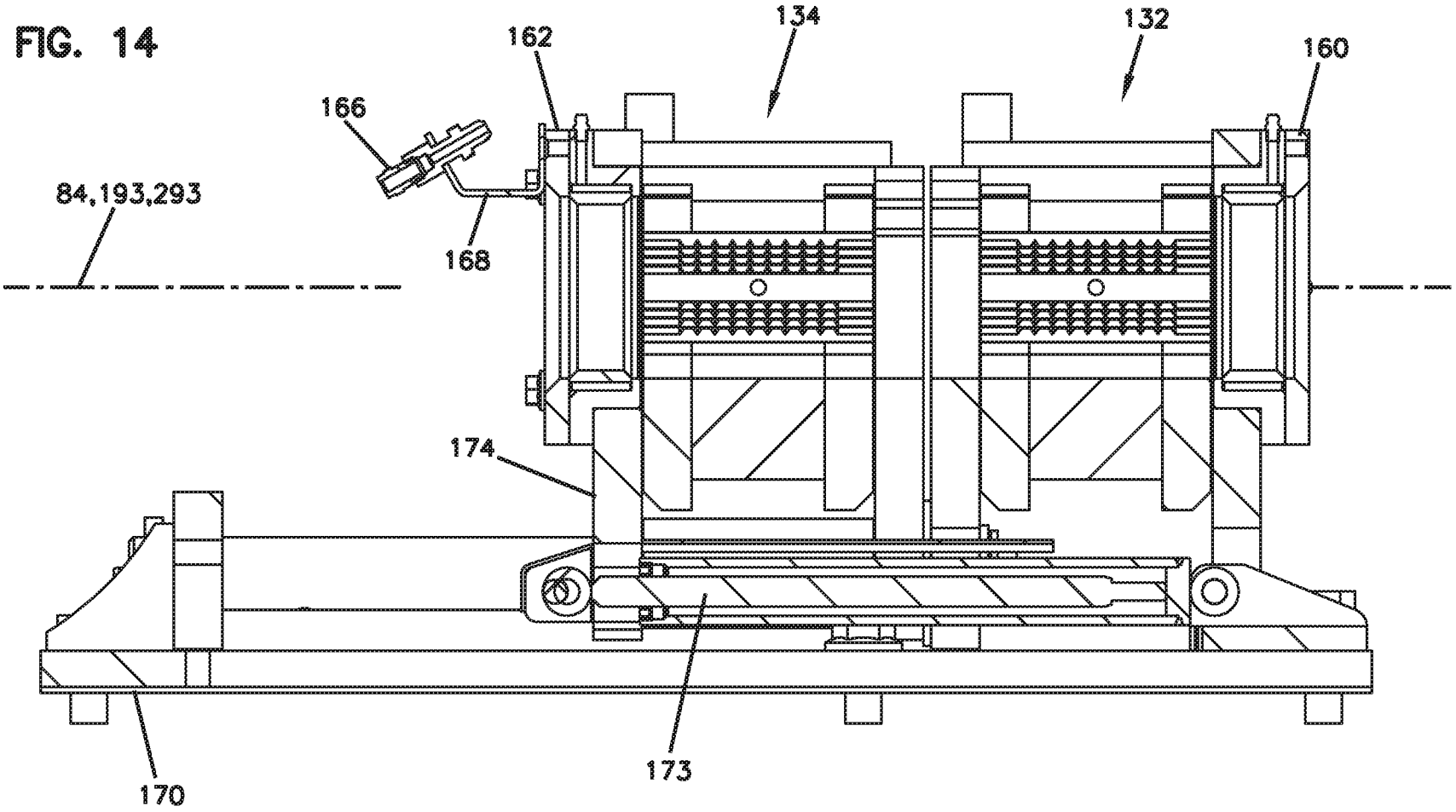
FIG. 14 is a cross-sectional view of the vise arrangement of FIG. 8 taken along section line 14-14 of FIG. 13.
Figure 15:
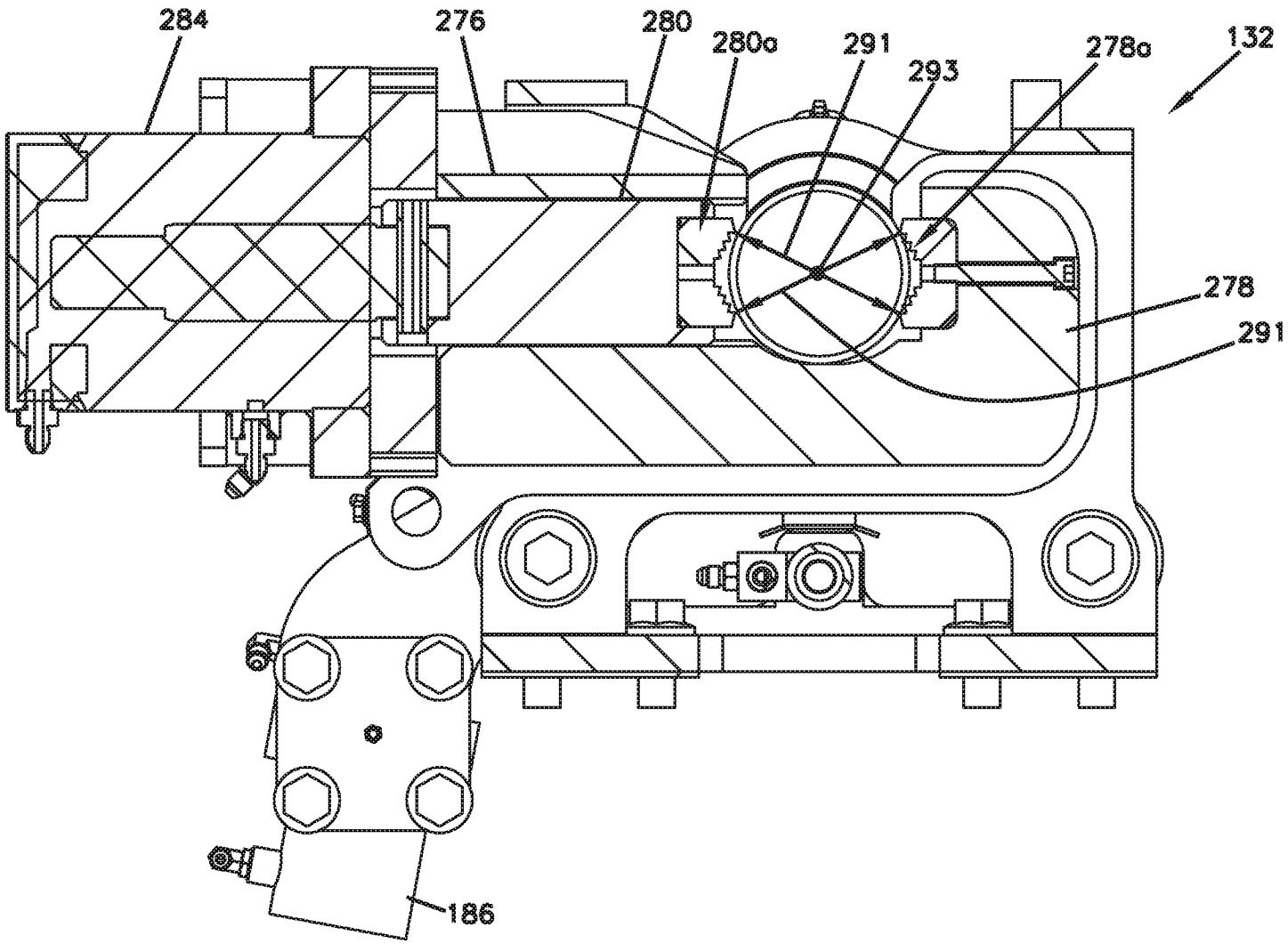
FIG. 15 is a cross-sectional view of the vise arrangement of FIG. 8 taken along section line 15-15 of FIG. 13.
Figure 16:
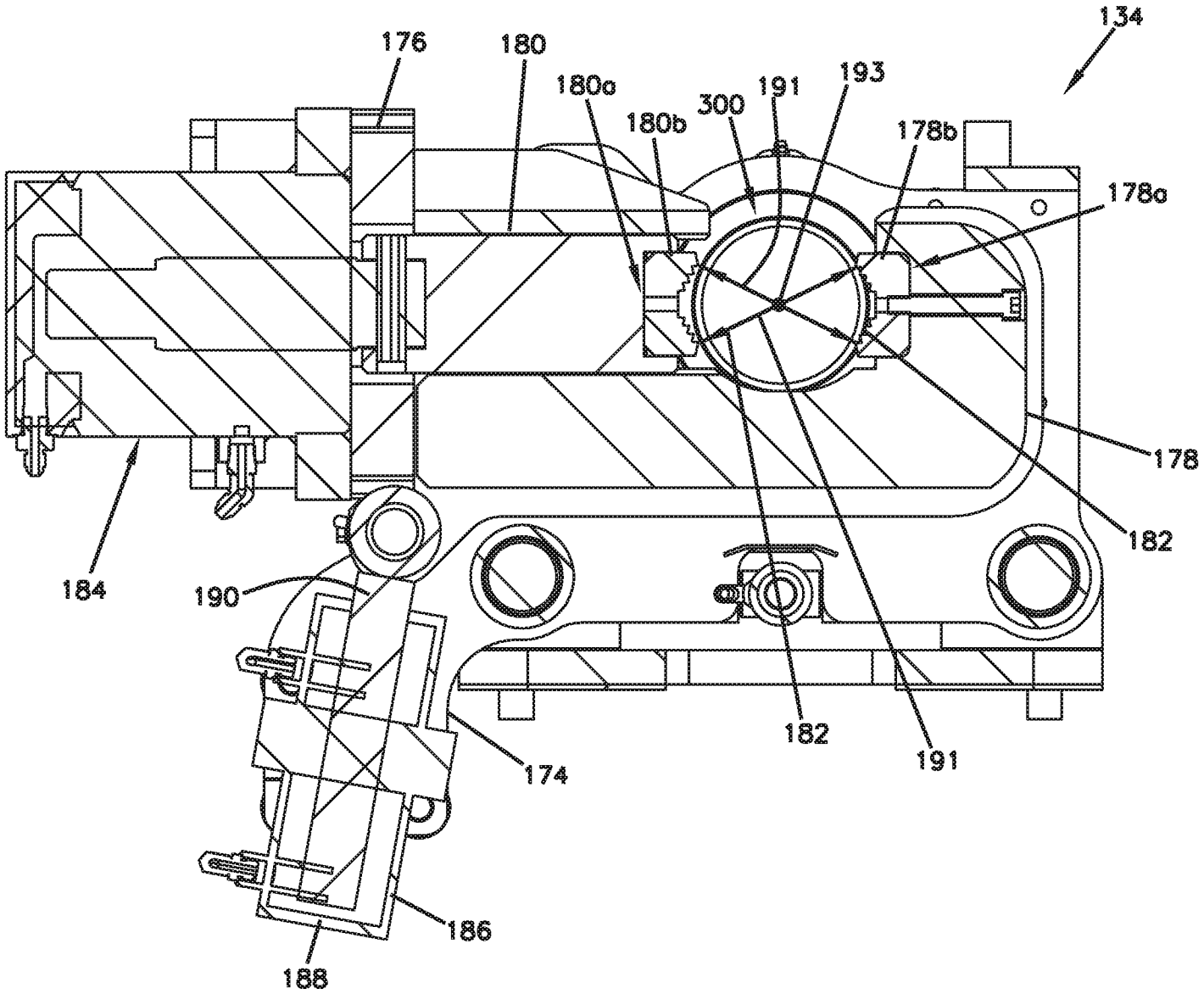
FIG. 16 is a cross-sectional view of the vise arrangement of FIG. 8 taken along section line 16-16 of FIG. 13.

Referring to FIG. 8, the vise arrangement 130 includes a base plate 170 that mounts to the frame 70 adjacent the base end 72 of the frame 70. Linear motion bearings 172 (e.g., rails, rods, tracks, guides, etc.) are mounted on the base plate 170 to guide movement of the second rod vise 134 between the first and second axial positions. The second rod vise 134 includes an outer frame 174 that is mounted on the linear motion bearings 172 and is configured to slide back and forth along the linear motion bearings 172. The second rod guide/support 162 is mounted at an up-hole side of the outer frame 174. An actuator such as a hydraulic cylinder 173 (see FIG. 14) is used to move the second rod vise 134 along the linear motion bearings 172 between the first and second axial positions. The hydraulic cylinder 173 includes one end attached to the base plate 170 and an opposite end attached to the outer frame 174 of the second rod vise 134.

The second rod vise 134 also includes an inner frame 176 that is pivotally mounted within the outer frame 174 so as to allow the second rod vise 134 to pivot about the drive axis 84 between first and second pivotal positions. Rotational movement bearings, centered on the drive axis 84, can be provided between the inner frame 176 and the outer frame 174 to allow the inner frame 176 to pivot relative to the outer frame 174. Vise jaws 178, 180 (see FIG. 16) are mounted within and carried by the inner frame 176. The vise jaws 178, 180 include opposing portions 178*a*, 180*a* that include opposing dies 178*b*, 180*b*. The jaws 178, 180 can be sized to clamp on and grip the enlarged diameter portions of the drill rods 32. The dies 178*b*, 180*b* can include gripping sides that each may have a tapered, generally concave pocket shape 182 for receiving the enlarged diameter portions of a drill rod 32. The gripping sides may include teeth. The jaw 178 is depicted as a fixed jaw that is fixed relative to the inner frame 176 and the jaw 180 is depicted as a movable jaw that is linearly movable relative to the inner frame 176. In other examples, both jaws may be movable or more than two jaws may be provided. The jaw 180 can be linearly moved relative to the jaw 178 by an actuator such as a hydraulic cylinder 184 mounted to and carried with the inner frame 176. The cylinder 184 can have a cylinder portion coupled to the inner frame 176 and a piston rod coupled to the jaw 180. By retracting the cylinder 184, the second rod vise 134 can be moved to an open position in which a rod can be inserted axially therein. In the open position, the second rod vise 134 defines a cross-dimension spacing 191 between the opposing portions 178*a*, 180*a* that is larger than the enlarged end diameters of the drill rods. When the cylinder 184 is extended, the jaw 180 is moved relative to the jaw 178 causing the spacing 191 between the opposing portions 178*a*, 180*a* of the jaws 178, 180 to be reduced. In this way, the second rod vise 134 moves toward a closed position in which the opposing portions 178*a*, 180*a* engage and clamp against a drill rod with the drill rod compressed between the opposing portions 178*a*, 180*a*. This clamping action prevents the drill rod from rotating relative to the second rod vise 134 when making and breaking threaded joints. At least when the second rod vise 134 is in the closed position, the opposing portions 178*a*, 180*a* define a central vise axis 193 that is preferably co-axially aligned with the drive axis 84.

An actuator such as a hydraulic cylinder 186 is used to pivot the second rod vise 134 relative to the frame 70 and the outer frame 174. The cylinder 186 can include a cylinder portion 188 coupled to the outer frame 174 and a piston rod 190 coupled to the inner frame 176. The cylinder 186 is configured to pivot the second vise 134 about the drive axis 84 between a first position (see FIG. 9A) and a second position (see FIG. 9B). The second rod vise 134 is pivoted relative to the first rod vise 132 from the first position to the second position to break a joint between two drill rods. Thus, the first position can be referred to as a home pivotal position and the second position can be referred to as a joint-break pivotal position. The jaws 178, 180 and the inner frame 176 define an open side 300 of the second rod vise 134. The open side 300 faces in an upward direction when the second rod vise 134 is in the home pivotal position. Thus, the second rod vise 134 is an open-top vise.

The first rod vise 132 includes an outer frame 274 that is fixed relative to the base plate 170. The first rod vise 132 also includes an inner frame 276 that is fixed within the outer frame 274. Vise jaws 278, 280 (see FIG. 15) are mounted the inner frame 276. The vise jaws 278, 280 include opposing portions 278*a*, 280*a* that include opposing dies 278*b*, 280*b*. The jaws 278, 280 can be sized to clamp on and grip the enlarged diameter portions of the drill rods 32 and can have the same structure and operate in the same basic way described with respect to the jaws 178, 180 to provide clamping. The jaw 278 is depicted as a fixed jaw that is fixed relative to the inner frame 276 and the jaw 280 is depicted as a movable jaw that is linearly movable relative to the inner frame 276. In other examples, both jaws may be movable or more than two jaws may be provided. The jaw 280 can be linearly moved relative to the jaw 278 by an actuator such as a hydraulic cylinder 284 mounted to the inner frame 276. Actuation of the cylinder 284 can open the first rod vise 132 so that the enlarged diameter portion of a drill rod can be inserted therein, and can close the rod vise 132 on the drill rod to clamp the rod and prevent the rod from rotating relative to the vise 132 when making or breaking a threaded joint. In the open position, the vise 134 defines a cross-dimension spacing 291 between the opposing portions 278*a*, 280*a* that is larger than the enlarged end diameters of the drill rods. At least when the first rod vise 132 is in the closed position, the opposing portions 278*a*, 280*a* define a central vise axis 293 that is preferably co-axially aligned with the drive axis 84.

To break a joint between two drill rods 32*a*, 32*b*, the joint is positioned with the seam between the first and second rod vises 132, 134 while the second rod vise 134 is in the first axial position along the drive axis 84 and is also in the first pivotal position about the drive axis (i.e., the home pivotal position). Proper positioning in the joint can be easily visually determined through visual inspection through the open tops sides of the vises. With the joint properly positioned between the first and second rod vises 132, 134, the first and second rod vises 132, 134 are clamped on their respective drill rods and the second rod vise 134 is pivoted from the first pivotal position to the second pivotal position to break the joint. Once the joint is broken, the second rod vise 134 can be opened and the rotational driver 80 can counter-rotate the rod coupler 82 to fully unthread the joint. Once the joint is unthreaded, the rotational driver 80 is moved up the track 102 to pull the drill rod into alignment with the rod load/unloading region 117 of the rod storage structure 76. As the rotational driver 80 is moved up the track 102, the second rod vise 134 is concurrently moved by the hydraulic cylinder 173 up the track from the first axial position to the second axial position. Thus, the second rod vise 134 follows the movement of the rotational driver 80. When the drill rod is aligned with the rod load/unloading region 117 of the rod storage structure, the rod handling device 110 is extended such that the rod is received in the rod receivers 116. The second rod vise 134 is then clamped and the rotational driver 80 counter-rotates the rod coupler 82 to unthread the rod coupler 82 from the upper end of the rod. The second rod vise 134 is then opened and lowered to the first axial position so that the second rod vise does not obstruct linear movement of the rod from the drive axis 84 to the load/unloading region 117 along the rod transfer path. The rod handling device 110 is then retracted to move the rod from the drive axis 84 through the rod load/unloading region 117 to a location beneath a column of the rod storage structure 76. The lift device 112 is then used to push the rod upwardly into the rod storage structure, and the rotational driver 80 moves back down the track to couple with the next drill rod to be pulled-back from the bore. Once the next drill rod has been pulled back, the above process can be repeated.

To make a joint between two drill rods, it is not necessary to use the second rod vise 134, rather, only the first rod vise 132 and the rotational driver 80 are used. To make a joint, the first rod vise 132 clamps on the up-hole end of the uppermost rod of the drill string, and the second rod vise 134 is open. A rod is then transferred linearly from the load/unloading region 117 of the rod storage structure 76 to a position in co-axial alignment with the rotational driver 80. The rotational driver 80 is then slowly propelled down the track 102 while the rod coupler 82 is rotated to torque-up the threaded joint between the upper end of the drill rod and the rod coupler 82 and to also torque-up the joint between the lower end of the drill rod and the upper end of the drill rod that is clamped by the first rod vise 132. Once the joints are torqued-up, the first rod vise 132 is opened and the rod handling device 110 is retracted such that the torqued-up section of drill rod is ready to be pushed into the ground by the rotational driver 80.

The first and second rod guides/supports 160, 162 of the vise arrangement 130 are passive, non-active components that function to self-center the enlarged end portions 38*a*, 40*a* of two drill rods 32*a*, 32*b* desired to be coupled together at a threaded joint. The first rod guide/support 160 is positioned to engage and self-center, prior to clamping, a drill rod that enters the rod vise arrangement from a down-hole direction. The second rod guide/support 162 is positioned to engage and self-center, prior to clamping, a drill rod that enters the rod vise arrangement from an up-hole direction. The rod guides/supports 160, 162 can be configured to center the enlarged end portions 38*a*, 40*a* with respect to the central vise axes 193, 293, which are preferably co-axial with the drive axis 84 of the rotational driver 80. In one example, the rod guides/supports 160/162 are configured to center the enlarged end portions 38*a*, 40*a* to within 0.25 inches or to within 0.125 inches of the central vise axes 193, 293. In certain examples, the first rod guide/support 160 is fixed on a down-hole most wall of the rod vise arrangement 130 and the second rod guide/support is fixed on an up-hole most wall of the rod vise arrangement 130. In certain examples, the first rod guide/support 160 is attached to a down-hole wall of the outer frame 274 of the first rod vise 132 and the second rod guide/support 162 is attached to an up-hole wall of the outer frame 174 of the second rod vise 134. In certain examples, the first and second rod guides/supports 160, 162 each define inner cross-dimensions (e.g., inner diameters) that are smaller than the cross-dimension spacings 191, 291 of the vises 130, 132 when the vises 130, 132 are in the open position. In certain examples, the rod guides/supports define inner cross-dimensions (e.g., inner diameters) that are no more than 0.25 inches larger or in the range of 0.1 to 0.25 inches larger than the nominal outer diameter defined by the enlarged end portions of the drill rods for which the drilling machine is sized to accommodate. In certain examples, the first rod guide/support is located below the rod vise arrangement 130 and the second rod guide/support is located above the rod vise arrangement 130. In certain examples, the first rod guide/support is located below the rod vise arrangement 130 and has a tapered lead-in that faces in a down-hole direction and the second rod guide/support is located above the rod vise arrangement 130 and has a tapered lead-in that faces in an up-hole direction. In certain examples, the tapered lead-ins correspond with inner openings having cross-dimensions (e.g., diameters) that reduce in size as the inner openings extend toward the rod vise arrangement 130. In certain examples, the first and second rod guides/supports 160, 162 are rings. In certain examples, the first and second rod guides/supports 160, 162 define inner guide openings that are circular in shape and that are centered on the central vise axes 193, 293 and the drive axis 84. In certain examples, the first and second guides/supports 160, 162 are separated by a spacing that is less than or equal to the enlarged diameter section length L of a rod joint between two rods sized to be compatible with the drilling machine. In certain examples, the rod guides/supports can be referred to as rod alignment or rod centering members or components. In some examples, the rod alignment members or rod centering members can include alignment of centering openings having a circular transverse cross-sectional shape. In other examples, the rod guides/supports can be referred to as rod centering rings or rod alignment rings.

It will be appreciated that the rod guides/supports 160, 162 provide mechanical contact with the enlarged ends of the drill rods to pre-center the central axes of the drill rods, as needed, on the center axes of the vises 132, 134 prior to clamping the drill rods with the vises 132, 134. As the enlarged end of a drill rod is inserted into one of the rod guides/support 160, 162, if the enlarged end is not centered with the drive axis 84 and the vise axes 193, 293, the enlarged end contacts the corresponding rod guide/support 160, 162 and through this contact is moved into a centered position in general alignment with the axes 84, 193, 293. This occurs before clamping the drill rod with either of the vises 132, 134. Thus, since the rod is pre-centered, the opposing jaws of the vises 132, 134 are not required to move the rod into a centered position through contact with the angled pocket portions of the jaws during the clamping process. This reduces wear. It is preferred for a spacing between the guides/supports 160, 162 to be less than or equal to the enlarged diameter section length L of a rod joint between two rods sized to be compatible with the drilling machine. This ensures that the enlarged end portion of at least one the two rods is within one of the guides/supports 160, 162 and supported in central alignment as needed when the seam of the joint is positioned between the vises 132, 134 of the vise arrangement 130. If the spacing were larger, the smaller diameter intermediate portion of one or both of the rods could be located within the corresponding guide/support 160, 162 enabling the rod to drop by gravity out of alignment with the vise axes 193, 293. In one example, the spacing from the mid-point of the vises 132, 132 to the upper rod guide 162 is less than or equal to the length of the enlarged diameter portion 140*a* (i.e., the length of the longer enlarged diameter portion of the drill rod) and the spacing from the mid-point of the vises 132, 132 to the lower rod guide 160 is also less than or equal to the length of the enlarged diameter portion 140*a*. In one example, the spacing from the mid-point of the vises 132, 132 to the upper rod guide 162 is equal to the spacing from the mid-point of the vises 132, 132 to the lower rod guide 160. In other examples, the spacing from the mid-point of the vises 132, 132 to the upper rod guide 162 may be different from (e.g., larger than or smaller than) the spacing from the mid-point of the vises 132, 132 to the lower rod guide 160.

It will be appreciated that aspects of the rod guide system disclosed herein are applicable to drill rods having enlarged end portions 38*a*, 40*a* with different lengths. When the joint 50 is properly positioned within the vise arrangement 130, the exterior seam of the joint is located between the vises 132, 134. Since the enlarged end portion 38*a* of the joint 50 is shorter, the corresponding shoulder of the enlarged end portion 38*a* is positioned up-hole with respect to the lower rod guide 160. However, at the same time, the enlarged end portion 40*a* is positioned within the rod guide 162 so as to provide pre-alignment of the central longitudinal axis of the joint 50 and the axes 193, 293 of the vises 132, 134 prior to clamping of one or both the vises 132, 134. This is particularly useful during pull-back operations, where absent the presence of the upper rod guide 162, the positioning of the shoulder of the enlarged end section 38*a* up-hole of the lower guide 160 when the seam of the joint 50 is between the vises 132, 134 would allow the joint 50 to drop down by gravity out of alignment relative to the vises 132, 134 prior to clamping of the vises 132, 134. In this situation, the upper rod guide 162 provides a centering function of the central axis of the joint, which extends longitudinally through the enlarged joint length L, relative to the central axes of the vises 132, 134. The inclusion of both upper and lower guides 160, 162 allows the system to be readily used regardless of whether the drilling machine is used with a drill string having each drill rod oriented with the enlarged end portion 38*a* up-hole and the enlarged end portion 40*a* down-hole (as shown) or alternatively with the enlarged end portions 38*a* down-hole and the enlarged end portions 40*a* up-hole. Also, the use of guides 160, 162 allows for vises 132, 134 with relatively wide jaws to be used to enhance gripping of the drill rods while concurrently providing for pre-alignment of the drill rod enlarged end portions within the vises 132, 134. Additionally, providing the rod guide 162 carried with the upper vise 134 allows the guide 162 to maintain or provide centering of the end of a drill rod when the vise 134 is open and moved to the second (e.g., upper) axial position. For example, during pull-back operations after a joint has been broken between two drill rods, the vise 134 is opened, the rotational driver 80 is used to fully unthread the joint, and the uncoupled drill rod is moved up the track 102 into alignment with the rod storage structure 76. The vise 132 can also be moved axially with the presence of the upper guide 162 ensuring centering of the rod relative to the vise 132 when the vise 132 is in the second axial position. In this way, the rod is ensured to be centered relative to the vise 132 when the vise 132 is again closed so as to clamp on the rod to prevent rotation of the rod as the coupling between the rod and the rod coupler 82 of the rotational driver 80 is broken via rotation of the rod coupler 82.

The lubricant dispenser 166 of the drilling machine 60 is configured to dispense lubricant into the rod coupler 82 of the rotational drive 80. In one example, the dispenser 166 is oriented to face at least partially in an up-hole direction, and optionally is mounted at an up-hole most wall of the rod vise arrangement 130. In one example, the rod coupler 82 has a female threaded interface with internal threads 81, and the dispenser 166 is oriented to dispense lubricant (e.g., grease) into the interior of the female threaded interface onto the interior threads 81. In one example, the dispenser 166 is positioned to dispense joint lubricant along a dispensing axis 167 (see FIG. 11) that is oriented at an oblique angle relative to the drive axis 84. In one example, the oblique angle A of the dispensing axis 167 is in the range of 20-70 degrees relative to the drive axis. In another example, the oblique angle of the dispensing axis is in the range of 30-60 degrees relative to the drive axis. In a further example, the joint lubricant dispenser is carried with the translatable vise 134 as the translatable vise 134 moves between the first and second axial positions. In certain examples, the dispenser 166 is a nozzle, spray tip, injector, or like structure. In certain examples, the dispenser 166 receives lubricant (e.g., grease) from a reservoir and includes a source of pressure (e.g., a pump) for conveying the lubricant through tubes, hoses, pipes, or other means from the reservoir to the dispenser 166. In certain examples, an actuator such as a switch, button, or the like can be manually engaged by an operator to cause the dispenser to dispense a volume of lubricant.

In certain examples, the drilling machine 60 includes only a single lubricant dispenser 166. In certain examples, lubricant is not dispensed directly on the threads of the rods, but only on the threads of the rod coupler of the rotational driver 80 and transferred to the threads of the rods through contact with the rod coupler. In certain examples, lubricant is applied to the rod coupler during both drilling and pull-back operations. In certain examples, lubricant is applied to the rod coupler at a location near a vise arrangement near the base of the track on which the rotational driver moves. In certain examples, during drilling operations, lubricant is applied to the rod coupler when the rotational driver 80 is stopped at a lubrication station as the rotational driver 80 is being moved from a down-hole position on the track to an up-hole position on the track. The up-hole position on the track is a position in which the rod coupler can be connected to another rod to be added to the drill string. In certain examples, during pull-back operations, lubricant is applied to the rod coupler when the rotational driver 80 is stopped at a lubrication station as the rotational driver 80 is being moved from an up-hole position on the track to a down-hole position on the track. The down-hole position on the track is a position in which the rod coupler can be connected to the upper-most rod in the drill string that is to be removed from the ground and uncoupled from the drill string. In one example, the system includes a lubricant dispenser that is movable. In one example, the system includes a lubricant dispenser that is movable along the drive axis 84. In one example, the system includes a lubricant dispenser that is movable with a vise.

Figure 21:
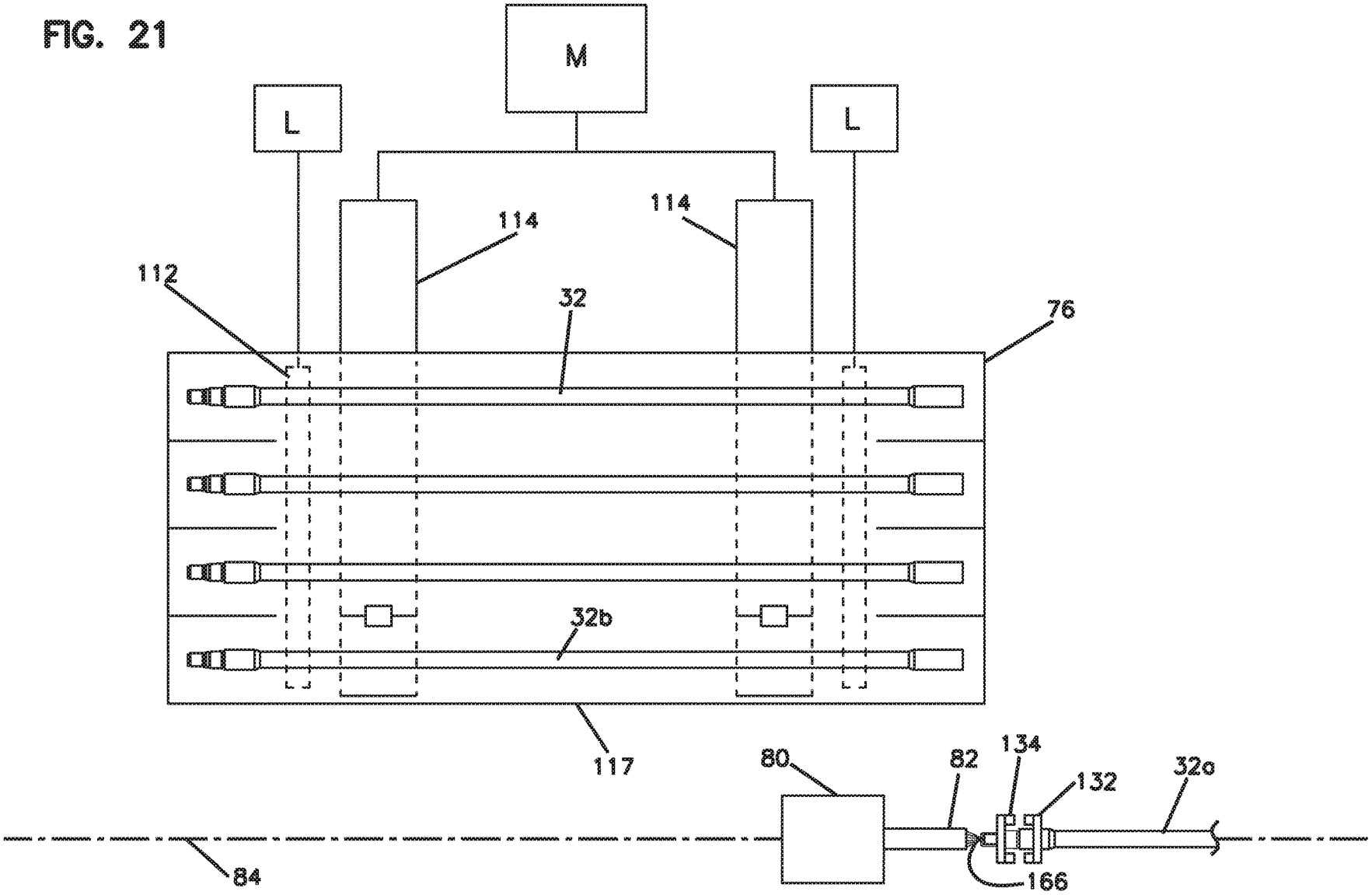
Figure 22:
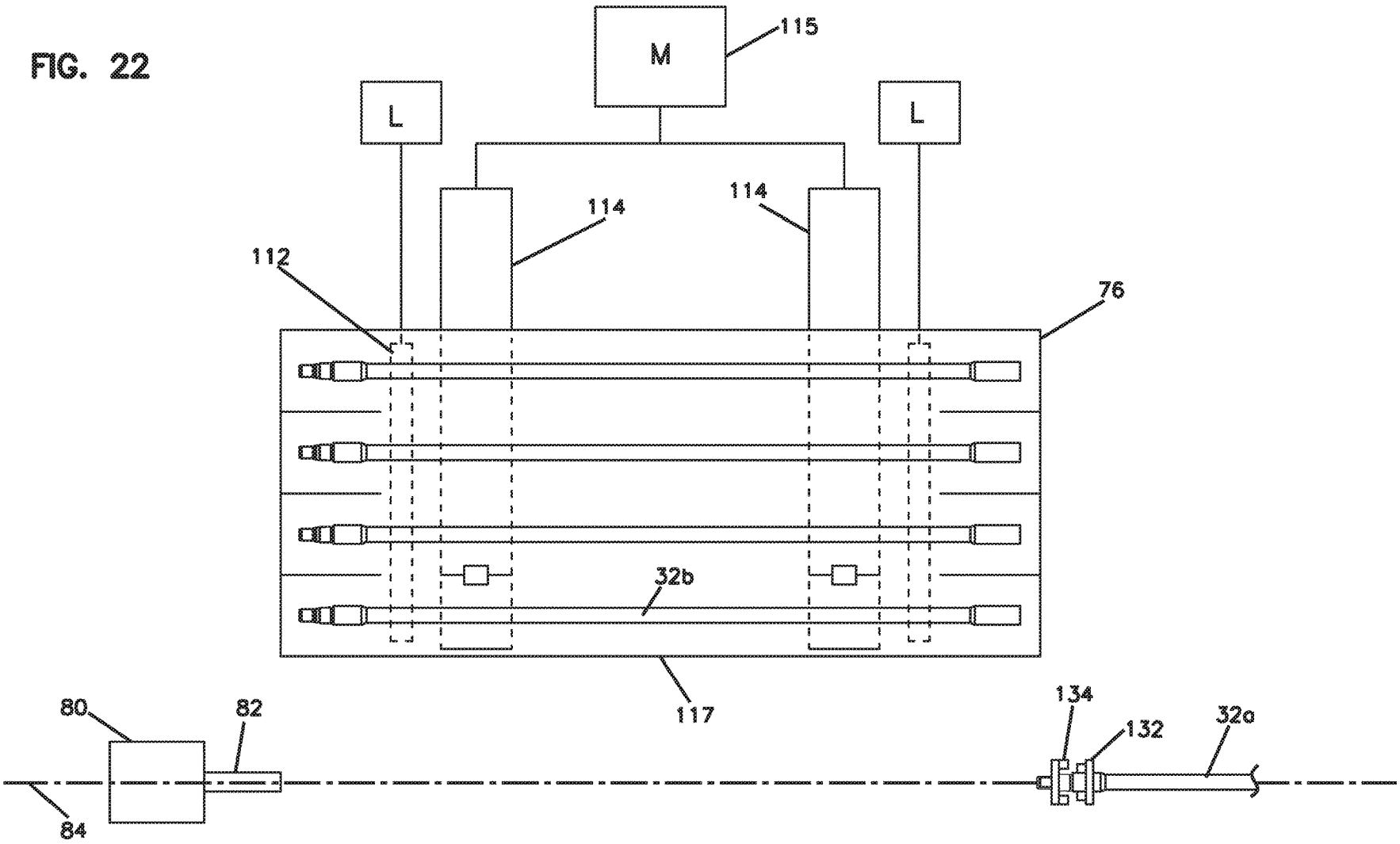
Figure 23:
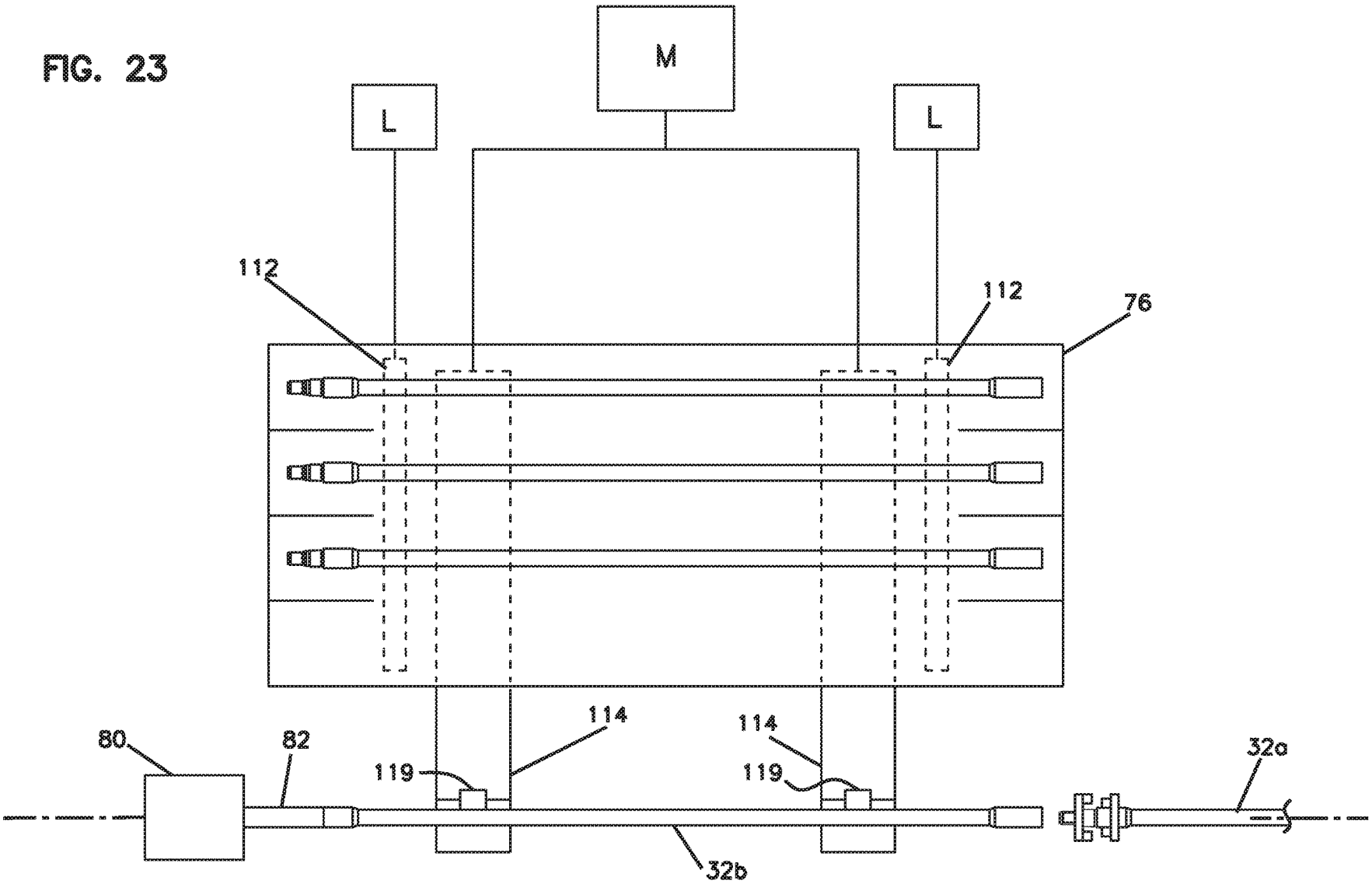
Figure 24:
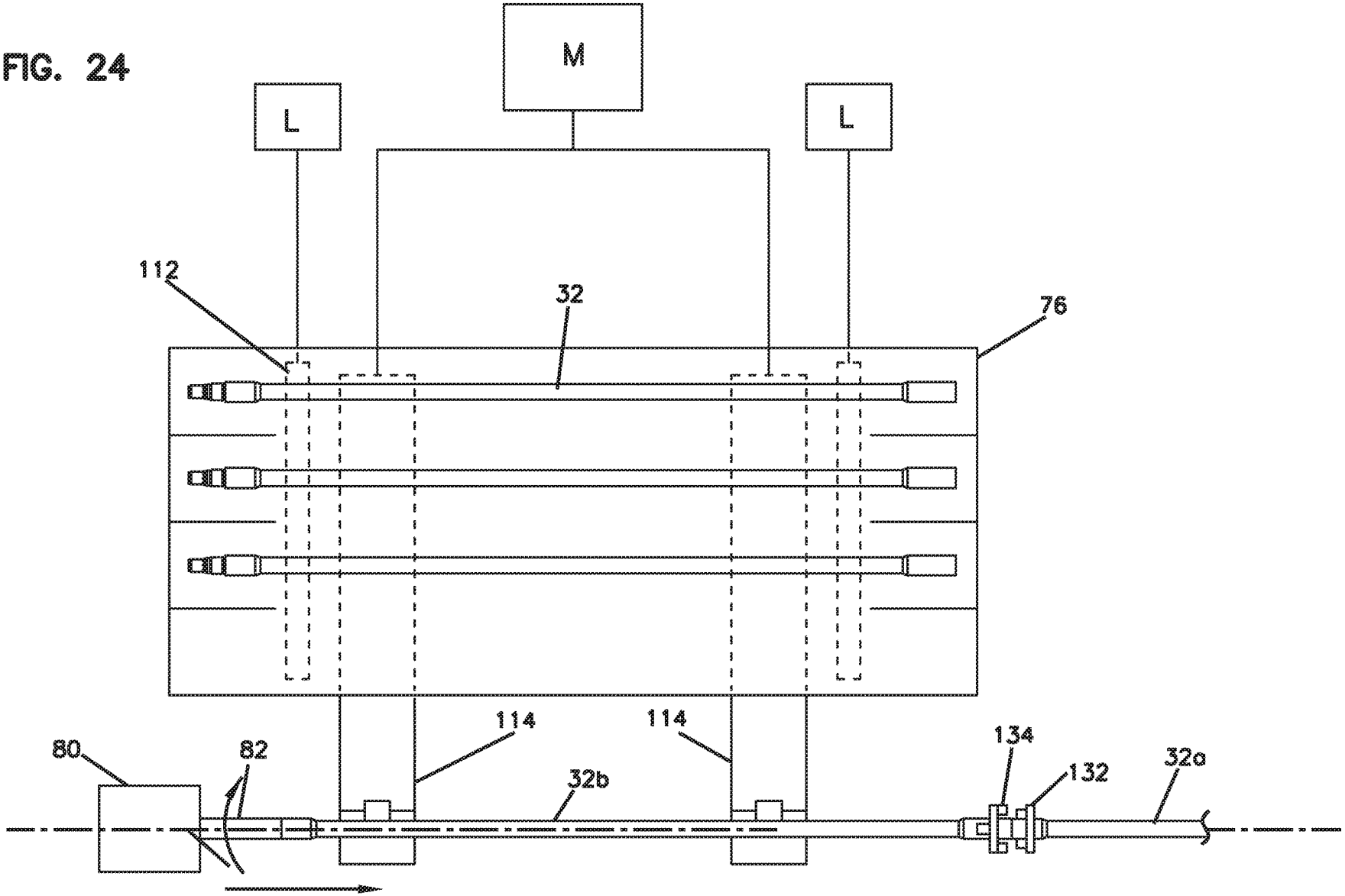
Figure 25:
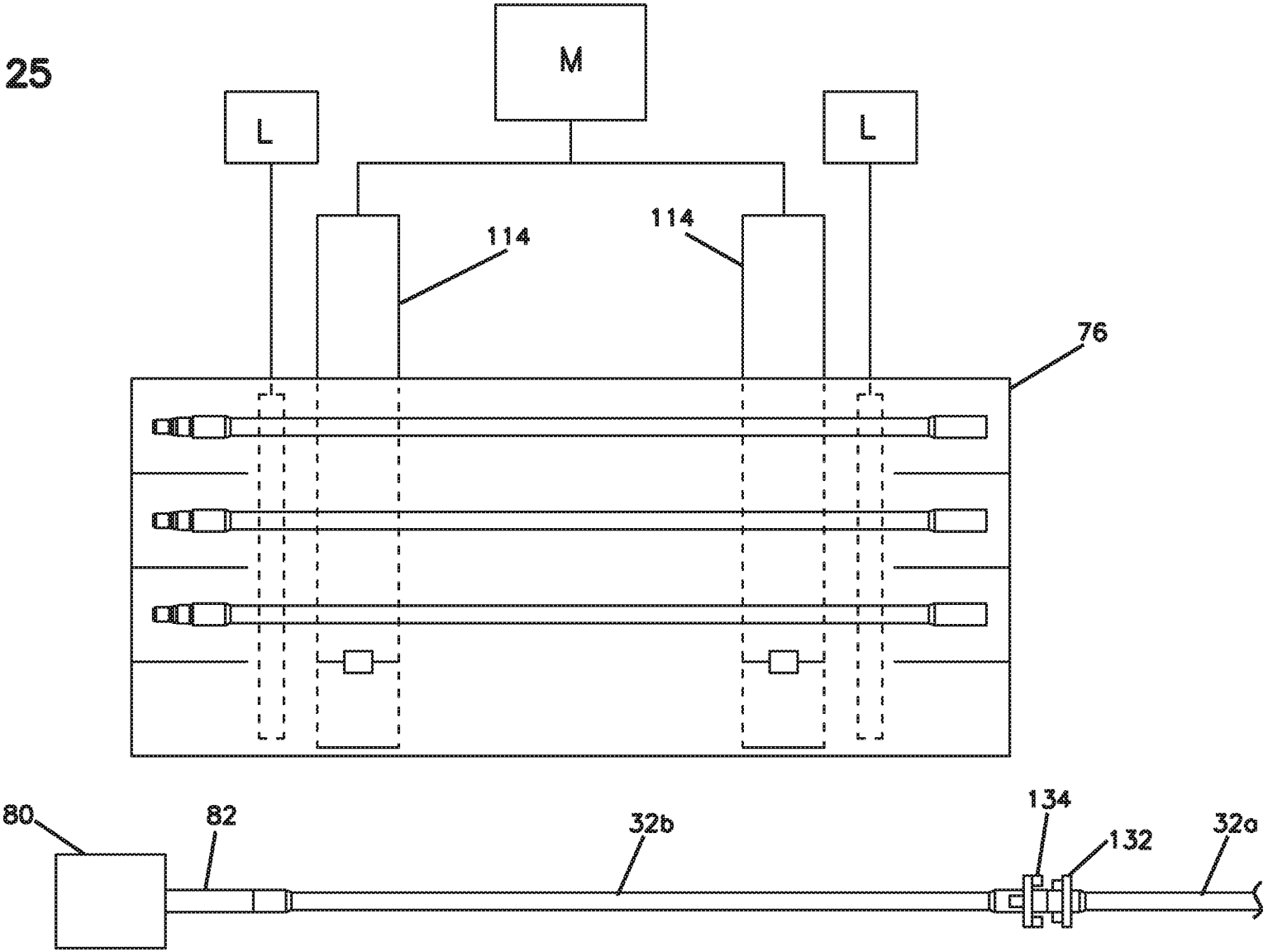
Figure 26:
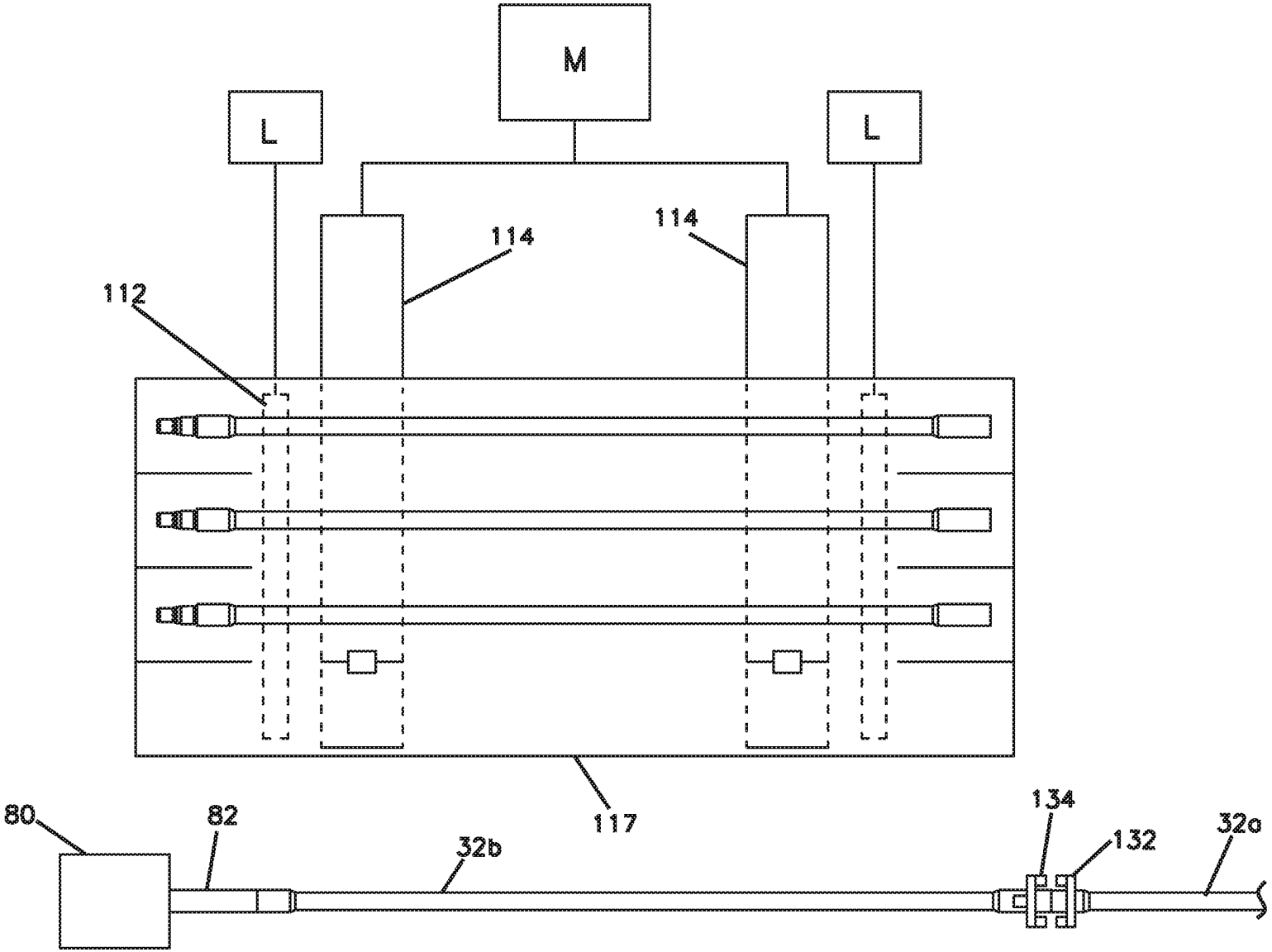
FIGS. 26-37 are schematic views of the drilling machine of FIG. 4 showing an example sequence for removing drill rods from a drill string during a pullback operation after drilling.
Figure 27:
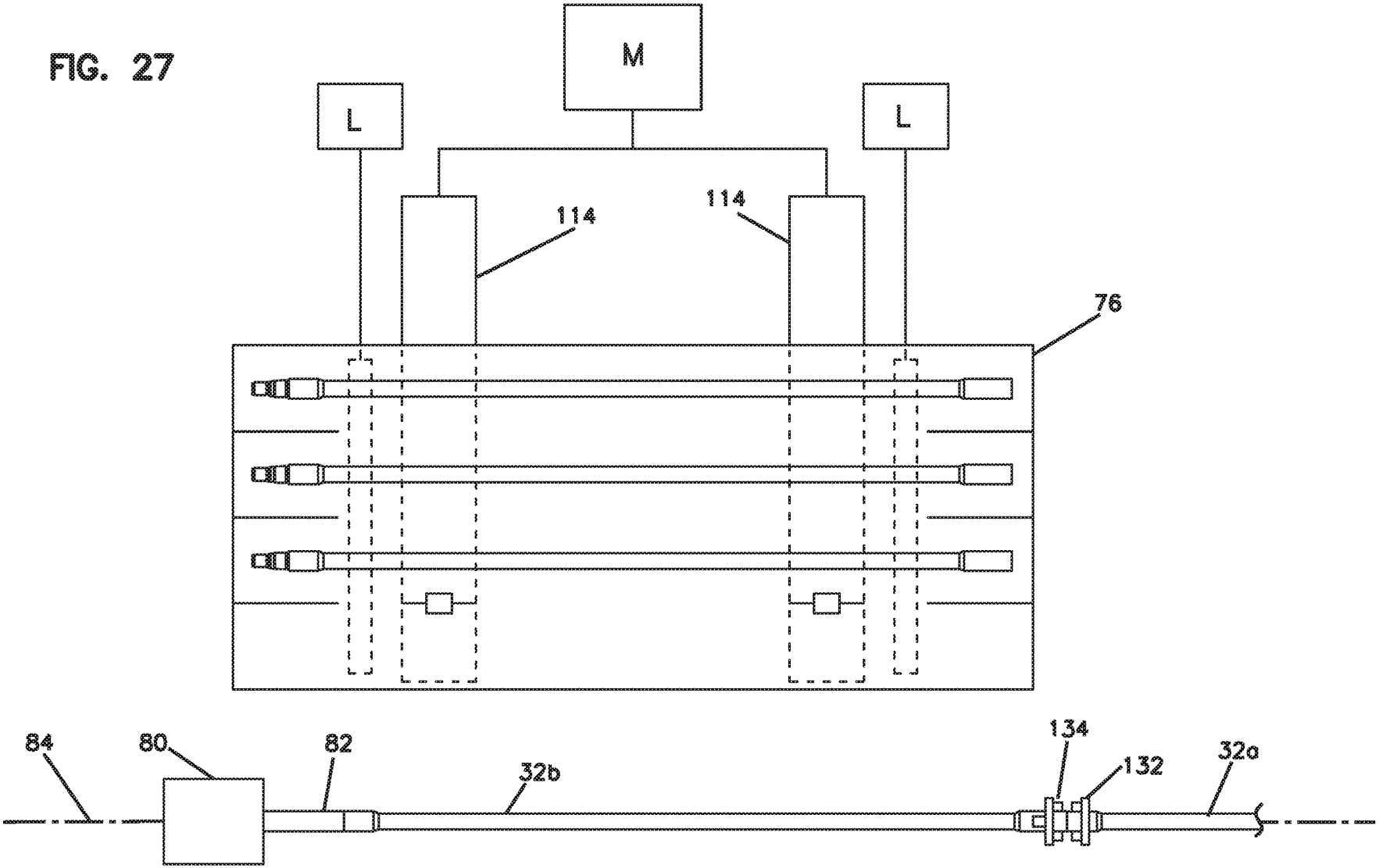
Figure 28:
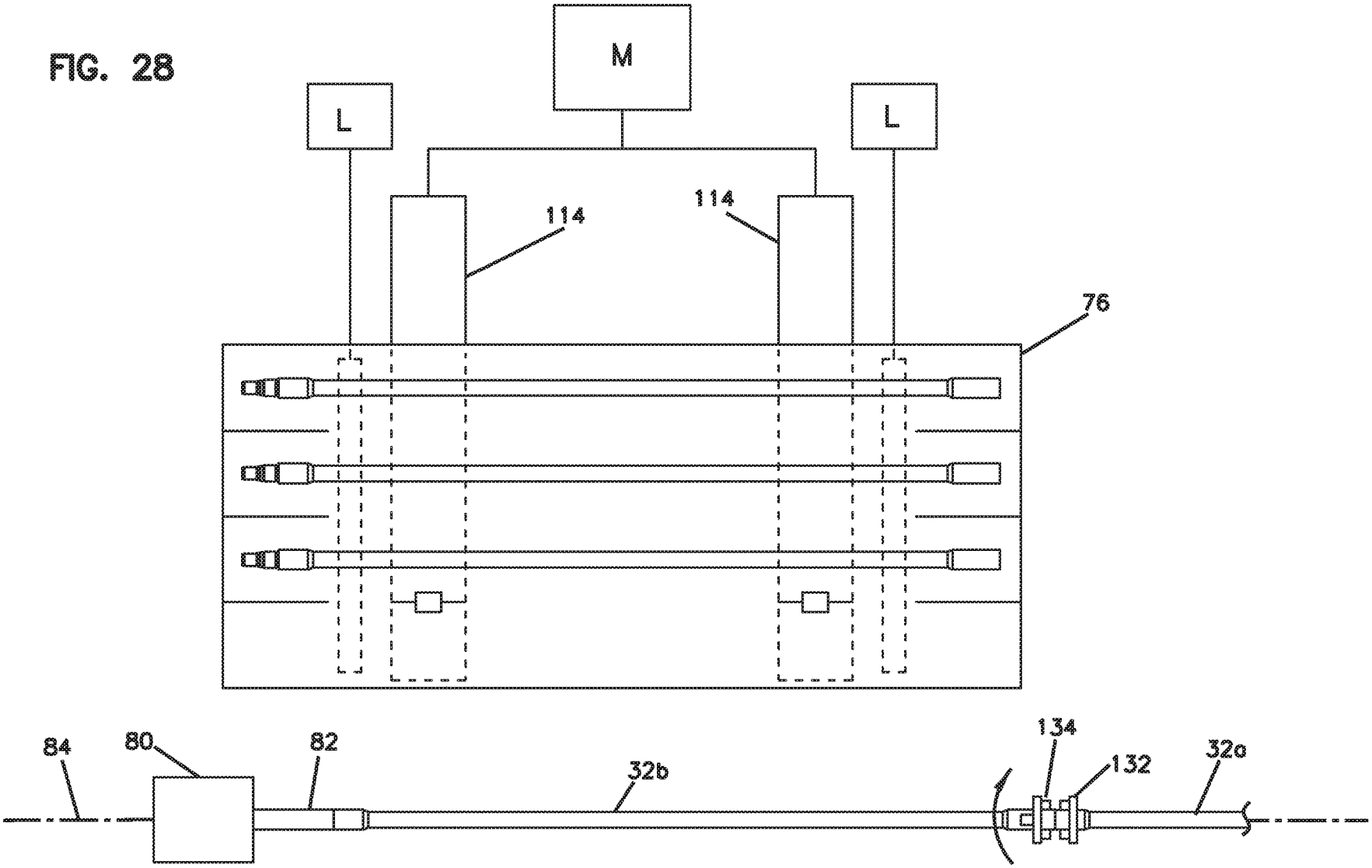
Figure 29:
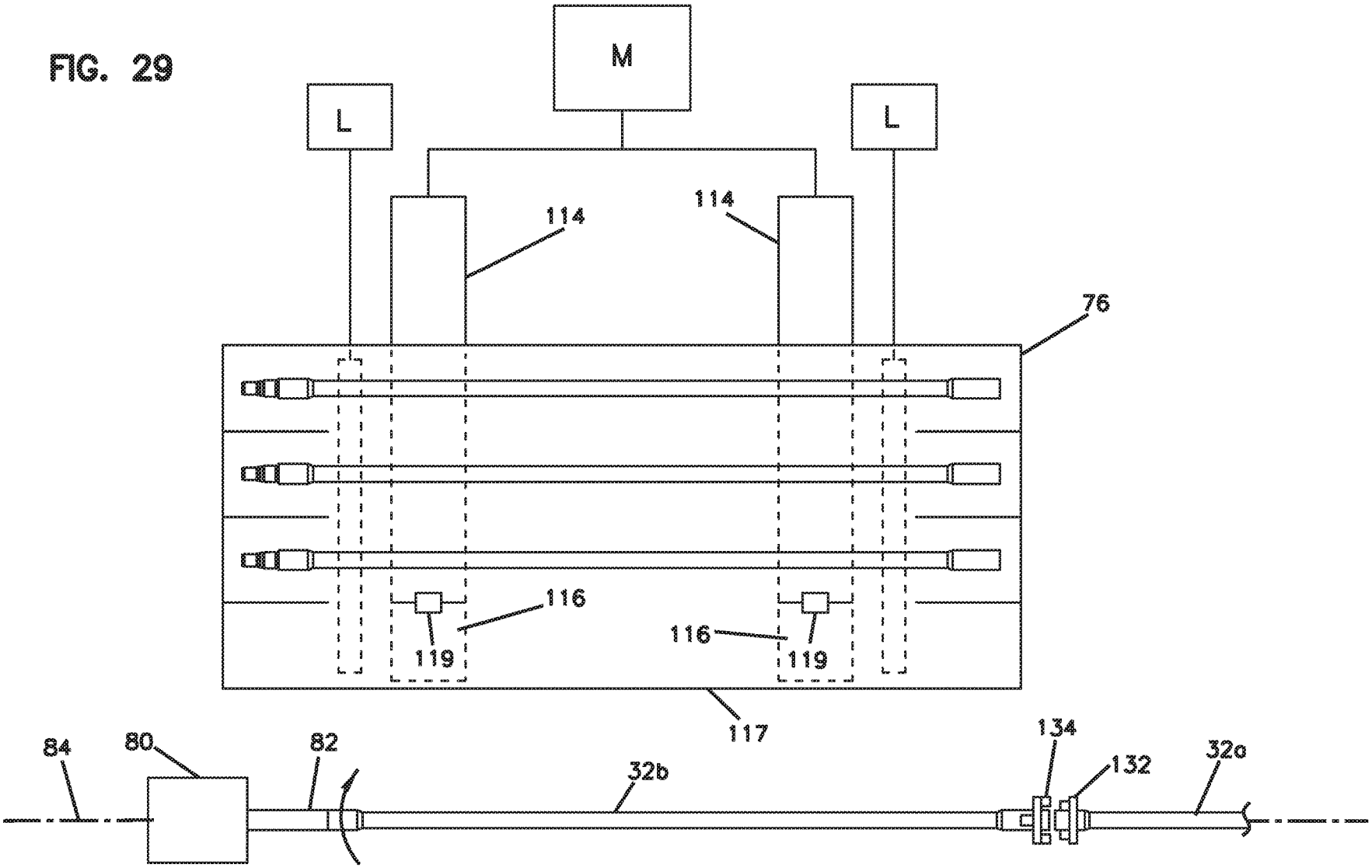
Figure 30:
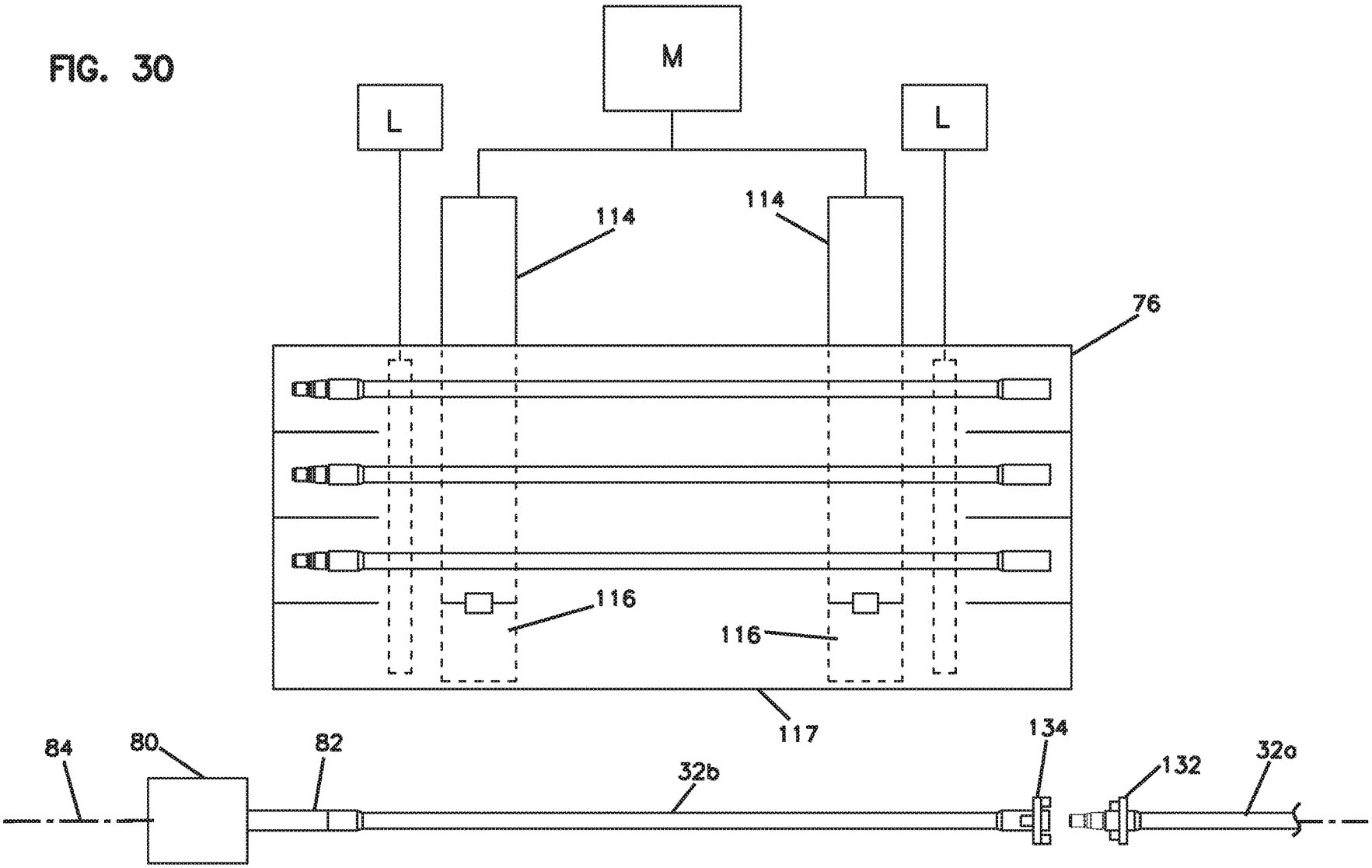
Figure 31:
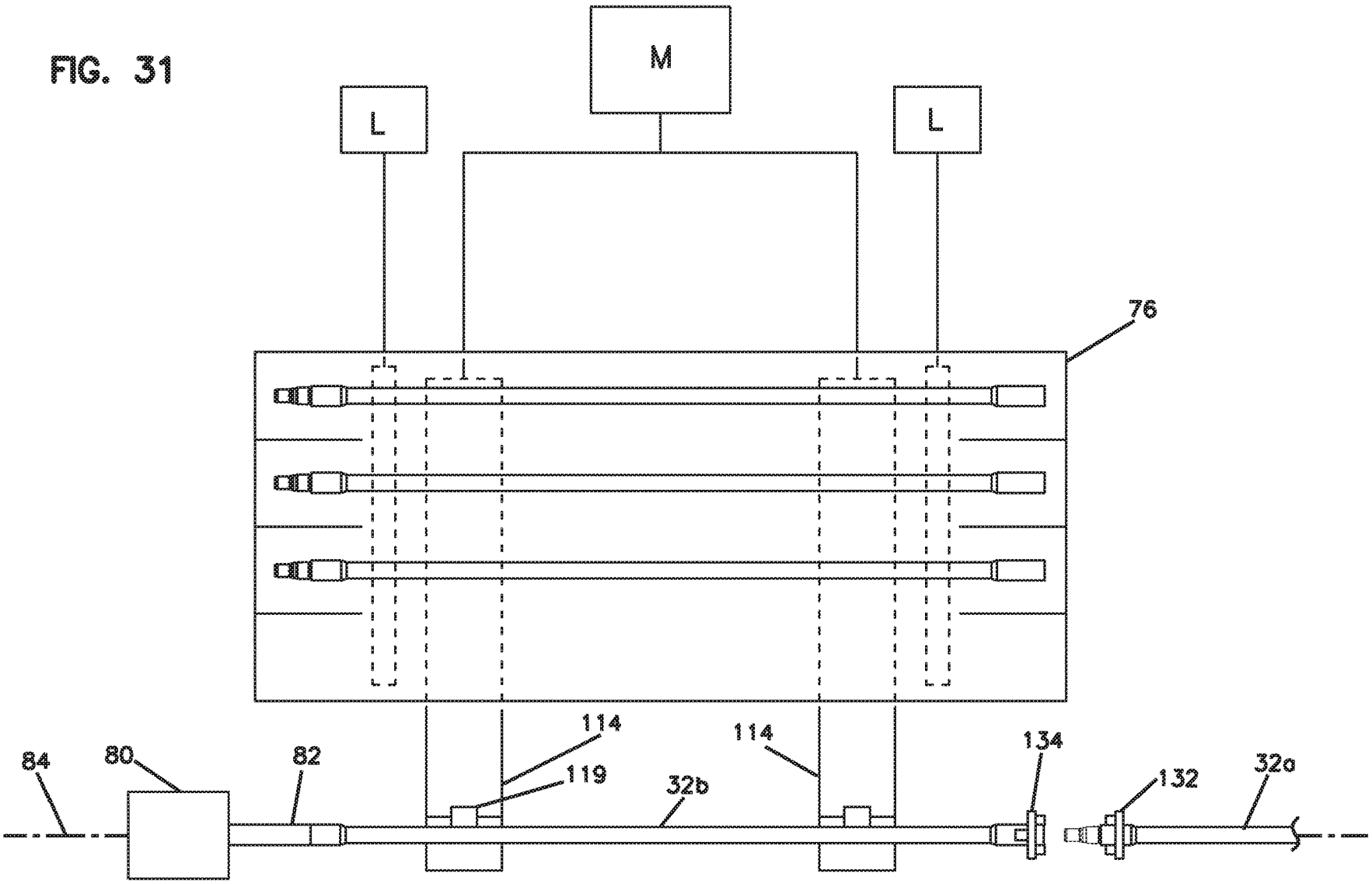
Figure 32:
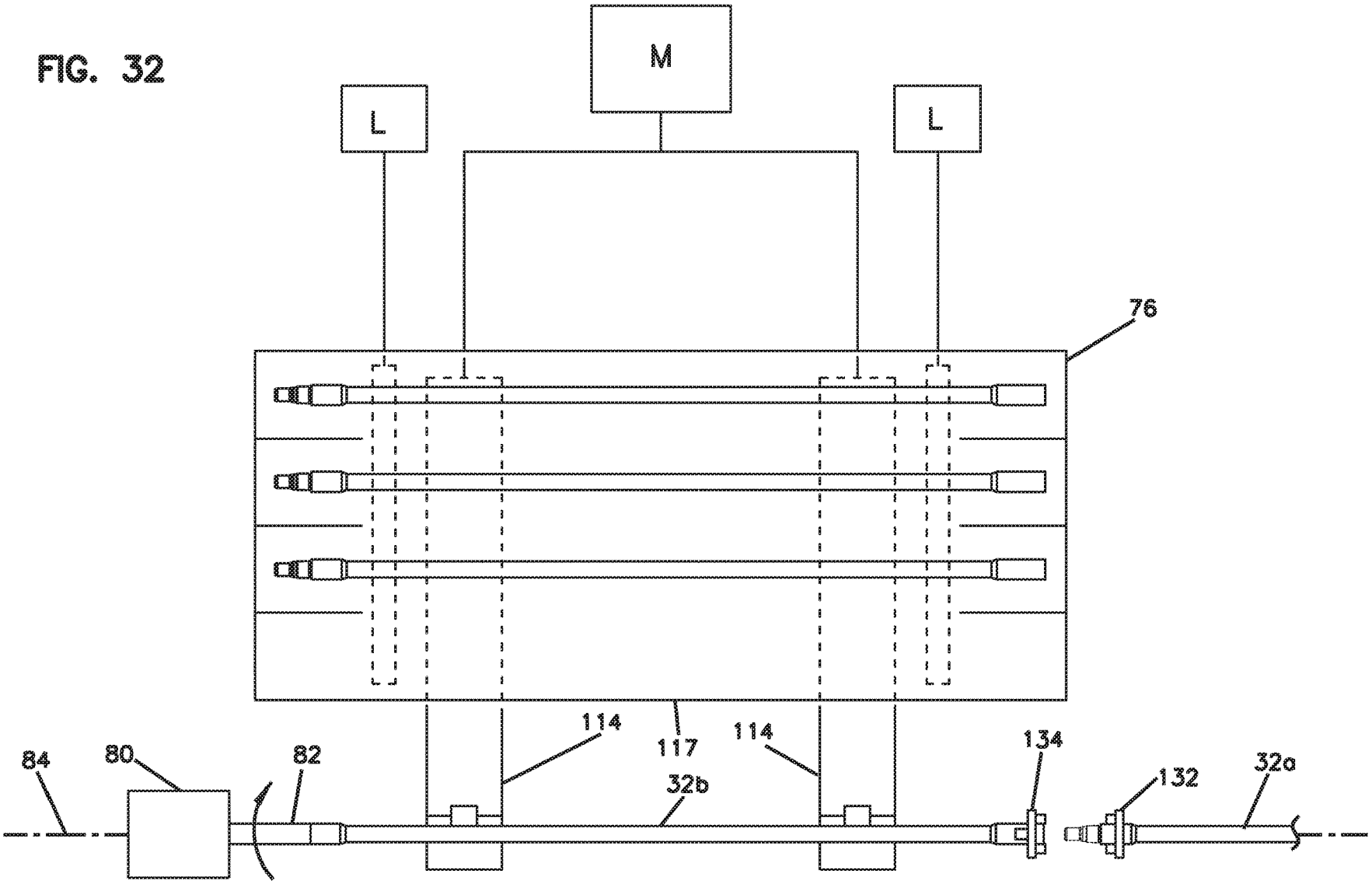
Figure 33:
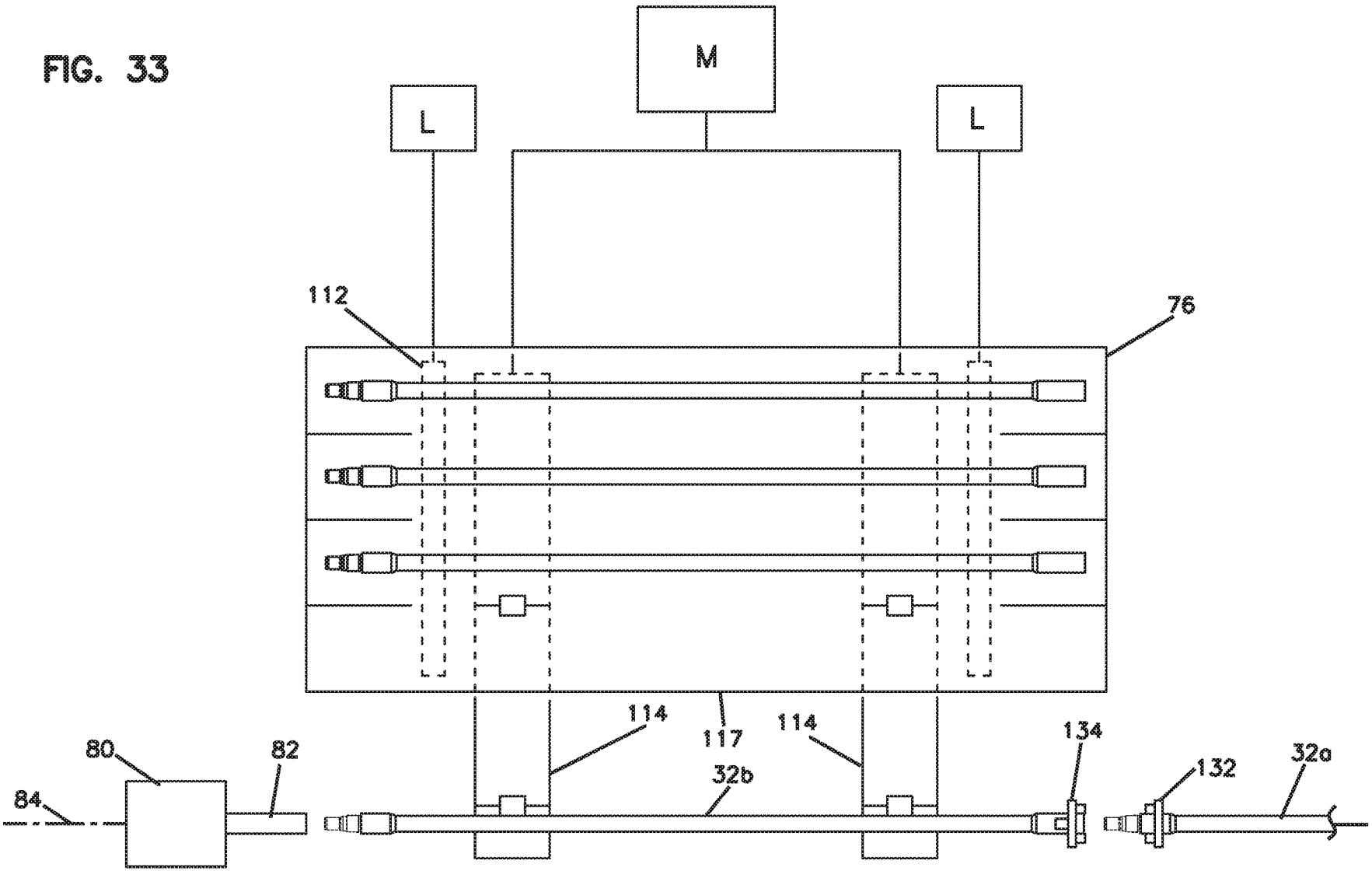
Figure 34:
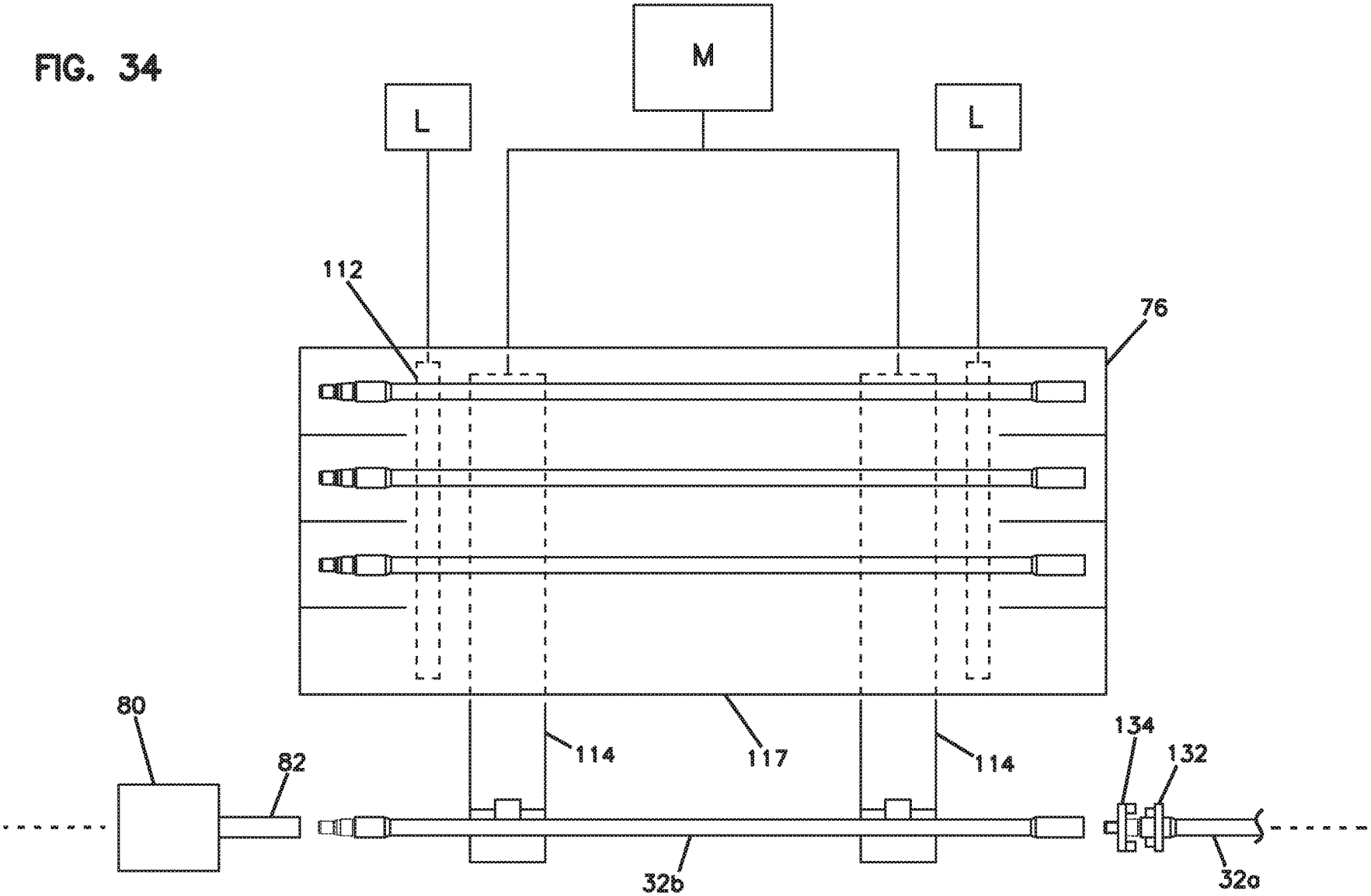
Figure 35:
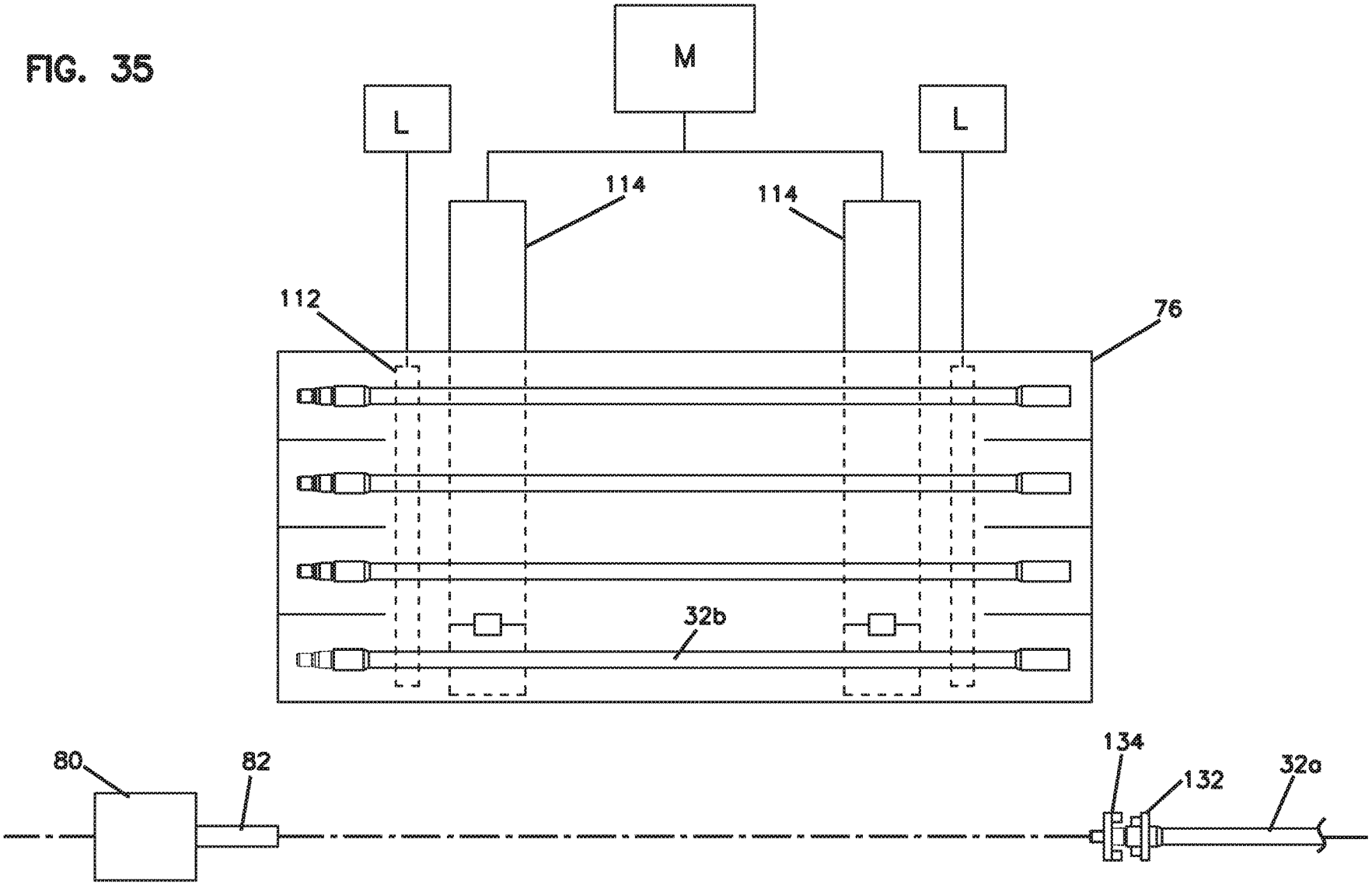
Figure 36:
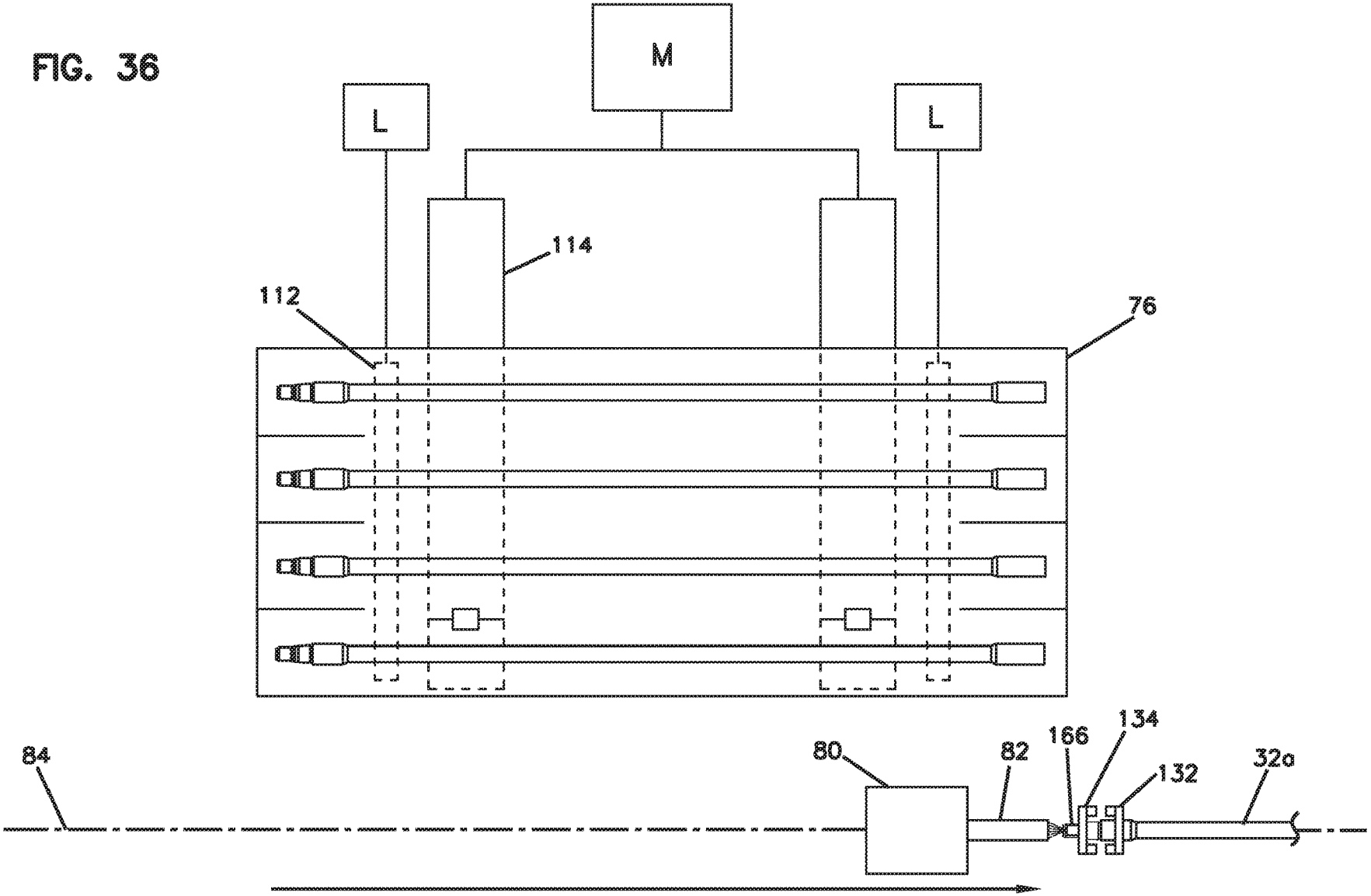
Figure 37:
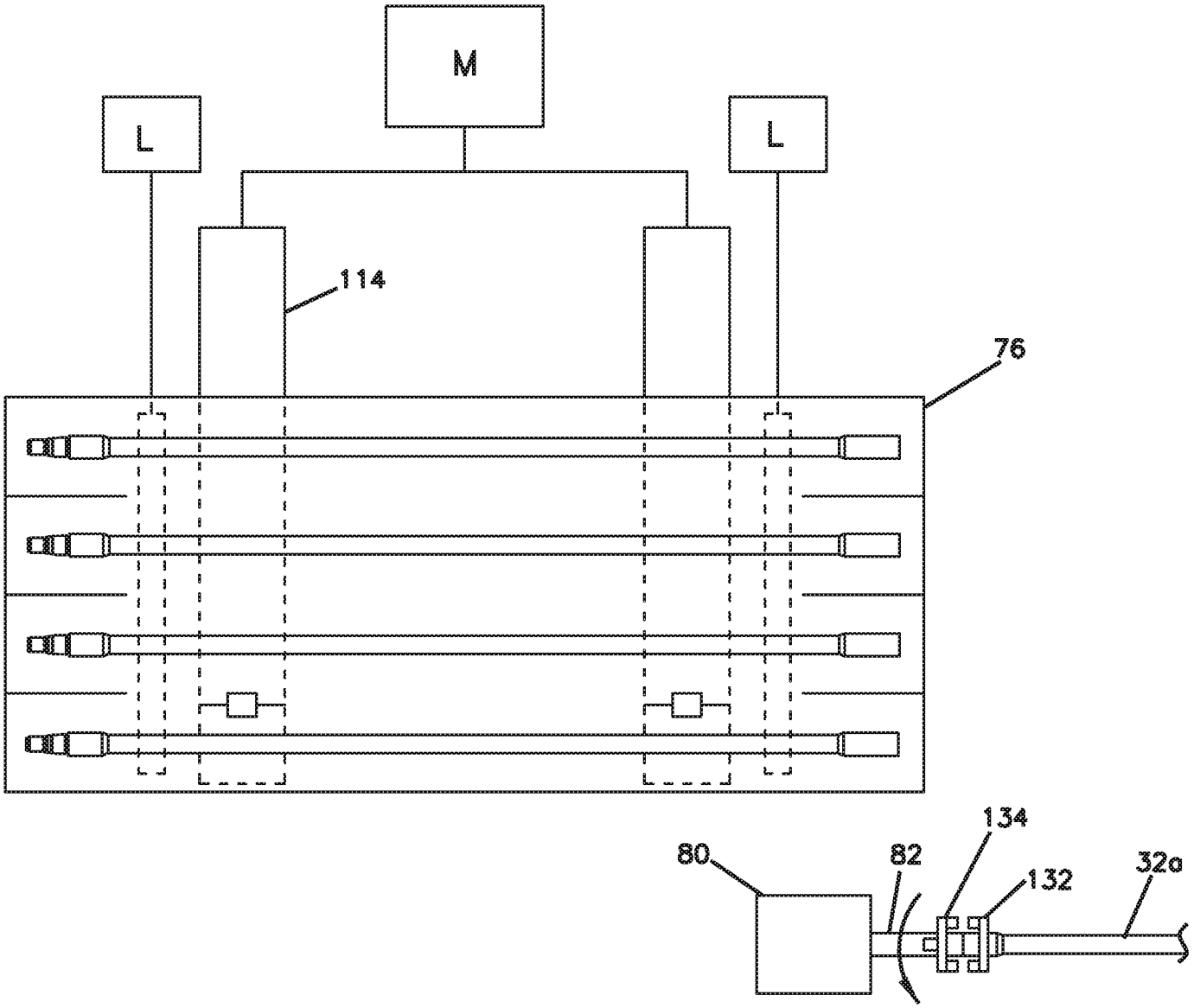

FIGS. 18-26 schematically depict a sequence of operational steps for the machine of FIG. 4 showing a drill rod being added to a drill string to extend the drill string during drilling operations. At FIG. 18, a drill rod 32*a* has just been drilled into the ground and the rod coupler 82 of the rotational driver 80 is coupled to an upper end of the drill rod 32*a*. In this state, the rotational driver 80 is at the bottom of the track 102 adjacent to the rod vise arrangement 130, both rod vises 132, 134 are open, and the upper vise 134 is in the first axial position directly adjacent to the lower vise 132. At FIG. 19, the lower vise 132 is shown closed on the upper end of the drill rod 32*b* to prevent the drill rod 32*a* from rotating as the joint between the upper end of the drill rod 32*a* and the rod coupler 82 is broken. At FIG. 20, the rotational driver 80 reverse rotates the rod coupler 82 and moves slightly up the track 102 along the drive axis 84 to break and unthread the joint with the upper end of the drill rod 32*a*. After the joint is unthreaded, the rotational driver is propelled up the track 102 along the drive axis 84 and is stopped at a lubrication station where the female threaded interface of the rod coupler 82 is intersected by the dispensing axis of the lubricant dispenser 166. As shown at FIG. 21, the lubricant dispenser is actuated to dispense a volume of grease into the rod coupler 82. Next, the rotational driver 80 is moved fully up the track 102 along the axis to a top position of the track where the rod coupler 82 does not obstruct movement of a new rod 32*b* by the rod handling device 110 from the rod storage structure 76 to the drive axis 84 in co-axial alignment with the rod coupler 82 (see FIG. 22). Thereafter, the shuttle arms 114 are extended to transport the drill rod 32*a* along the linear rod transfer path from the rod storage location 76 to the drive axis 84 (see FIG. 23). Next, the rotational driver 80 is moved slowly down the track 102 while rotating the rod coupler 82 to engage and torque-up a threaded joint between the rod coupler 82 and the upper end of the drill rod 32*b* and to also torque-up a threaded joint between the lower end of the drill rod 32*a* and the upper end of the drill rod 32*a* (see FIG. 24). The shuttle arms 114 are then retracted (see FIG. 25) and the lower vise 132 is opened (see FIG. 26). The rotational driver 80 can then be propelled down the track 102 while rotating the rod coupler 82 to drive the drill rod 32*b* into the ground. Once the drill rod 32*b* is in the ground, the drilling machine is again in the configuration of FIG. 18, and the sequence can be repeated for subsequent drill rods until the drill string reaches the termination point.

FIGS. 26-37 schematically depict a sequence of operational steps for the machine of FIG. 4 showing a drill rod being withdrawn from a drill string to retract the drill string during pull-back operations. At FIG. 26, the drill rod 32*b* has been pulled from the ground. In this state, the rotational driver 80 is near the top of the frame 70, the upper vise 134 is in the lower axial position and is pivoted to the home position, both vises 132, 134 are open, the rod coupler 82 is coupled to the upper end of the drill rod 32*b*, the lower end of the drill rod 32*b* is coupled to the upper end of the drill rod 32*a*, the shuttle arms 114 are retracted, and the rods in the rod storage structure are lifted. At FIG. 27, the joint between the drill rods 32*a*, 32*b* is aligned between the rod vises 132, 134, the upper vise 134 has been closed on the enlarged lower end of the drill rod 32*a*, and the lower vise 132 has been closed on the enlarged upper portion of the drill rod 32*b*. The open-top configuration of the vises 132, 134 facilitates properly axially aligning the joint between the vises 132, 134. At FIG. 28, the upper vise 134 is counter rotated to the joint break pivot position thereby breaking the joint between the rods 32*b*, 32*a*. At FIG. 29, the upper vise 134 is opened and moved back to the home pivot position, and the rotational driver 80 counter rotates the rod coupler 82 and moves slowly up the track 102 to fully unthread the joint between the drill rods 32*b* 32*a*. Once the joint is unthreaded, the rotational driver 80 moves up the track 102 to a position where the drill rod 32*b* is aligned with the load/unloading region 117 of the rod storage structure 76, and the upper vise 134 follows the movement of the rotational driver 80 and concurrently moves to the second/upper axial position (see FIG. 30) where the lower end of the drill rod 32*b* is axially received in the upper vise 134. Next, the shuttle arms 114 are extended to receive the drill rod, the upper vise 134 is clamped on the lower end of the drill rod 32*a* (see FIG. 31), and the rod coupler 82 is counter rotated and moved slowly up the track 102 (see FIG. 32) to break and unthread the coupling between the rod coupler and the upper end of the drill rod 32*b*. The rotational driver 80 is moved up the track 102 until the rod coupler 82 clears the upper end of the drill rod 32*b* (see FIG. 33). The upper vise 134 is then opened and moved to the lower axial position where the upper vise 134 does not obstruct movement of the drill rod back to the rod storage structure 76 (see FIG. 34). The rods in the rod storage structure 76 are lowered by the lift 112, the shuttle arms 114 are retracted to move the rod 32*b* under the rod storage structure, and the lift is raised to push the rod 32*b* into a column of the rod storage structure 76 (see FIG. 35). The rotational driver 80 is then moved down the track 102 to the lubrication station where the dispensing axis of the lubricant dispenser 166 intersects the rod coupler 82. Grease is then dispensed into the rod coupler 82 (see FIG. 36). After lubrication, the rotational driver 80 is moved further down the track and the rod coupler 82 is rotated to torque-up a joint with the upper end of the drill rod 32*a* that is clamped in the lower vise 132 (see FIG. 37). The lower vise 132 is released and the rotational driver 80 is moved up the track 102 while the rod coupler 82 is rotated to pull back the rod 32*a* and return to the state of FIG. 26. The process steps are then repeated for each subsequent drill rod until the drill string has been fully withdrawn from the ground.

As used herein, actuators can include pneumatic and hydraulic cylinders, screw drives, electric, hydraulic and pneumatic motors, and like devices. As used herein, terms such as upper, lower, up-hole, and down-hole are relative terms that have been used to assist in describing the relative positioning of certain parts of components. For a component that is above ground, an upper portion of such component is positioned farther from the launch point 24 of the drilling machine as compared to a relative lower portion. Similarly, for a component that is positioned above ground, an up-hole portion of the component is positioned farther from the launch point of the drilling machine as compared to a down-hole portion of the component.

EXAMPLES

Illustrative examples of the underground drilling machine disclosed herein are provided below. An embodiment of the underground drilling machine may include any one or more, and any combination of, the examples described below.

Example 1 is an underground drilling machine including a rotational driver having a rotationally driven rod coupler adapted for connection to an end of a drill rod. The rod coupler is rotatable about a drive axis. The rotational driver is mounted to move back and forth along the drive axis. The underground drilling machine also includes a drill rod storage structure positioned alongside the drive axis and a rod handling device for conveying drill rods back and forth between the drive axis and the rod storage structure along a rod transfer path. The underground drilling machine further includes first and second rod vises positioned along the drive axis. The second rod vise is positioned between the first rod vise and the rotational driver. The second rod vise is movable along the drive axis relative to the first rod vise between a first axial position and a second axial position. The second rod vise is offset from the rod transfer path when in the first axial position, such that the second rod vise does not prevent a drill rod from being moved between the drill rod storage structure and the drive axis by the rod handling device. The second rod vise is intersected by the rod transfer path when in the second axial position, and thereby is positioned so as to obstruct movement of a drill rod between the drill rod storage structure and the drive axis by the rod handling device. The second rod vise is pivotally movable about the drive axis between a first pivotable position and a second pivotable position.

In Example 2, the subject matter of Example 1 is further configured such that, to break a joint between two drill rods, the joint is positioned between the first and second rod vises while the second rod vise is in the first axial position along the drive axis and is also in the first pivotal position about the drive axis. With the joint positioned between the first and second rod vises, the first and second rod vises are clamped on their respective drill rods, and the second rod vise is pivoted from the first pivotal position to the second pivotal position to break the joint. The two drill rods together define an up-hole drill rod and a down-hole drill rod. The up-hole drill rod includes an up-hole end coupled to the rotationally driven rod coupler and a down-hole end coupled to an up-hole end of the down-hole drill rod at the joint. The first rod vise clamps on the up-hole end of the down-hole drill rod and the second vise clamps on the down-hole end of the up-hole drill rod.

In Example 3, the subject matter of Example 2 is further configured such that, once the joint is broken, the second rod vise is unclamped from the up-hole drill rod and the rotational driver is used to fully unthread the joint between the up-hole and down-hole drill rods while the first vise remains clamped on the up-hole end of the down-hole drill rod.

In Example 4, the subject matter of Example 3 is further configured such that, once the joint is fully unthreaded, the rotational driver moves axially in an up-hole direction along the drive axis to pull the up-hole drill rod to a rod loading position aligned with the drill rod storage structure. The second vise moves to the second axial position to support the down-hole end of the up-hole drill rod.

In Example 5, the subject matter of Example 4 is further configured such that the second vise moves from the first axial position to the second axial position concurrently with the up-hole movement of the rotational driver as the up-hole drill rod is moved in the up-hole direction into alignment with the drill rod storage structure.

In Example 6, the subject matter of Example 5 is further configured such that, with the second vise in the second axial position, the second vise is clamped on the down-hole end of the up-hole drill rod and the rotational driver is reverse rotated to unthread the rod coupler from the up-hole end of the up-hole drill rod.

In Example 7, the subject matter of Example 6 is further configured such that the rod handling device is extended to engage and support the up-hole drill rod once the up-hole drill rod has been axially moved into alignment with the drill rod storage structure. The second vise is unclamped after the up-hole end of the up-hole drill rod has been unthreaded from the rod coupler of the rotational driver. The rod handling device supports the up-hole drill rod when the down-hole end of the up-hole drill rod has been unclamped from the second vise and the rotational driver has been unthreaded from the up-hole end of the up-hole drill rod. The rod handling device moves the up-hole drill rod to the rod storage structure after the up-hole drill rod has been unclamped from the second vise and the rotational driver has been unthreaded from the up-hole end of the up-hole drill rod. The second vise moves to the first axial position before the rod handling device moves the up-hole drill rod to the rod storage structure.

In Example 8, the subject matter of Example 1 further includes an up-hole rod centering member corresponding to the second vise and a down-hole rod centering member corresponding to the first vise. The first and second vises are positioned between the up-hole and down-hole centering members. The up-hole and down-hole centering members are configured for centering drill rods relative to the first and second vises while the first and second vises are open.

In Example 9, the subject matter of Example 8 is further configured such that the up-hole rod centering member is carried with the second vise as the second vise moves between the first and second axial positions.

In Example 10, the subject matter of Example 8 is further configured such that the up-hole rod centering member has an up-hole face having a tapered lead-in. The down-hole rod centering member includes a down-hole face with a tapered lead-in.

In Example 11, the subject matter of Example 8 is further configured such that the up-hole and down-hole rod centering members define rod centering openings having diameters that are smaller than a cross-dimension spacing defined between opposing jaws of the first and second vises when the first and second vises are open.

In Example 12, the subject matter of Example 11 is further configured such that the up-hole and down-hole rod centering members include rod centering rings that are centered on the drive axis. The first and second vises have vise clamping axes that are co-axial with the drive axis.

In Example 13, the subject matter of Example 8 is further configured such that the drill rods include enlarged end portions having enlarged outer diameters as compared to intermediate portions of the drill rods, wherein, when two drill rods are coupled end-to-end at a joint, the coupled enlarged end portions at the joint define a length, and wherein, when the second vise is in the first axial position, a spacing between the first and second centering members is less than or equal to the length.

In Example 14, the subject matter of Example 1 is further configured such that, when the second vise is in the second axial position, the second vise will obstruct a drill rod from being moved from the rod storage structure to the drive axis by the rod handling device.

In Example 15, the subject matter of Example 1 is further configured such that the rod handling device does not include any clamping members between which drill rods are clamped.

In Example 16, the subject matter of Example 1 is further configured such that the rod handling device includes at least one shuttle member that is linearly moved between retracted and extended positions.

In Example 17, the subject matter of Example 16 is further configured such that the shuttle member includes a shelf for supporting a drill rod and at least one magnet for holding the drill rod on the shelf.

In Example 18, the subject matter of Example 1 is further configured such that the first vise is positioned down-hole with respect to the second vise, and wherein the first vise is not axially movable along the drive axis.

In Example 19, the subject matter of Example 1 further includes a joint lubricant dispenser carried with the second vise.

In Example 20, the subject matter of Example 19 is further configured such that the joint lubricant dispenser is positioned to dispense joint lubricant along a dispensing axis that is oriented at an oblique angle relative to the drive axis.

In Example 21, the subject matter of Example 20 is further configured such that the oblique angle of the dispensing axis is in the range of 20-70 degrees relative to the drive axis.

In Example 22, the subject matter of Example 20 is further configured such that the oblique angle of the dispensing axis is in the range of 30-60 degrees relative to the drive axis.

In Example 23, the subject matter of Example 19 is further configured such that the rod coupler includes a female connection interface with internal threads. The joint lubricant dispenser dispenses joint lubricant into the female connection interface.

In Example 24, the subject matter of Example 19 is further configured such that the joint lubricant dispenser dispenses grease into a female connection interface.

In Example 25, the subject matter of Example 1 is further configured such that the first vise includes an open top side.

In Example 26, the subject matter of Example 1 is further configured such that an open side of the second rod vise faces upwardly when the second rod vise is in the first pivotal position.

Example 27 is an underground drilling machine that includes a rotational driver that includes a rotationally driven rod coupler that is adapted for connection to an end of a drill rod. The rod coupler is rotatable about a drive axis and the rotational driver is mounted to move back and forth along the drive axis. The rod coupler includes a female connection interface that includes internal threads. The underground drilling machine includes a drill rod storage structure that is positioned alongside the drive axis. The underground drilling machine includes a rod handling device for conveying drill rods back and forth between the drive axis and the drill rod storage structure. The underground drilling machine includes at least one rod vise that is positioned along the drive axis. The underground drilling machine includes a joint lubricant dispenser that is positioned for dispensing joint lubricant into the female connection interface. The joint lubricant dispenser is axially movable along the drive axis.

In Example 28, the subject matter of Example 27 is further configured such that the joint lubricant dispenser is positioned to dispense joint lubricant along a dispensing axis that is oriented at an oblique angle relative to the drive axis.

In Example 29, the subject matter of Example 28 is further configured such that the oblique angle of the dispensing axis is in the range of 20-70 degrees relative to the drive axis.

In Example 30, the subject matter of Example 28 is further configured such that the oblique angle of the dispensing axis is in the range of 30-60 degrees relative to the drive axis.

In Example 31, the subject matter of Example 27 further includes a translatable vise that is movable along the drive axis between first and second axial positions. The joint lubricant dispenser is carried with the translatable vise as the translatable vise moves between the first and second axial positions.

In Example 32, the subject matter of Example 27 is further configured such that the joint lubricant dispenser is part of a joint lubricant dispensing system for dispensing joint lubricant only into the female connection interface and not directly onto threads of the drill rod.

Example 33 is an underground drilling machine that includes a rotational driver that includes a rotationally driven rod coupler that is adapted for connection to an end of a drill rod. The rod coupler is rotatable about a drive axis and the rotational driver is mounted to move back and forth along the drive axis. The underground drilling machine includes a drill rod storage structure positioned alongside the drive axis. The underground drilling machine includes a rod handling device for conveying drill rods back and forth between the drive axis and the drill rod storage structure. The underground drilling machine includes a first rod vise that is positioned along the drive axis. The underground drilling machine includes a second rod vise positioned along the drive axis. The second rod vise is positioned between the first rod vise and the rotational driver. The second rod vise is pivotally movable about the drive axis between a first pivotal position and a second pivotal position. The underground drilling machine includes a first rod guide/support that corresponds to the first vise and a second rod guide/support that corresponds to the second vise. The first and second rod guides/supports are configured to center drill rods relative to the first and second vises while the first and second vises are open. The first and second vises are positioned between the first and second rod guides/supports.

In Example 34, the subject matter of Example 33 is further configured such that the first rod guide/support includes a first tapered lead-in that faces away from the rotational driver. The second rod guide/support includes a tapered lead-in that faces toward the rotational driver.

In Example 35, the subject matter of Example 33 is further configured such that the first and second rod guides/supports include guide/support rings.

In Example 36, the subject matter of Example 35 is further configured such that the guide/support rings are centered on the drive axis. The first and second vises have vise clamping axes that are co-axial with the drive axis.

In Example 37, the subject matter of Example 33 is further configured such that the drill rods include enlarged end portions having enlarged outer diameters as compared to intermediate portions of the drill rods. When two drill rods are coupled end-to-end at a joint, the coupled enlarged end portions at the joint define a length. A spacing between the first and second rod guides/supports is less than or equal to the length.

Example 38 is an underground drilling machine that includes a rotational driver that includes a rotationally driven rod coupler that is adapted for connection to an end of a drill rod. The rod coupler is rotatable about a drive axis and the rotational driver is mounted to move back and forth along the drive axis. The underground drilling machine includes a drill rod storage structure positioned alongside the drive axis. The underground drilling machine includes a rod handling device for conveying drill rods back and forth between the drive axis and the drill rod storage structure. The underground drilling machine includes at least one rod vise positioned along the drive axis. The underground drilling machine includes a joint lubricant dispensing system for dispensing joint lubricant only into the female connection interface and not directly onto threads of the drill rod.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. An underground drilling machine comprising:

a rotational driver including a rotationally driven rod coupler adapted for connection to an end of a drill rod, the rod coupler being rotatable about a drive axis, the rotational driver being mounted to move back and forth along the drive axis;

a drill rod storage structure positioned alongside the drive axis;

a rod handling device for conveying drill rods back and forth between the drive axis and the drill rod storage structure along a rod transfer path;

a first rod vise positioned along the drive axis and having a clamping axis co-axial with the drive axis;

a second rod vise positioned along the drive axis and having a clamping axis co-axial with the drive axis, the second rod vise being positioned between the first rod vise and the rotational driver, the second rod vise being movable along the drive axis relative to the first rod vise between a first axial position and a second axial position, the first axial position being located such that the second rod vise is not intersected by the rod transfer path when the second rod vise is in the first axial position, the second axial position being located such that the second rod vise is intersected by the rod transfer path when the second rod vise in the second axial position, the second rod vise being pivotally movable about the drive axis between a first pivotal position and a second pivotal position; and an up-hole rod centering member attached to an up-hole wall of an outer frame of the second vise for movement with the second vise between the first and second axial positions, and a down-hole rod centering member attached to a down-hole wall of an outer frame of the first vise, the first and second vises being positioned between the up-hole and down-hole centering members, the up-hole and down-hole centering members being configured for aligning drill rods with the clamping axes of the first and second vises while the first and second vises are open.

2. The underground drilling machine of claim 1, wherein, to break a joint between two drill rods, the joint is positioned between the first and second rod vises while the second rod vise is in the first axial position along the drive axis and is also in the first pivotal position about the drive axis, wherein, with the joint positioned between the first and second rod vises, the first and second rod vises are clamped on their respective drill rods and the second rod vise is pivoted from the first pivotal position to the second pivotal position to break the joint, wherein the two drill rods together define an up-hole drill rod and a down-hole drill rod, wherein the up-hole drill rod includes an up-hole end coupled to the rotationally driven rod coupler and a down-hole end coupled to an up-hole end of the down-hole drill rod at the joint, and wherein the first rod vise clamps on the up-hole end of the down-hole drill rod and the second vise clamps on the down-hole end of the up-hole drill rod.

3. The underground drilling machine of claim 2, wherein, once the joint is broken, the second rod vise is unclamped from the up-hole drill rod and the rotational driver is used to fully unthread the joint between the up-hole and down-hole drill rods while the first vise remains clamped on the up-hole end of the down-hole drill rod.

4. The underground drilling machine of claim 3, wherein, once the joint is fully unthreaded, the rotational driver moves axially in an up-hole direction along the drive axis to pull the up-hole drill rod to a rod loading position aligned with the drill rod storage structure, and wherein the second vise moves to the second axial position to support the down-hole end of the up-hole drill rod.

5. The underground drilling machine of claim 4, wherein the second vise moves from the first axial position to the second axial position concurrently with the up-hole movement of the rotational driver as the up-hole drill rod is moved in the up-hole direction into alignment with the drill rod storage structure, wherein, with the second vise in the second axial position, the second vise is clamped on the down-hole end of the up-hole drill rod and the rotational driver is reverse rotated to unthread the rod coupler from the up-hole end of the up-hole drill rod.

6. The underground drilling machine of claim 5, wherein the rod handling device is extended to engage and support the up-hole drill rod once the up-hole drill rod has been axially moved into alignment with the drill rod storage structure, wherein the second vise is unclamped after the up-hole end of the up-hole drill rod has been unthreaded from the rod coupler of the rotational driver, wherein the rod handling device supports the up-hole drill rod when the down-hole end of the up-hole drill rod has been unclamped from the second vise and the rotational driver has been unthreaded from the up-hole end of the up-hole drill rod, wherein the rod handling device moves the up-hole drill rod to the rod storage structure after the up-hole drill rod has been unclamped from the second vise and the rotational driver has been unthreaded from the up-hole end of the up-hole drill rod, and wherein the second vise moves to the first axial position before the rod handling device moves the up-hole drill rod to the rod storage structure.

7. The underground drilling machine of claim 1, and second axial positions, wherein the up-hole rod centering member has an up-hole face and wherein the down-hole rod centering member includes a down-hole face with a tapered lead-in.

8. The underground drilling machine of claim 1, wherein the up-hole and down-hole rod centering members define rod centering openings having diameters that are smaller than a cross-dimension spacing defined between opposing jaws of the first and second vises when the first and second vises are open, wherein the up-hole and down-hole rod centering members include rod centering rings that are centered on the drive axis and the clamping axes of the first and second vises.

9. The underground drilling machine of claim 1, wherein the first vise is positioned down-hole with respect to the second vise, and wherein the first vise is not axially movable along the drive axis.

10. The underground drilling machine of claim 1, further comprising a joint lubricant dispenser carried with the second vise, wherein the joint lubricant dispenser is positioned to dispense joint lubricant along a dispensing axis that is oriented at an oblique angle relative to the drive axis.

11. The underground drilling machine of claim 1, wherein the first vise includes an open top side.

12. The underground drilling machine of claim 1, wherein an open side of the second rod vise faces upwardly when the second rod vise is in the first pivotal position.

13. An underground drilling machine comprising:

a rotational driver including a rotationally driven rod coupler adapted for connection to an end of a drill rod, the rod coupler being rotatable about a drive axis, the rotational driver being mounted to move back and forth along the drive axis, the rod coupler including a female connection interface including internal threads;

a drill rod storage structure positioned alongside the drive axis;

a rod handling device for conveying drill rods back and forth between the drive axis and the drill rod storage structure;

at least one rod vise positioned along the drive axis; and a joint lubricant dispenser attached to an up-hole wall of an outer frame of the at least one rod vise and positioned for dispensing joint lubricant in an up-hole direction into the female connection interface, the joint lubricant dispenser being axially movable with the at least one rod vise along the drive axis;

wherein the joint lubricant dispenser is positioned to dispense joint lubricant along a dispensing axis that is oriented at an oblique angle relative to the drive axis, and wherein the oblique angle of the dispensing axis is in the range of 20-70 degrees relative to the drive axis.

14. The underground drilling machine of claim 13, wherein the joint lubricant dispenser is part of a joint lubricant dispensing system for dispensing joint lubricant only into the female connection interface and not directly onto threads of the drill rod.

15. An underground drilling machine comprising:

a rotational driver including a rotationally driven rod coupler adapted for connection to an end of a drill rod, the rod coupler being rotatable about a drive axis, the rotational driver being mounted to move back and forth along the drive axis;

a drill rod storage structure positioned alongside the drive axis;

a rod handling device for conveying drill rods back and forth between the drive axis and the drill rod storage structure;

a first rod vise positioned along the drive axis and having a clamping axis co-axial with the drive axis;

a second rod vise positioned along the drive axis and having a clamping axis co-axial with the drive axis, the second rod vise being positioned between the first rod vise and the rotational driver, the second rod vise being pivotally movable about the drive axis between a first pivotal position and a second pivotal position;

a first rod guide/support attached to a down-hole wall of an outer frame of the first vise and a second rod guide/support attached to an up-hole wall of an outer frame of the second vise, the first and second guides/supports being configured to align drill rods with the clamping axes of the first and second vises while the first and second vises are open, the first and second vises being positioned between the first and second rod guide/supports;

wherein the first rod guide/support includes a first tapered lead-in that faces away from the rotational driver, and wherein the second rod guide/support includes a tapered lead-in that faces toward the rotational driver; and wherein the first and second rod guides/supports include guide/support rings, and wherein the guide/support rings are centered on the drive axis and the clamping axes of the first and second vises.

16. The underground drilling machine of claim 15, wherein the drill rods include enlarged end portions having enlarged outer diameters as compared to intermediate portions of the drill rods, wherein, when two drill rods are coupled end-to-end at a joint, the coupled enlarged end portions at the joint define a length, and wherein a spacing between the first and second rod guides/supports is less than or equal to the length.

* * * * *